US008328415B2

(12) United States Patent
Kachi et al.

(10) Patent No.: US 8,328,415 B2
(45) Date of Patent: Dec. 11, 2012

(54) CLOCK WITH WIRELESS FUNCTION

(75) Inventors: Setsuo Kachi, Nishitokyo (JP); Masahiro Mamiya, Higashimurayama (JP)

(73) Assignee: Citizens Holdings Co., Ltd., Nishitokyo-shi (JP)

( * ) Notice: Subject to any disclaimer, the term of this patent is extended or adjusted under 35 U.S.C. 154(b) by 125 days.

(21) Appl. No.: 12/373,534

(22) PCT Filed: Jul. 13, 2007

(86) PCT No.: PCT/JP2007/064014

§ 371 (c)(1), (2), (4) Date: Jan. 27, 2009

(87) PCT Pub. No.: WO2008/007783

PCT Pub. Date: Jan. 17, 2008

(65) Prior Publication Data

US 2009/0316536 A1 Dec. 24, 2009

(30) Foreign Application Priority Data

Jul. 13, 2006 (JP) ..... 2006-193266
Aug. 10, 2006 (JP) ..... 2006-218881

(51) Int. Cl.
*G04C 11/02* (2006.01)

(52) U.S. Cl. ..... 368/281; 368/47; 368/88

(58) Field of Classification Search ..... 368/278
See application file for complete search history.

(56) References Cited

U.S. PATENT DOCUMENTS 6,411,569 B1 * 6/2002 Megner et al. ..... 368/43
7,321,337 B2 1/2008 Ikeda et al.
7,333,063 B2 * 2/2008 Yano et al. ..... 343/702
7,433,273 B2 10/2008 Oguchi et al.
7,639,569 B2 * 12/2009 Yano et al. ..... 368/47
7,701,806 B2 4/2010 Oguchi et al.
2002/0044501 A1 * 4/2002 Sato ..... 368/281
2002/0071346 A1 6/2002 Paratte et al.
2004/0042344 A1 * 3/2004 Motokawa et al. ..... 368/47
2005/0047282 A1 * 3/2005 Sakurazawa et al. ..... 368/281
2005/0180266 A1 * 8/2005 Hanai ..... 368/47
2005/0185518 A1 * 8/2005 Kawakami et al. ..... 368/232
2005/0196636 A1 9/2005 Kawakami et al.
2006/0126438 A1 * 6/2006 Itou et al. ..... 368/47
2006/0164921 A1 * 7/2006 Gunnarsson et al. ..... 368/47
2006/0250896 A1 * 11/2006 Oguchi ..... 368/47
2007/0008828 A1 * 1/2007 Takasawa ..... 368/232
2007/0041275 A1 * 2/2007 Barras et al. ..... 368/14

(Continued)

FOREIGN PATENT DOCUMENTS

EP 1624525 A1 2/2006

(Continued)

*Primary Examiner* — Sean Kayes

(74) *Attorney, Agent, or Firm* — The Webb Law Firm

(57) ABSTRACT

A timepiece with a wireless function, in which the receiving sensitivity of an antenna is improved and the antenna can reliably receive a prescribed radio wave even in the case in which a watch case or the like made of a conductive metal is used. The timepiece is provided with an antenna that is stored in a housing to receive an external radio wave, a watch case that configures at least a part of the housing, that has at least one portion electrically conductive, and that is separated into a plurality of parts, and an insulating region disposed between at least two parts among the plurality of parts of the watch case to insulate the two parts one from the other.

6 Claims, 35 Drawing Sheets

U.S. PATENT DOCUMENTS

| | | | | |
|---|---|---|---|---|
| 2007/0070818 | A1* | 3/2007 | Inomata et al. | 368/10 |
| 2008/0025152 | A1* | 1/2008 | Yano et al. | 368/47 |
| 2009/0003141 | A1* | 1/2009 | Ozawa | 368/294 |
| 2010/0054087 | A1* | 3/2010 | Matsuzaki | 368/14 |

FOREIGN PATENT DOCUMENTS

| | | | |
|---|---|---|---|
| JP | 61122586 | U | 8/1986 |
| JP | 6080192 | U | 11/1994 |
| JP | 7280967 | A | 10/1995 |
| JP | 2001296373 | A | 10/2001 |
| JP | 2003050983 | A | 2/2003 |
| JP | 2003222686 | A | 8/2003 |
| JP | 2004325315 | A | 11/2004 |
| JP | 20042354365 | A | 12/2004 |
| JP | 2005212461 | A | 8/2005 |
| JP | 2006105864 | A | 4/2006 |
| JP | 2006112892 | A | 4/2006 |

* cited by examiner

PRIOR ART

CLOCK WITH WIRELESS FUNCTION

TECHNICAL FIELD

The present invention relates to a timepiece with a wireless function, particularly to a timepiece provided with an antenna capable of receiving a prescribed radio wave and a conductive housing for storing the antenna. More specifically, the present invention relates to a timepiece in which a watch case that configures at least a part of the housing and that has at least one portion conductive is provided with a plurality of separated parts such as a conductive body, a conductive bezel, and a conductive dial ring.

Moreover, the present invention relates to a timepiece with a wireless function, particularly to a timepiece that is provided with a conductive bezel and in which an antenna capable of receiving a prescribed radio wave is stored in a conductive housing.

Moreover, the present invention relates to a timepiece with a wireless function, particularly to a timepiece that is provided with a conductive dial ring and in which an antenna capable of receiving a prescribed radio wave is stored in a conductive housing.

BACKGROUND ART

Conventionally, a timepiece with a wireless function such as a personal computer communication function, a cellular phone function, and a noncontact IC card function has been well known. As such a timepiece with a wireless function, a timepiece with a wireless function for receiving a long-wave standard radio wave (carrier wave) including time information and for correcting clock time based on the time information has been also widely known.

Similarly to other communication devices, the timepiece with a wireless function must be provided with an antenna for receiving a prescribed radio wave. Consequently, it is thought that a housing that is a chassis for storing the antenna that receives a radio wave is made of a nonconductive material such as a synthetic resin from a viewpoint of a function for receiving a radio wave, which is so-called receiving sensitivity.

However, the timepiece with a wireless function is a timepiece which requires the beauty and luxury as an ornament or an accessory unlike other communication devices. Consequently, it is required to adopt not a nonconductive material such as a synthetic resin but a conductive material, that is, a metal material as a material of the housing that is a chassis for storing the antenna that receives a radio wave.

The reason of the above requirement is that a housing made of a synthetic resin gives the cheap appearance and wearing sense to a user from a viewpoint of a texture, a color tone, and lightness in weight. On the other hand, a metal housing gives the luxury appearance and wearing sense to a user.

The demand to the metal housing is extremely remarkable for a wristwatch as a portable accessory of a user. However, in the case in which the antenna is stored in the conductive housing, that is, the metal housing, a magnetic flux generated around the antenna is absorbed in the metal housing that is a conductive material, thereby preventing a resonance phenomenon. Consequently, a receiving function for receiving the standard radio wave by the antenna is extremely degraded.

Therefore, a variety of proposals for improving receiving sensitivity has been carried out.

For instance, Patent document 1 (Japanese Patent Application Laid-Open Publication No. 2004-325315) discloses a radio controlled timepiece, in particular a radio controlled wristwatch, provided with a metal housing that is a metal chassis. More specifically, as shown in FIG. 34, a radio controlled wristwatch 100 is provided with a housing 102.

The vertical direction described in the present specification means the upward and downward direction in the cross sectional views of FIGS. 34 and 2 and so on. Consequently, the upper face is a face exposed outside in the state in which a user wears the wristwatch on the wrist, and the lower face is a face that faces the wrist in the same state.

The planar direction is a direction perpendicular to the vertical direction and means a horizontal direction in the cross sectional views of FIGS. 34 and 2 and so on. In some cases, the planar direction corresponds to a longitudinal direction of a band or a width direction of a band.

The housing 102 is provided with a watch case 104 that configures a metal frame, a rear cover 106 made of a metal mounted to the watch case 104 in such a manner that the rear cover 106 covers a lower opening section of the watch case 104 in a sealing state, and a windshield (glass) 108 mounted to the watch case in such a manner that the windshield 108 covers an upper opening section of the watch case in a sealing state.

The housing 102 contains a movement 110 that configures a clock drive section and a dial plate 112 made of a metal disposed on the movement 110.

An antenna 116 for receiving the standard radio wave is disposed under the lateral part of the movement 110.

A minute hand and an hour hand are mounted to a hand spindle that protrude from the movement 110 and that penetrate the dial plate 112 although this is not shown in the figure. The minute hand and the hour hand are located between the dial plate 112 and the windshield 108 to indicate time.

For the radio controlled wristwatch 100 in which a metal external packaging is adopted, the antenna 116 is shielded by the metal watch case 104, the metal rear cover 106, and the metal dial plate 112. Consequently, an external radio wave is blocked by the metal parts, thereby preventing a radio wave from being received by the antenna 116 disposed in the housing 102.

In particular, in the case in which the metal watch case 104, the metal rear cover 106, and the metal dial plate 112 are made into contact directly with each other, a loop is formed electromagnetically among the metal watch case 104, the metal rear cover 106, and the metal dial plate 112. The loop is closed electromagnetically, whereby an external radio wave is further hard to reach the antenna 116.

To avoid such a phenomenon, for the radio controlled wristwatch 100 disclosed in Patent document 1, the metal dial plate 112 is covered by an insulating film 114, and an insulating layer 118 is formed between the watch case 104 and the rear cover 106.

By the above configuration, a loop is not formed electromagnetically among the metal watch case 104, the metal rear cover 106, and the metal dial plate 112. Consequently, an external radio wave is hard to be shielded by the metal parts.

Patent document 1: Japanese Patent Application Laid-Open Publication No. 2004-325315

Patent document 2: Japanese Utility Model Application Laid-Open Publication No. 6-80192

However, for the radio controlled wristwatch 100 disclosed in Patent document 1 and depicted in FIG. 34 herein, the watch case 104 made of a metal is located close to the antenna 116 while surrounding the antenna 116 as a ring part made of a metal having a size almost equivalent to a vertical thickness of the radio controlled wristwatch 100.

As described above, the watch case 104 made of a metal extremely larger than other parts shields an external radio wave, thereby preventing a radio wave from being received by the antenna 116 disposed in the housing 102. Consequently, the antenna 116 cannot receive a radio wave sufficiently.

Moreover, in the case in which an external radio wave or a radio wave generated by the antenna 116 causes a magnetic field around the watch case 104 made of a metal to fluctuate periodically, a magnetic flux passing through the opening that vertically penetrates the watch case 104 also fluctuates. As a result, an eddy current is generated in a circumferential direction of the watch case 104 made of a metal due to an electromagnetic induction.

An eddy current generated as described above consumes the energy of a radio wave, thereby reducing the receiving sensitivity of a radio wave of the antenna 116 disposed in the housing 102.

In particular, an eddy current generated on the metal watch case 104 having a large cross section along a vertical direction (diagonal line section of the watch case 104 in FIG. 34) flows as a comparatively large inductive current. Therefore, the eddy current cancels a radio wave transmitted from the outside of the housing 102, thereby reducing the receiving sensitivity of the antenna 116. Consequently, the receiving sensitivity of the antenna 116 cannot be improved sufficiently.

Accordingly, the metal watch case 104 that is disposed around the antenna and that is a conductive part having the largest volume is separated into a plurality of parts, and the parts are insulated one from the other. It is thought that shielding of an external radio wave due to the watch case 104 can be reduced by the above configuration.

Moreover, by separating the watch case 104 into a plurality of parts, a small eddy current is generated for each separated part as compared with a large eddy current generated in the case of the watch case 104 of one body that is not separated into a plurality of parts. Consequently, it is thought that a reduction in the receiving sensitivity of the antenna 116 due to the eddy current can be suppressed.

As a result, even in the case in which the conductive watch case 104 made of a metal is used, it is thought that the receiving sensitivity of the antenna 116 can be improved.

Some radio controlled wristwatches provided with such a housing made of a metal are provided with a bezel as one of a plurality of parts separated from the watch case 104 made of a metal. The bezel is a ring member mainly disposed around the windshield on the upper side of the watch case. In some cases, the bezel is made of a metal from a viewpoint of a beauty, a luxury or the like.

Such a wristwatch provided with a bezel is disclosed in Patent document 2 (Japanese Utility Model Application Laid-Open Publication No. 6-80192). As shown in FIG. 35 herein, a wristwatch 200 is provided with a housing 202. The housing 202 is provided with a watch case 204 that configures a metal frame, a rear cover 206 made of a metal mounted to the watch case 204 in such a manner that the rear cover 206 covers a lower opening section of the watch case 204 in a sealing state, and a windshield (glass) 208 mounted to the watch case in such a manner that the windshield 208 covers an upper opening section of the watch case in a sealing state.

Moreover, the watch case 204 is provided with a watch case body 210 and a bezel 212 disposed above the watch case body 210. A waterproof packing 214 is disposed between the watch case body 210 and the bezel 212.

The housing 202 contains a movement 216 that configures a clock drive section and a dial plate 218 disposed on the movement 216.

A minute hand 222 and an hour hand 224 are mounted to a hand spindle 220 that protrude from the movement 216 and that penetrate the dial plate 218. The minute hand 222 and the hour hand 224 are located between the dial plate 218 and the windshield 208 to indicate time.

For the wristwatch 200 that adopts such a metal external packaging and that is provided with the watch case body 210 and the bezel 212 as one of parts separated from the watch case 204 made of a metal, in the case in which a rear cover 206 that functions as a ground on a human wrist side, the watch case body 210, and the bezel 212 are electrically insulated by the waterproof packing 214, a static electricity from the side of the windshield 208 is stored in the bezel 212 in some cases.

By the operation of a static electricity, as shown by the dashed lines in FIG. 35, the minute hand 222 is abutted to the windshield 208, and the minute hand 222 cannot be moved in some cases. In addition, a static electricity is transmitted to the movement 216 via the minute hand 222, thereby preventing the movement 216 from being operated.

To solve the above problem, in Patent document 2, a conductive paste 226 is disposed between the watch case body 210 and the bezel 212, thereby ensuring an electrical conduction between the watch case body 210 and the bezel 212. Consequently, a static electricity from the windshield 208 side is grounded to a human wrist via the bezel 212, the watch case body 210, and the rear cover 206.

However, Patent document 2 does not target a radio controlled wristwatch in which an antenna is stored in a housing. In addition, even in the case in which the configuration of Patent document 2 for ensuring an electrical conduction between the watch case body 210 and the bezel 212 by forming a conductive paste 226 between the watch case body 210 and the bezel 212 is applied to a radio controlled wristwatch, a loop is formed electromagnetically between the watch case body 210 and the bezel 212, and the loop is closed electromagnetically, whereby an external radio wave is hard to reach the antenna.

Moreover, an eddy current generated on the metal watch case 204 having a large cross section along a vertical direction (diagonal line sections of the watch case body 210 and the bezel 212 in FIG. 35) flows as a comparatively large inductive current. Therefore, the eddy current cancels a radio wave transmitted from the outside of the housing 202, thereby reducing the receiving sensitivity of the antenna. Consequently, the receiving sensitivity of the antenna cannot be improved sufficiently.

Some radio controlled wristwatches provided with such a housing made of a metal are provided with a dial ring as a lining part separated from the watch case or the bezel as one of a plurality of parts separated from the watch case 104 made of a metal. Chiefly, the dial ring is a ring member disposed between the windshield and the dial plate in the housing. The upper surface of the dial ring functions as a mounting face of the windshield, and an inclined surface extending downward from the upper surface to the dial plate functions as an index surface in which an index for indicating a functional display of a watch is arranged.

In some cases, the dial ring is also made of a metal from a viewpoint of a beauty, a luxury or the like.

However, in the case in which the dial ring made of a metal is used for the radio controlled wristwatch provided with a housing made of a metal as described above, the receiving sensitivity of the antenna is greatly reduced disadvantageously. For instance, even in the case in which an insulating later is disposed between a metal rear cover and a metal watch case as disclosed in Patent document 1, a reduction in the receiving sensitivity cannot be sufficiently improved.

The present invention was made in consideration of such conditions, and an object of the present invention is to provide a timepiece with a wireless function in which the metal watch case that is disposed around the antenna and that is a conductive part having the largest volume is separated into a plurality of parts, and the parts are insulated one from the other, whereby shielding of an external radio wave due to the watch case can be reduced. Moreover, by separating the watch case into a plurality of parts, a small eddy current is generated for each separated part as compared with a large eddy current generated in the case of the watch case of one body that is not separated into a plurality of parts, whereby a reduction in the receiving sensitivity of the antenna due to the eddy current can be suppressed for the timepiece with a wireless function. Furthermore, the timepiece with a wireless function has improved receiving sensitivity of the antenna and reliably receives a prescribed radio wave by the antenna even in the case in which a watch case or the like made of a conductive metal is used.

SUMMARY OF THE INVENTION

The present invention was made in order to solve the above problems of the conventional art and to achieve the objective. A timepiece with a wireless function in accordance with the present invention is characterized by comprising a conductive watch case body; a conductive rear cover; a windshield; a non-conductive dial plate; an antenna that is stored in a housing to receive a radio wave from the external having an opening end on each side thereof; and an insulting region disposed between a dial ring and a lining receiving portion, the lining receiving portion is protruded on an inner peripheral side of the watch case body, wherein the insulating region is disposed around a section above both opening ends of the antenna.

By the above configuration, the conductive watch case that is disposed around the antenna and that is a conductive part having the largest volume is separated into a plurality of parts, and the parts are insulated one from the other, whereby shielding of an external radio wave due to the watch case can be reduced. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be improved.

In the present invention, a conductive member is a member of which a material itself is conductive or a member on which a conductive film is coated. In the latter case, a material itself of the member can be any of a nonconductive material, a conductive material, and a combination of a nonconductive material and a conductive material.

On the other hand, a nonconductive member is a member of which a material itself is nonconductive or a member on which a nonconductive film is coated. In the latter case, a material itself of the member can be any of a nonconductive material, a conductive material, and a combination of a nonconductive material and a conductive material.

The timepiece with a wireless function in accordance with the present invention is characterized in that the plurality of parts configuring the watch case include a watch case body and a dial ring in which at least a part thereof is conductive, and an insulating region is disposed between the watch case body and the dial ring to insulate the two parts one from the other.

As described above, a plurality of parts configuring the watch case is composed of a watch case body and a dial ring, and an insulating region is disposed between the watch case body and the dial ring to insulate the two parts one from the other. Consequently, the watch case body and the dial ring are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body and the dial ring, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be extremely improved.

The timepiece with a wireless function in accordance with the present invention is characterized in that the plurality of parts configuring the watch case include a bezel in which at least a part thereof is conductive and a dial ring in which at least a part thereof is conductive, and an insulating region is disposed between the bezel and the dial ring to insulate the two parts one from the other.

As described above, an insulating region is disposed between the bezel and the dial ring to insulate the two parts one from the other. Consequently, the bezel and the dial ring are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the bezel and the dial ring, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be extremely improved.

The timepiece with a wireless function in accordance with the present invention is characterized in that the plurality of parts configuring the watch case include a watch case body, a bezel in which at least a part thereof is conductive, and a dial ring in which at least a part thereof is conductive, and an insulating region is disposed between at least two parts among the watch case body, the bezel, and the dial ring to insulate the parts from each other.

As described above, an insulating region is disposed between at least two parts among the watch case body, the bezel, and the dial ring to insulate the parts from each other. Consequently, the bezel and the dial ring are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body, the bezel, and the dial ring, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be extremely improved.

The timepiece with a wireless function in accordance with the present invention is characterized in that the plurality of parts configuring the watch case include a watch case body and a bezel in which at least a part thereof is conductive, and an insulating region is disposed between the watch case body and the bezel to insulate the two parts one from the other.

As described above, an insulating region is disposed between the watch case body and the bezel to insulate the two parts one from the other. Consequently, the watch case body and the bezel are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body and the bezel, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be extremely improved.

As described above, the conductive dial ring is insulated from the conductive watch case body or the bezel, whereby the receiving sensitivity of the antenna can be extremely improved. It is thought that the above effect is caused by the following operation. It is thought that the receiving sensitivity of the antenna is strongly influenced by the dial ring that is a conductive member, which is located directly above the opening end of the antenna and close to the opening end of the antenna in a vertical direction. More specifically, in the case in which the antenna receives a radio wave from up above, if an inductive current flows in the dial ring, the inductive current operates in such a manner that a radio wave is prevented from being received by the antenna.

However, in the present invention, an insulating region is formed to insulate the dial ring from the conductive watch case body and the bezel that are disposed around the dial ring and to block the conduction between the dial ring and the watch case body or the bezel. Consequently, it is thought that a current pathway between the dial ring and the adjacent watch case body or the bezel is sufficiently blocked, whereby a radio wave shielding operation caused by an inductive current can be greatly suppressed.

Moreover, as described above, the conductive the bezel is insulated from the conductive watch case body or the dial ring, whereby the receiving sensitivity of the antenna can be extremely improved. It is thought that the above effect is caused by the following operation. It is thought that the receiving sensitivity of the antenna is strongly influenced by the bezel that is a conductive member, which is located directly above the opening end of the antenna and close to the opening end of the antenna in a vertical direction. More specifically, in the case in which the antenna receives a radio wave from up above, if an inductive current flows in the bezel, the inductive current operates in such a manner that a radio wave is prevented from being received by the antenna.

However, in the present invention, an insulating region is formed to insulate the bezel from the conductive watch case body and the dial ring that are disposed around the bezel and to block the conduction between the bezel and the watch case body or dial ring. Consequently, it is thought that a current pathway between the bezel and the adjacent watch case body or the dial ring is sufficiently blocked, whereby a radio wave shielding operation caused by an inductive current can be greatly suppressed.

By the configuration of the present invention, the receiving sensitivity can be improved for any timepiece with a wireless function provided with the conductive watch case body, the bezel, and the dial ring. In particular, the receiving sensitivity can be extremely improved in the case in which the lower section of the housing such as a rear cover is conductive, moreover, in the case in which a nonconductive dial plate is disposed above the antenna, such as the case in which a translucent function for transmitting an outside light to the solar cell is imparted.

By the configuration of the present invention, the receiving sensitivity can be improved for any timepiece with a wireless function provided with the conductive watch case body, the dial ring, and the bezel. In particular, the receiving sensitivity can be extremely improved in the case in which the lower section of the housing such as a rear cover is conductive, moreover, in the case in which a nonconductive dial plate is disposed above the antenna, such as the case in which a translucent function for transmitting an outside light to the solar cell is imparted.

In the present invention, a watch case body in which at least a part thereof is conductive, a bezel in which at least a part thereof is conductive, and a dial ring in which at least a part thereof is conductive include a member of which a material itself is conductive, a nonconductive member on which a conductive film is coated, and a combination of any of other conductive materials and any of other nonconductive materials. As specific examples of a conductive material that configures the watch case body, the bezel, and the dial ring, there can be mentioned for instance gold, silver, copper, brass, aluminum, magnesium, zinc, titanium, and an alloy thereof. In addition, stainless steel and tantalum carbide can also be used.

In the present invention, an insulating region is disposed between at least two parts of conductive parts in at least the watch case body, the bezel, and the dial ring. In the present invention, the housing can be one of a variety of housings such as a housing provided with a rear cover, a housing provided with a watch case which a rear cover is integrated with, and a housing provided with a rear cover made of a glass. In addition, the housing can be composed of conductive parts and nonconductive parts. At least a part of the housing is a conductive member.

The timepiece with a wireless function in accordance with the present invention is characterized in that the insulating region is disposed around the section above the antenna.

The timepiece with a wireless function in accordance with the present invention is characterized in that the insulating region is disposed around the sections above the opening ends on the both sides of the antenna while facing the opening ends.

The timepiece with a wireless function in accordance with the present invention is characterized in that the insulating region is disposed around the section above at least one opening end of the antenna while facing the opening end.

Here, a region around the section above the antenna includes a region around the section above at least one opening end of the antenna, preferably a region around the section above the opening ends on the both sides of the antenna.

Here, "the opening end of the antenna" includes a region around the opening end of the antenna. For instance, in the case in which the antenna is in a circular arc shape like a U shape, a circular arc part around the opening end of the antenna is included in "the opening end of the antenna".

It is preferable that the insulating region is disposed around the section above at least one opening end of the antenna while facing the opening end. Moreover, from a viewpoint of improving the receiving sensitivity, it is more preferable that the insulating region is disposed around the sections above the opening ends on the both sides of the antenna while facing the opening ends.

Here, a region around the section above the opening end of the antenna is a region around a location above the opening end of the antenna in a vertical direction of the housing, and is a range shown in FIGS. 4 and 5 for instance.

As described above, by disposing the insulating region around the section above the opening end of the antenna, an inductive current caused by the dial ring can be sufficiently suppressed, thereby improving the receiving sensitivity of the antenna.

Moreover, as described above, by disposing the insulating region around the section above the opening end of the antenna, an inductive current caused by the bezel can be sufficiently suppressed, thereby improving the receiving sensitivity of the antenna.

The timepiece with a wireless function in accordance with the present invention is characterized in that the insulating region is disposed between the upper surface of the lining receiving portion formed on the watch case body and the lower surface of the dial ring disposed on the lining receiving portion.

By the above configuration, at the boundary section between the upper surface of the lining receiving portion and the lower surface of the dial ring, in which the watch case body and the dial ring come into contact with each other at least, the conduction between the watch case body and the dial ring is reliably blocked by the insulating region disposed in the boundary section, thereby improving the receiving sensitivity of the antenna as described above.

The timepiece with a wireless function in accordance with the present invention is characterized in that the insulating region is made of an insulating film formed on at least one of the surface of the dial ring and the surface of the watch case body.

Moreover, the timepiece with a wireless function in accordance with the present invention is characterized in that the insulating film is formed on the entire surface of the dial ring.

As described above, the insulating region can be made of an insulating film, whereby the receiving sensitivity of the antenna can be improved by the simple configuration and a more productive method.

As such an insulating film, there can be mentioned for instance a coating film, a printing film, and a dry plating film that have insulation properties.

As specific examples of the insulating film, there can be mentioned for instance:

a diamond like carbon (DLC) film, an insulating film made of an organic material such as an acrylic material, an urethane material, and a cellulosic material, a chromium compound film containing a chromium compound, and an aluminum oxide film containing an aluminum oxide compound.

As a chromium compound film, there can be mentioned for instance a chromium oxide film containing a chromium oxide compound, a chromium nitride film containing a chromium nitride compound, and a chromium carbide film containing a chromium carbide compound.

As a specific example of a method for forming a coating film that has insulation properties, a method for forming a finish coating film having insulation properties like a clear coat can be mentioned for instance. In this case, after a coating film is formed by the metallic coating, a clear coat that is a transparent or semi-transparent synthetic resin layer can be formed on the metallic coating film.

As specific examples of a coating film that has insulation properties, there can be mentioned for instance a polyurethane resin paint, a fluorine resin paint in which fluorine is mixed in a polymer molecule forming a resin, a vinyl chloride sol paint in which a poly vinyl chloride resin is dispersed in a plasticizing agent, a silicone polyester resin paint made of a silicone polyester resin in which an oil-free polyester resin is denatured by a silicone intermediate, an oil-free polyester resin, an acrylic resin paint, an epoxy resin paint, a silicone acrylic resin paint, a vinyl chloride resin paint, a lacquer, a phenol resin paint, and a chlorinated rubber paint.

In the case in which the insulating region is formed on the entire surface of the dial ring, a method of dipping can be used for instance.

The timepiece with a wireless function in accordance with the present invention is characterized in that the insulating region is made of an insulating member disposed between the dial ring and the watch case body.

Moreover, the timepiece with a wireless function in accordance with the present invention is characterized in that the insulating member is bonded to the dial ring or the watch case body.

As described above, the insulating region can be made of an insulating member, whereby the receiving sensitivity of the antenna can be improved by the simple configuration and a more productive method. As specific examples of such an insulating member, there can be mentioned for instance a member made of a material such as a synthetic resin and a rubber in a sheet shape or the like and a nonconductive member made of a material such as ceramic.

Moreover, the insulating region can be made of a member in which a conductive material is coated with a nonconductive film, or in which an insulating sheet made of a material such as a synthetic resin and a rubber is bonded to a conductive material. In this case, as a conductive material, there can be mentioned for instance gold, silver, copper, brass, aluminum, magnesium, zinc, titanium, and an alloy thereof. In addition, stainless steel and tantalum carbide can also be used. As a nonconductive film, materials described above as specific examples of the insulating film can be used.

In the case in which an insulating member is disposed between the dial ring and the watch case body, an independent insulating sheet can be disposed as a spacer between the dial ring and the watch case body. However, it is more preferable that an insulating member is bonded to one of the dial ring and the watch case body. More specifically, a pressure-sensitive tape or an adhesive tape can be bonded to one of the dial ring and the watch case body.

By the above configuration, the dial ring and the watch case body can be easily built into the watch during an assembly of the watch, thereby improving working property.

The timepiece with a wireless function in accordance with the present invention is characterized in that the insulating region is disposed between the upper surface of the lining receiving portion formed on the bezel and the lower surface of the dial ring disposed on the lining receiving portion.

By the above configuration, at the boundary section between the upper surface of the lining receiving portion and the lower surface of the dial ring, in which the bezel and the dial ring come into contact with each other at least, the conduction between the bezel and the dial ring is reliably blocked by the insulating region disposed in the boundary section, thereby improving the receiving sensitivity of the antenna as described above.

The timepiece with a wireless function in accordance with the present invention is characterized in that the insulating region is made of an insulating film formed on at least one of the surface of the dial ring and the surface of the bezel.

Moreover, the timepiece with a wireless function in accordance with the present invention is characterized in that the insulating film is formed on the entire surface of the dial ring.

As described above, the insulating region can be made of an insulating film, whereby the receiving sensitivity of the antenna can be improved by the simple configuration and a more productive method.

As such an insulating film, an insulating film as described above can be used.

The timepiece with a wireless function in accordance with the present invention is characterized in that the insulating region is made of an insulating member disposed between the dial ring and the bezel.

Moreover, the timepiece with a wireless function in accordance with the present invention is characterized in that the insulating member is bonded to the dial ring or the bezel.

As described above, the insulating region can be made of an insulating member, whereby the receiving sensitivity of the antenna can be improved by the simple configuration and a more productive method. As specific examples of such an insulating member, an insulating member as described above can be used.

The timepiece with a wireless function in accordance with the present invention is characterized in that an insulating region is disposed at least between the upper surface of the lining receiving portion formed on the watch case body and the lower surface of the dial ring disposed on the lining receiving portion and between the inner peripheral face of the bezel and the outer peripheral face of the dial ring.

By the above configuration, at the boundary section between the upper surface of the lining receiving portion and the lower surface of the dial ring, in which the watch case body and the dial ring come into contact with each other at least, and at the boundary section between the inner peripheral face of the bezel and the outer peripheral face of the dial ring, the conduction among the watch case body, the bezel, and the dial ring is reliably blocked by the insulating region disposed in the boundary sections, thereby improving the receiving sensitivity of the antenna as described above.

The timepiece with a wireless function in accordance with the present invention is characterized in that the insulating region is made of an insulating film formed on at least one of the surface of the dial ring, the surface of the watch case body, and the surface of the bezel.

Moreover, the timepiece with a wireless function in accordance with the present invention is characterized in that the insulating film is formed on the entire surface of the dial ring.

As described above, the insulating region can be made of an insulating film, whereby the receiving sensitivity of the antenna can be improved by the simple configuration and a more productive method.

As such an insulating film, an insulating film as described above can be used.

The timepiece with a wireless function in accordance with the present invention is characterized in that the insulating region is made of an insulating member disposed between at least two parts among the dial ring, the watch case body, and the bezel.

The timepiece with a wireless function in accordance with the present invention is characterized in that the insulating member is bonded to any of the dial ring, the watch case body, and the bezel.

As described above, the insulating region can be made of an insulating member, whereby the receiving sensitivity of the antenna can be improved by the simple configuration and a more productive method. As specific examples of such an insulating member, an insulating member as described above can be used.

The timepiece with a wireless function in accordance with the present invention is characterized in that the insulating region is made of an insulating film formed on at least one of the surface of the watch case body and the surface of the bezel.

As described above, the insulating region can be made of an insulating film, whereby the receiving sensitivity of the antenna can be improved by the simple configuration and a more productive method.

As such an insulating film, an insulating film as described above can be used.

The timepiece with a wireless function in accordance with the present invention is characterized in that the insulating region is made of an insulating member disposed between the watch case body and the bezel.

Moreover, the timepiece with a wireless function in accordance with the present invention is characterized in that the insulating member is bonded to the watch case body or the bezel.

As described above, the insulating region can be made of an insulating member, whereby the receiving sensitivity of the antenna can be improved by the simple configuration and a more productive method. As specific examples of such an insulating member, an insulating member as described above can be used.

The timepiece with a wireless function in accordance with the present invention is characterized in that the watch case body is separated into a plurality of watch case body parts, and an insulating region is disposed between at least two parts among the separated watch case body parts to insulate the two parts one from the other.

By the above configuration, the watch case body is separated into a plurality of watch case body parts, and the parts are insulated one from the other, whereby shielding of an external radio wave due to the watch case can be reduced. Therefore, even in the case in which a conductive watch case or the like is used, the receiving sensitivity of the antenna can be improved.

Moreover, the metal watch case that is a conductive part having the largest volume is separated into a plurality of parts, and the parts are insulated, one from the other, whereby a small eddy current is generated for each separated part as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be improved.

The timepiece with a wireless function in accordance with the present invention is characterized in that the insulating region is made of an insulating film formed on the surface of at least one of the plurality of watch case body parts.

As described above, the insulating region can be made of an insulating film, whereby the receiving sensitivity of the antenna can be improved by the simple configuration and a more productive method.

As such an insulating film, an insulating film as described above can be used.

The timepiece with a wireless function in accordance with the present invention is characterized in that the insulating region is made of an insulating member disposed between the plurality of watch case body parts.

Moreover, the timepiece with a wireless function in accordance with the present invention is characterized in that the insulating member is bonded to at least one of the plurality of watch case body parts.

As described above, the insulating region can be made of an insulating member, whereby the receiving sensitivity of the antenna can be improved by the simple configuration and a more productive method. As specific examples of such an insulating member, an insulating member as described above can be used.

By the present invention, a plurality of parts configuring the watch case is composed of a watch case body and a dial ring, and an insulating region is disposed between the watch case body and the dial ring to insulate the two parts one from the other. Consequently, the watch case body and the dial ring are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body and the dial ring, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna can be extremely improved.

Consequently, the timepiece with a wireless function in accordance with the present invention has a satisfactory receiving sensitivity, whereby the antenna can reliably receive a prescribed radio wave.

BEST MODE OF CARRYING OUT THE INVENTION

An embodiment (example) of the present invention will be described below in detail with reference to the drawings.

Embodiment 1

Figure 1:
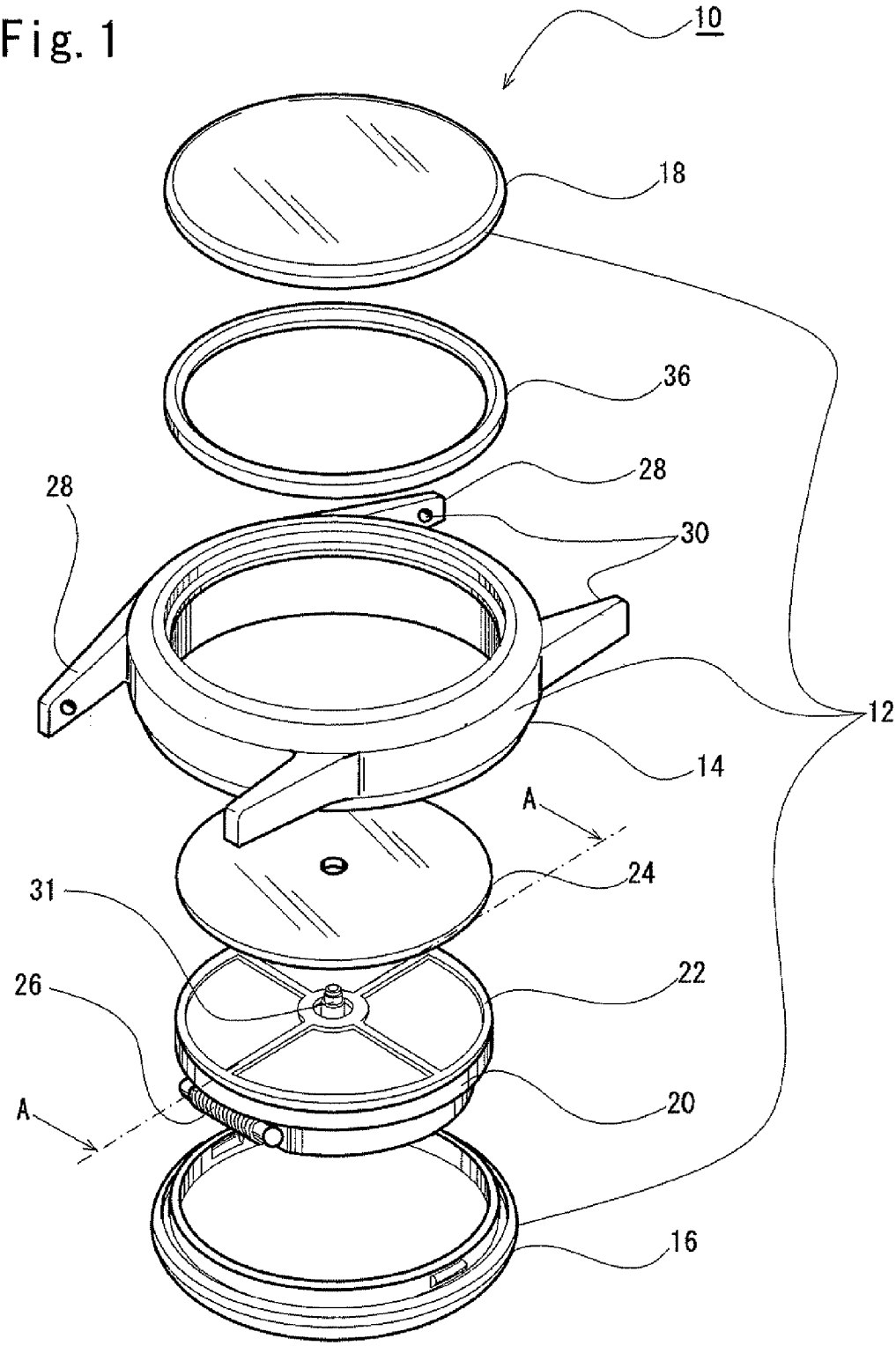
FIG. 1 is an exploded perspective view showing a timepiece with a wireless function in accordance with an embodiment of the present invention.
Figure 2:
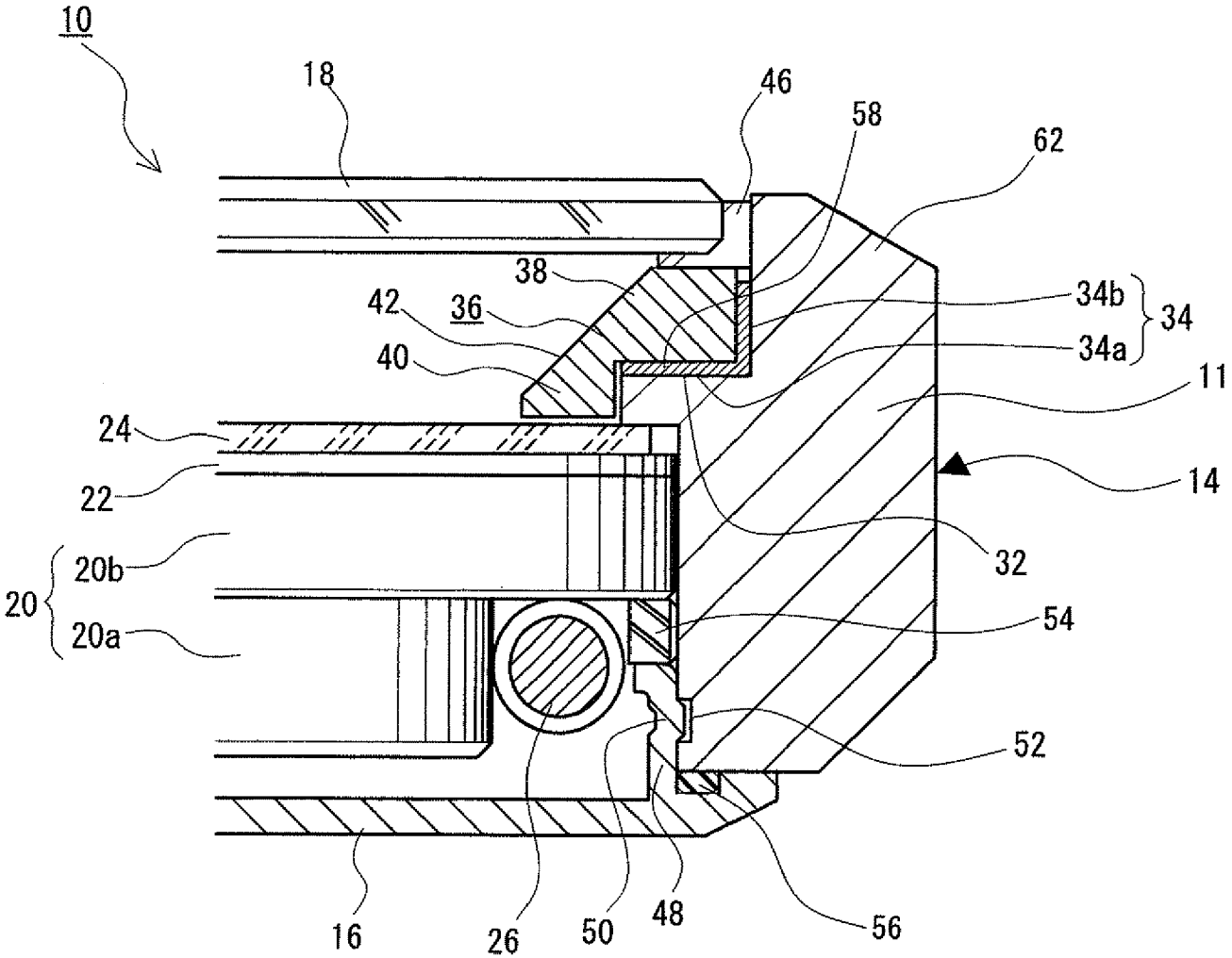
FIG. 2 is a partially cross-sectional view taken along the line A-A in the assembled state of the timepiece with a wireless function shown in FIG. 1.

FIG. 1 is an exploded perspective view showing a timepiece with a wireless function in accordance with an embodiment of the present invention. FIG. 2 is a partially cross-sectional view taken along the line A-A in the assembled state of the timepiece with a wireless function shown in FIG. 1.

In FIGS. 1 and 2, a numeral 10 represents a timepiece with a wireless function in accordance with an embodiment of the present invention. A timepiece 10 with a wireless function in accordance with an embodiment of the present invention is a radio controlled wristwatch that has a wireless function for receiving a long-wave standard radio wave (carrier wave) including time information and for correcting timepiece time based on the time information. As shown in FIGS. 1 and 2, the timepiece 10 with a wireless function is provided with a housing 12.

The housing 12 is provided with a watch case 14 that configures a conductive frame in a generally cylindrical shape, a conductive rear cover 16 mounted to the watch case 14 in such a manner that the rear cover 16 covers a lower opening section of the watch case 14 in a sealing state, and a windshield (glass) 18 mounted to the watch case 14 in such a manner that the windshield 18 covers an upper opening section of the watch case 14 in a sealing state.

The housing 12 contains a movement 20 that configures a clock drive section. A solar cell 22 for driving the movement 20 by an electromotive force of light is disposed on the movement 20.

A dial plate 24 is disposed on the solar cell 22. The dial plate 24 has a translucent function for transmitting an outside light having a wavelength that contributes to the electric power generation of the solar cell in such a manner that the movement 20 can be driven sufficiently.

An antenna 26 for receiving a standard radio wave is formed beside a small diameter portion 20*a* formed at the lower section of the movement 20. The antenna 26 is a bar antenna composed of a magnetic core member in the shape of a rod and a coil wound around the periphery of the magnetic core member as shown in the figure.

The dial plate 24 is not restricted in particular in the case in which the dial plate 24 has a translucent function for transmitting an outside light having a wavelength that contributes to the electric power generation of the solar cell. For instance, the dial plate 24 can be made of a nonconductive material such as a synthetic resin, ceramic, glass, wood, and a seashell, whereby an external radio wave can easily reach the antenna 26, thereby improving the receiving sensitivity of the antenna.

As shown in FIG. 1, the watch case 14 is provided with a pair of band attaching parts 28 that protrude outside. The band attaching parts 28 are provided with leg portions 30 that are uniformly spaced facing to each other and that extend from the watch case 14.

A band (not shown) of the wristwatch is connected to the leg portions 30 while being disposed between the opposite leg portions 30. A minute hand and an hour hand (not shown) are mounted to a hand spindle 31 that protrude from the movement 20 and that penetrate the solar cell 22 and the dial plate 24 shown in FIG. 1. The minute hand and the hour hand are located between the dial plate 24 and the windshield 18 to indicate time.

As shown in FIG. 2, the watch case 14 is separated into a plurality of parts. In this embodiment, the watch case 14 is separated into the watch case body 11 and a conductive dial ring 36.

A lining receiving portion 32 in a flange shape is protruded in a circular pattern on the inner peripheral side of the watch case body 11. The conductive dial ring 36 is mounted on a shoulder section 34 formed by the lining receiving portion 32.

The dial ring 36 is provided with a dial ring body 38 disposed on the lining receiving portion 32 and an extended portion 40 that is extended from the dial ring body 38 to the dial plate 24 and that is disposed on the dial plate 24. A tapered face 42 in which a diameter of a lower position thereof gradually becomes smaller is formed on the inner face side of the dial ring 36. An index such as a time character is shown on the tapered face 42.

A fixing (waterproof) packing 46 for fixing the windshield 18 in a sealing state is disposed on the upper end of the dial ring 36 and on the inner peripheral side of the upper end of the watch case body 11. A core cylinder member 48 protruding inside is formed on the rear cover 16. A plurality of engaging protrusions 50 are formed separately from each other on the outer peripheral side of the core cylinder member 48. Moreover, engaging depressions 52 which the engaging protrusions 50 of the core cylinder member 48 on the rear cover 16 are engaged with are formed on the inner peripheral side close to the lower end of the watch case body 11.

A support frame 54 is disposed between a large diameter portion 20*b* formed at the upper section of the movement 20 and the upper end of the core cylinder member 48. The support frame 54 is made of a nonconductive material such as a synthetic resin, and ensures a space in a planar direction between the conductive watch case body 11 and a conductive antenna 26, thereby maintaining a high receiving performance of the antenna 26.

In the case in which the engaging protrusions 50 of the core cylinder member 48 on the rear cover 16 are engaged with the engaging depressions 52 of the watch case body 11, the movement 20, the solar cell 22, and the dial plate 24 are fixed and housed in the watch case body 11 via the support frame 54 between the lining receiving portion 32 in a flange shape formed on the inner peripheral side of the watch case body 11 and the upper end of the core cylinder member 48 on the rear cover 16.

In FIG. 2, a numeral 56 represents a waterproof packing that is disposed between the rear cover 16 and the watch case body 11 in a sealing state.

For the timepiece 10 with a wireless function in accordance with an embodiment of the present invention, an insulating region 58 is disposed between the dial ring 36 and the watch case body 11 as shown in FIG. 2.

By forming the insulating region 58 having such a configuration, the conduction between the conductive watch case body 11 and the conductive dial ring 36 is blocked. Consequently, the watch case body 11 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

In the embodiment of the present invention, the insulating region 58 is formed in the range from a space between the upper surface of the lining receiving portion 32 formed on the watch case body 11 and the lower surface of the dial ring 36 disposed on the lining receiving portion 32 to a space between a side face 34*b* of the shoulder section 34 and the outer peripheral face of the dial ring 36. However, in the case in which there is a space between a side face 34*b* of the shoulder section 34 and the outer peripheral face of the dial ring 36 and the side face 34*b* of the shoulder section 34 and the outer peripheral face of the dial ring 36 are not abutted to each other, the insulating region 58 can be formed at least in only a space between the upper surface of the lining receiving portion 32 and the lower surface of the dial ring 36.

The insulating region 58 can be continuously formed in a planar direction on the entire section in a circumferential direction of the watch case body 11 and the dial ring 36. Alternatively, the insulating region 58 can also be formed on a partial section in the circumferential direction thereof.

In this case, it is desirable that the insulating region 58 is disposed around the section above the antenna 26, in particular at least around the section above the opening end of the antenna 26, from a viewpoint of effectively preventing an inductive current of the dial ring 36 around the opening end of the antenna 26.

Figure 3:
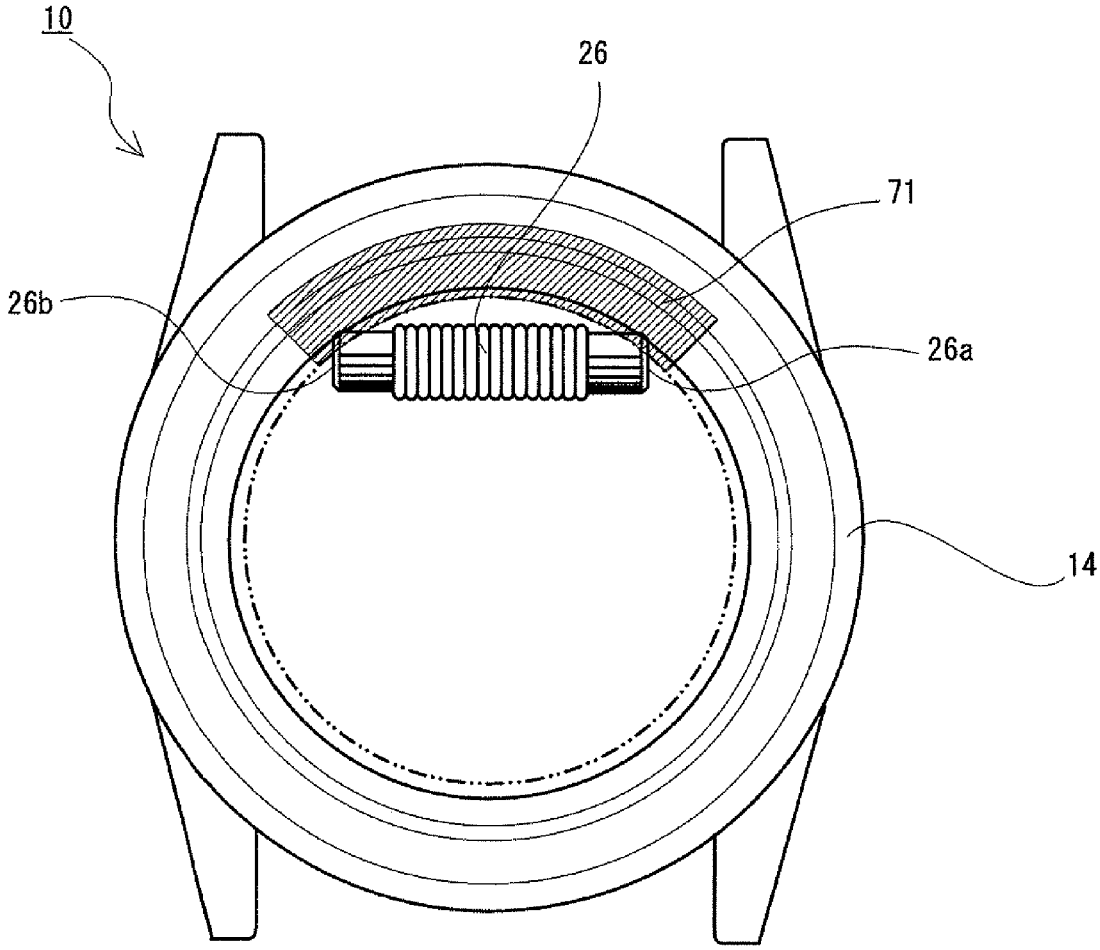
FIG. 3 is a view for illustrating the range around the section above the antenna.

FIG. 3 is a plan view showing a configuration around the section above the antenna 26. In this figure, a region 71 shown by diagonal lines is a region around the section above the antenna 26. For the convenience of explanation, only the inner peripheral side of the dial ring 36 is shown by the alternate long and two short dashes line.

Figure 4:
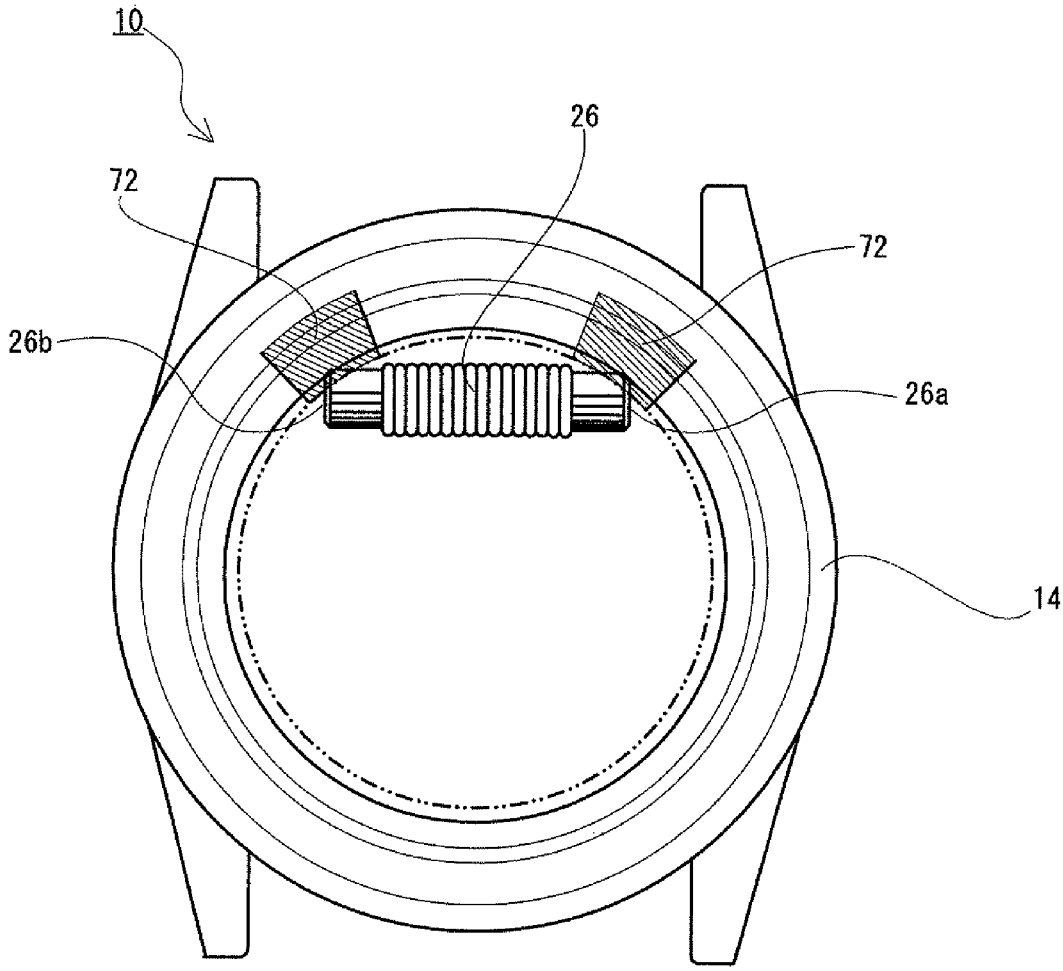
FIG. 4 is a view for illustrating the range around the section above the opening end of the antenna.

FIG. 4 is a plan view showing a configuration around the section above the opening ends 26*a* and 26*b* of the antenna 26. In this figure, two regions 72 shown by diagonal lines are regions around the sections above the opening ends 26*a* and 26*b*. It is particularly preferable that the insulating region 58 is disposed at least in each of the sections.

Figure 5:
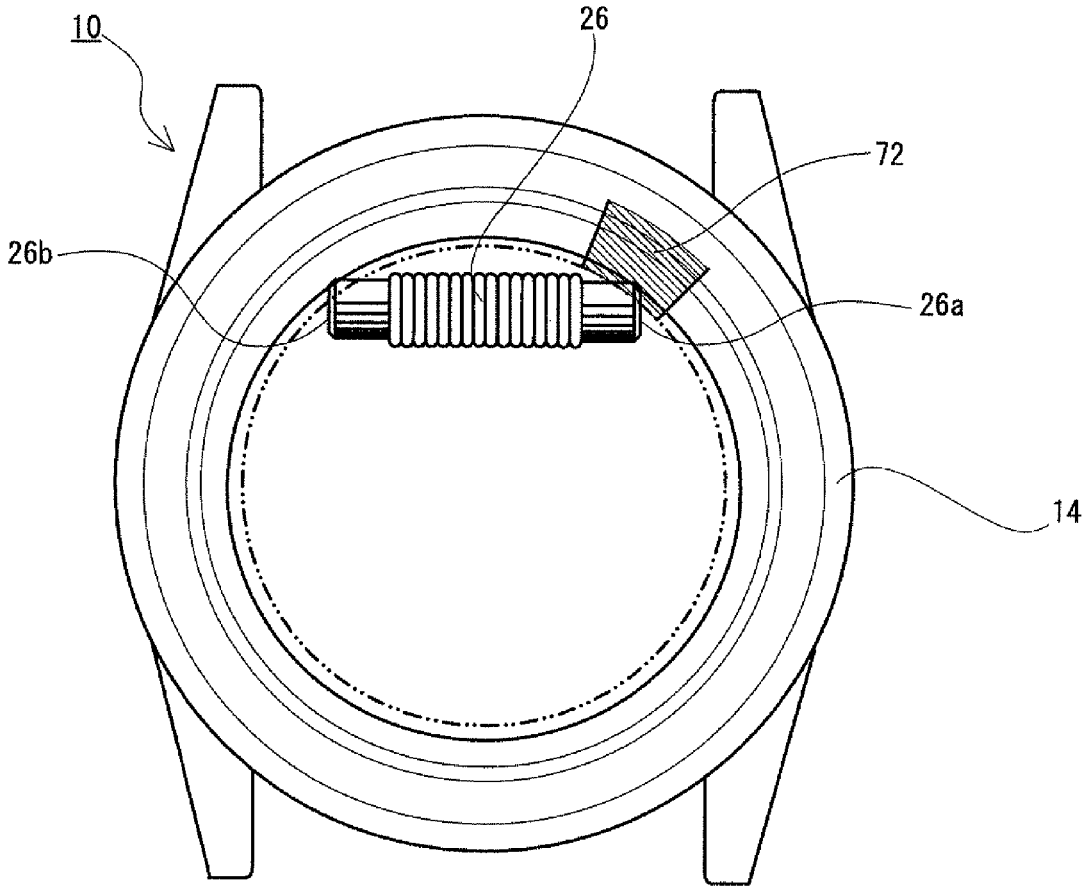
FIG. 5 is a view for illustrating the range around the section above the opening end of the antenna.

FIG. 5 is a plan view showing a configuration around the section above the opening end 26*a* on one side of the antenna 26. In this figure, the region 72 shown by diagonal lines is a region around the section above the opening end 26*a*. It is preferable that the insulating region 58 is disposed at least in the section. (The insulating region 58 can also be disposed in a section above the opening end 26*b* instead.)

Moreover, the insulating region 58 can also be made of an insulating film formed on at least one of the surface of the dial ring 36 and the surface of the watch case body 11.

Figure 7:
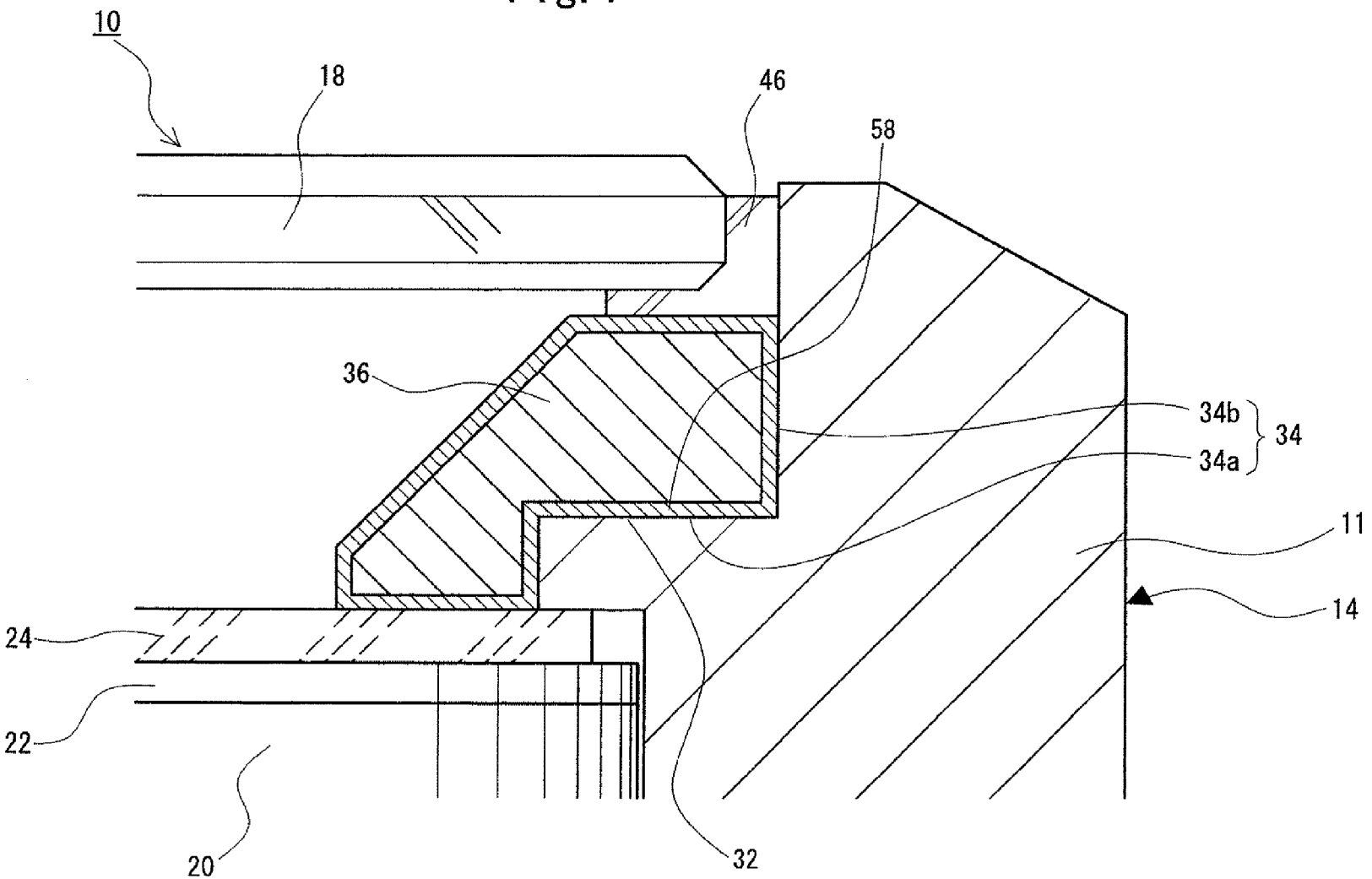
FIG. 7 is an enlarged cross-sectional view showing another embodiment of an area around the insulating region of the timepiece with a wireless function in accordance with the embodiment 1 of the present invention.

Furthermore, like an embodiment as shown in FIG. 7 described later, the insulating film can also be formed on the entire surface of the dial ring 36.

As described above, the insulating region can be made of an insulating film, whereby the receiving sensitivity of the antenna can be improved by the simple configuration and a more productive method.

As such an insulating film, there can be mentioned for instance a coating film, a printing film, and a dry plating film that have insulation properties.

As specific examples of the insulating film, there can be mentioned for instance:

a diamond like carbon (DLC) film, an insulating film made of an organic material such as an acrylic material, an urethane material, and a cellulosic material, a chromium compound film containing a chromium compound, and an aluminum oxide film containing an aluminum oxide compound.

As a chromium compound film, there can be mentioned for instance a chromium oxide film containing a chromium oxide compound, a chromium nitride film containing a chromium nitride compound, and a chromium carbide film containing a chromium carbide compound.

As a specific example of a method for forming a coating film that has insulation properties, a method for forming a finish coating film having insulation properties like a clear coat can be mentioned for instance. In this case, after a coating film is formed by the metallic coating, a clear coat that is a transparent or semi-transparent synthetic resin layer can be formed on the metallic coating film.

As specific examples of a coating film that has insulation properties, there can be mentioned for instance a polyurethane resin paint, a fluorine resin paint in which fluorine is mixed in a polymer molecule forming a resin, a vinyl chloride sol paint in which a poly vinyl chloride resin is dispersed in a plasticizing agent, a silicone polyester resin paint made of a silicone polyester resin in which an oil-free polyester resin is denatured by a silicone intermediate, an oil-free polyester resin, an acrylic resin paint, an epoxy resin paint, a silicone acrylic resin paint, a vinyl chloride resin paint, a lacquer, a phenol resin paint, and a chlorinated rubber paint.

The insulating region 58 can also be made of an insulating member disposed between the dial ring 36 and the watch case body 11.

For the timepiece with a wireless function in accordance with the present invention, the insulating member can also be bonded to the dial ring 36 or the watch case body 11.

As described above, the insulating region 58 can be made of an insulating member, whereby the receiving sensitivity of the antenna can be improved by the simple configuration and a more productive method. As specific examples of such an insulating member, there can be mentioned for instance a member made of a material such as a synthetic resin and a rubber in a sheet shape or the like and a nonconductive member made of a material such as ceramic.

Moreover, the insulating region 58 can be made of a member in which a conductive material is coated with a nonconductive film, or in which an insulating sheet made of a material such as a synthetic resin and a rubber is bonded to a conductive material. In this case, as a conductive material, there can be mentioned for instance gold, silver, copper, brass, aluminum, magnesium, zinc, titanium, and an alloy thereof. In addition, stainless steel and tantalum carbide can also be used. As a nonconductive film, materials described above as specific examples of the insulating film can be used.

In the case in which an insulating member is disposed between the dial ring 36 and the watch case body 11, an independent insulating sheet can be disposed as a spacer between the dial ring 36 and the watch case body 11. However, it is more preferable that an insulating member is bonded to one of the dial ring 36 and the watch case body 11. More specifically, a pressure-sensitive tape or an adhesive tape can be bonded to one of the dial ring 36 and the watch case body 11.

By the above configuration, the dial ring 36 and the watch case body 11 can be easily built into the watch during an assembly of the watch, thereby improving working property.

In the following embodiments, the insulating film and the insulating member and so on described above can be basically applied to the preferable configuration of the insulating region 58.

Embodiment 2

Figure 6:
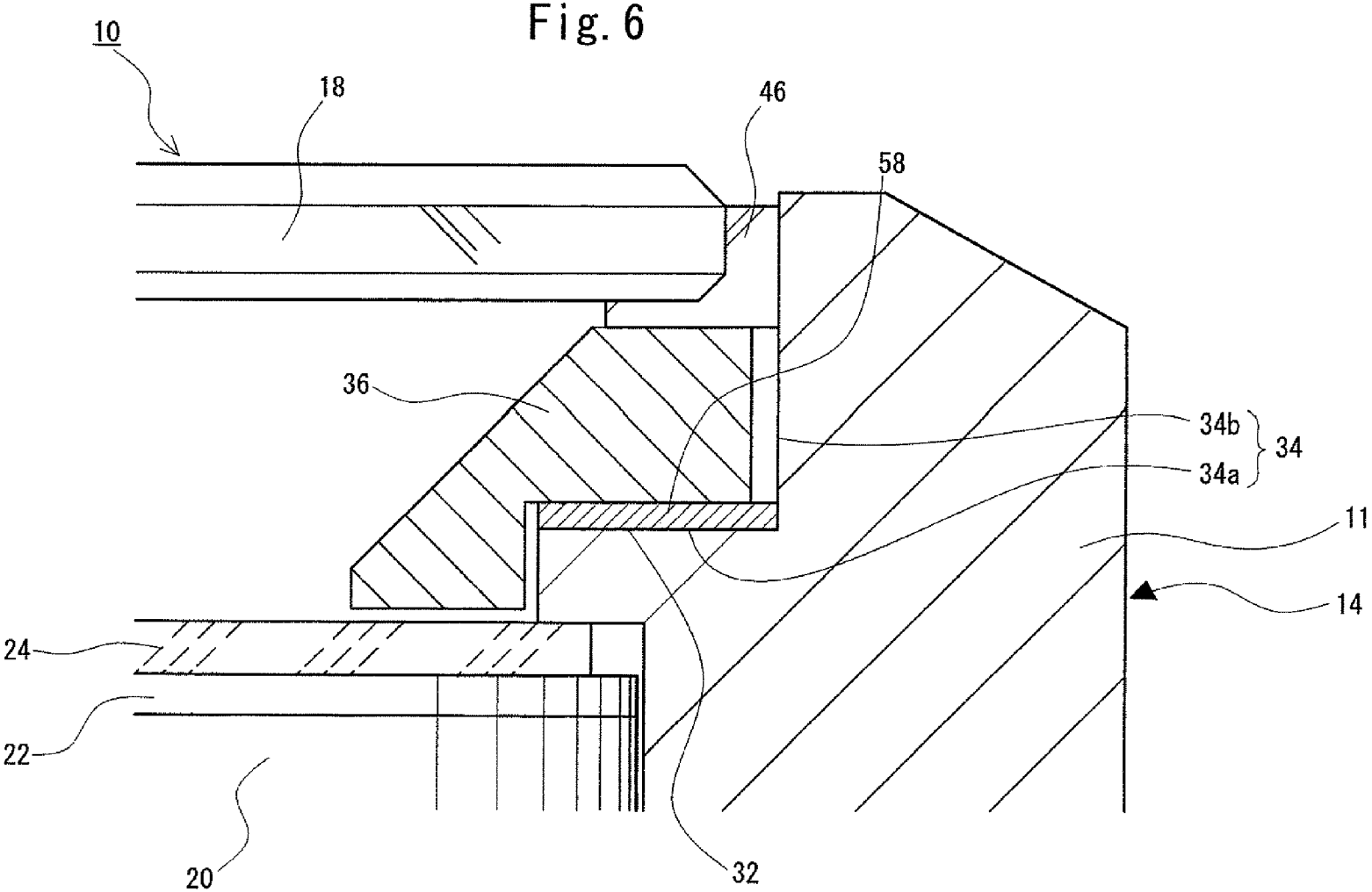
FIG. 6 is an enlarged cross-sectional view showing another embodiment of an area around the insulating region of the timepiece with a wireless function in accordance with the embodiment 1 of the present invention.

FIG. 6 is an enlarged cross-sectional view showing another embodiment of an area around the insulating region of the timepiece with a wireless function in accordance with the embodiment 1 of the present invention.

The timepiece 10 with a wireless function in accordance with the embodiment has a configuration basically equivalent to that of the timepiece 10 with a wireless function shown in FIGS. 1 and 2. Here, elements equivalent to those illustrated in FIGS. 1 and 2 are numerically numbered similarly and the detailed descriptions of the equivalent elements are omitted.

For the timepiece 10 with a wireless function in accordance with the embodiment, the insulating region 58 is formed in the range between the upper surface of the lining receiving portion 32 formed on the watch case body 11 and the lower surface of the dial ring 36 disposed on the lining receiving portion 32.

As described above, in the case in which there is a space between a side face 34*b* of the shoulder section 34 and the outer peripheral face of the dial ring 36 and the side face 34*b* of the shoulder section 34 and the outer peripheral face of the dial ring 36 are not abutted to each other, the insulating region 58 can be formed at least in only a space between the upper surface of the lining receiving portion 32 and the lower surface of the dial ring 36.

By forming the insulating region 58 having such a configuration, the conduction between the conductive watch case body 11 and the conductive dial ring 36 is blocked. Consequently, the watch case body 11 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

Embodiment 3

FIG. 7 is an enlarged cross-sectional view showing another embodiment of an area around the insulating region of the timepiece with a wireless function in accordance with the embodiment 1 of the present invention.

The timepiece 10 with a wireless function in accordance with the embodiment has a configuration basically equivalent to that of the timepiece 10 with a wireless function shown in FIGS. 1 and 2. Here, elements equivalent to those illustrated in FIGS. 1 and 2 are numerically numbered similarly and the detailed descriptions of the equivalent elements are omitted.

For the timepiece 10 with a wireless function in accordance with the embodiment, the insulating region 58 is formed on the entire surface of the dial ring 36. For instance, the insulating region 58 can be formed as an insulating film coated on the entire surface of the dial ring 36. As a method for forming the insulating region 58, a method of dipping can be mentioned for instance.

In this embodiment, the insulating film that configures the insulating region 58 is formed on the entire surface of the dial ring 36. Consequently, even in the case in which the dial ring 36 faces for coming into contact with the side face 34*b* of the shoulder section 34 of the watch case body 11 or the flange inner peripheral face of the lining receiving portion 32, the dial ring 36 and the watch case body 11 can be sufficiently insulated from each other.

By forming the insulating region 58 having such a configuration, the conduction between the conductive watch case body 11 and the conductive dial ring 36 is blocked. Consequently, the watch case body 11 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

Embodiment 4

Figure 8:
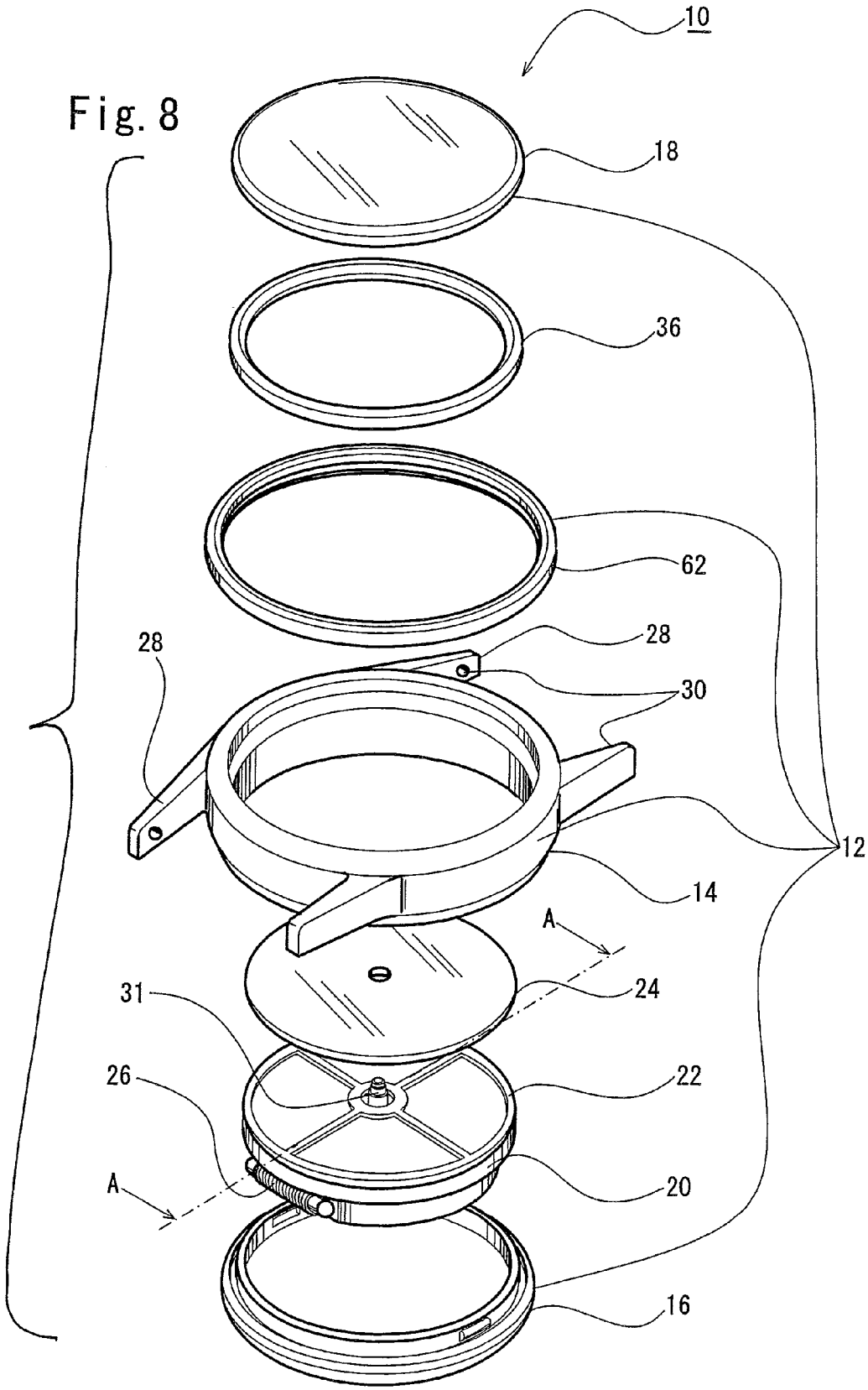
FIG. 8 is an exploded perspective view showing a timepiece with a wireless function in accordance with another embodiment of the present invention.
Figure 9:
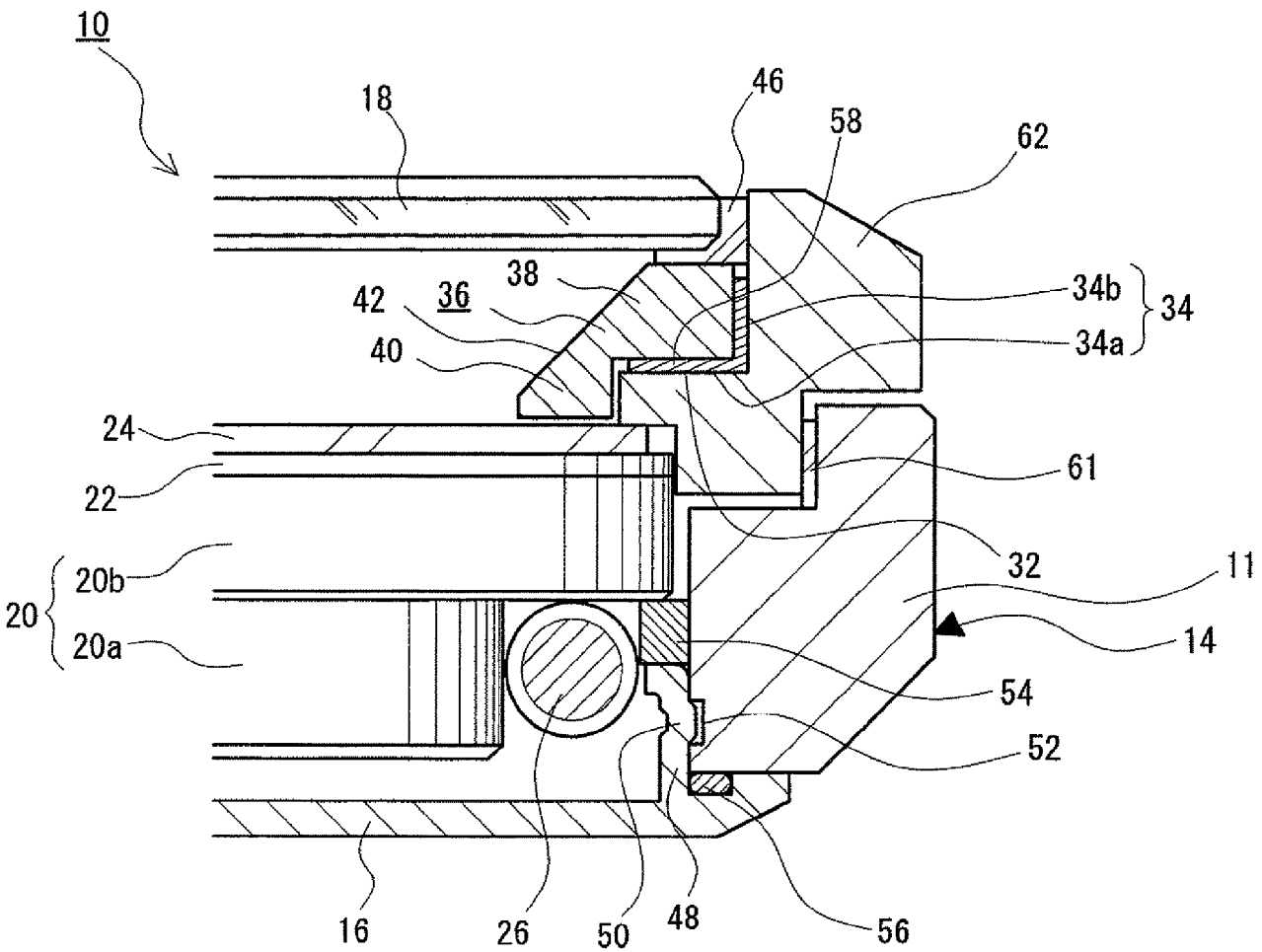
FIG. 9 is a partially cross-sectional view taken along the line A-A in the assembled state of the timepiece with a wireless function shown in FIG. 8.

FIG. 8 is an exploded perspective view showing a timepiece with a wireless function in accordance with another embodiment of the present invention. FIG. 9 is a partially cross-sectional view taken along the line A-A in the assembled state of the timepiece with a wireless function shown in FIG. 8.

The timepiece 10 with a wireless function in accordance with the embodiment has a configuration basically equivalent to that of the timepiece 10 with a wireless function shown in FIGS. 1 and 2. Here, elements equivalent to those illustrated in FIGS. 1 and 2 are numerically numbered similarly and the detailed descriptions of the equivalent elements are omitted.

For the timepiece 10 with a wireless function in accordance with this embodiment, as shown in FIG. 9, the watch case 14 is separated into a plurality of parts. In this embodiment, the watch case 14 is separated into a watch case body 11, a conductive dial ring 36, and a conductive bezel 62.

The conductive bezel 62 is disposed above the watch case body 11 in such a manner that the conductive bezel 62 is disposed on the upper surface on the outer edge side of the watch case body 11. In FIG. 9, a numeral 61 represents a waterproof packing that is disposed between the bezel 62 and the watch case body 11 in a sealing state.

A lining receiving portion 32 in a flange shape is protruded in a circular pattern on the inner peripheral side of the bezel 62. The conductive dial ring 36 is mounted on a shoulder section 34 formed by the lining receiving portion 32.

The dial ring 36 is provided with a dial ring body 38 disposed on the lining receiving portion 32 and an extended portion 40 that is extended from the dial ring body 38 to the dial plate 24 and that is disposed on the dial plate 24. A tapered face 42 in which a diameter of a lower position thereof gradually becomes smaller is formed on the inner face side of the dial ring 36. An index such as a time character is shown on the tapered face 42.

A fixing (waterproof) packing 46 for fixing the windshield 18 in a sealing state is disposed on the upper end of the dial ring 36 and on the inner peripheral side of the upper end of the bezel 62.

For the timepiece 10 with a wireless function in accordance with this embodiment, as shown in FIG. 9, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36.

By forming the insulating region 58 having such a configuration, the conduction between the conductive bezel 62 and the conductive dial ring 36 is blocked. Consequently, the bezel 62 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the bezel 62 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved.

In the embodiment of the present invention, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36. However, in the case in which there is a space between a side face 34*b* of the shoulder section 34 and the outer peripheral face of the dial ring 36 and the side face 34*b* of the shoulder section 34 and the outer peripheral face of the dial ring 36 are not abutted to each other, the insulating region 58 can be formed at least in only a space between the upper surface of the lining receiving portion 32 and the lower surface of the dial ring 36.

The insulating region 58 can be continuously formed in a planar direction on the entire section in a circumferential direction of the watch case body 11 the bezel 62, and the dial ring 36. Alternatively, the insulating region 58 can also be formed on a partial section in the circumferential direction thereof. In this case, it is desirable that the insulating region 58 is disposed around the section above the antenna 26, in particular at least around the section above the opening end of the antenna 26, from a viewpoint of effectively preventing an inductive current of the bezel 62 and the dial ring 36 around the opening end of the antenna 26. The configurations around the section above the antenna 26 and around the section above the opening end of the antenna 26 are similar to those explained in Embodiment 1 described above. The specific examples of the configurations are similar to the ranges shown in FIGS. 3 to 5 in a plan view.

Embodiment 5

Figure 10:
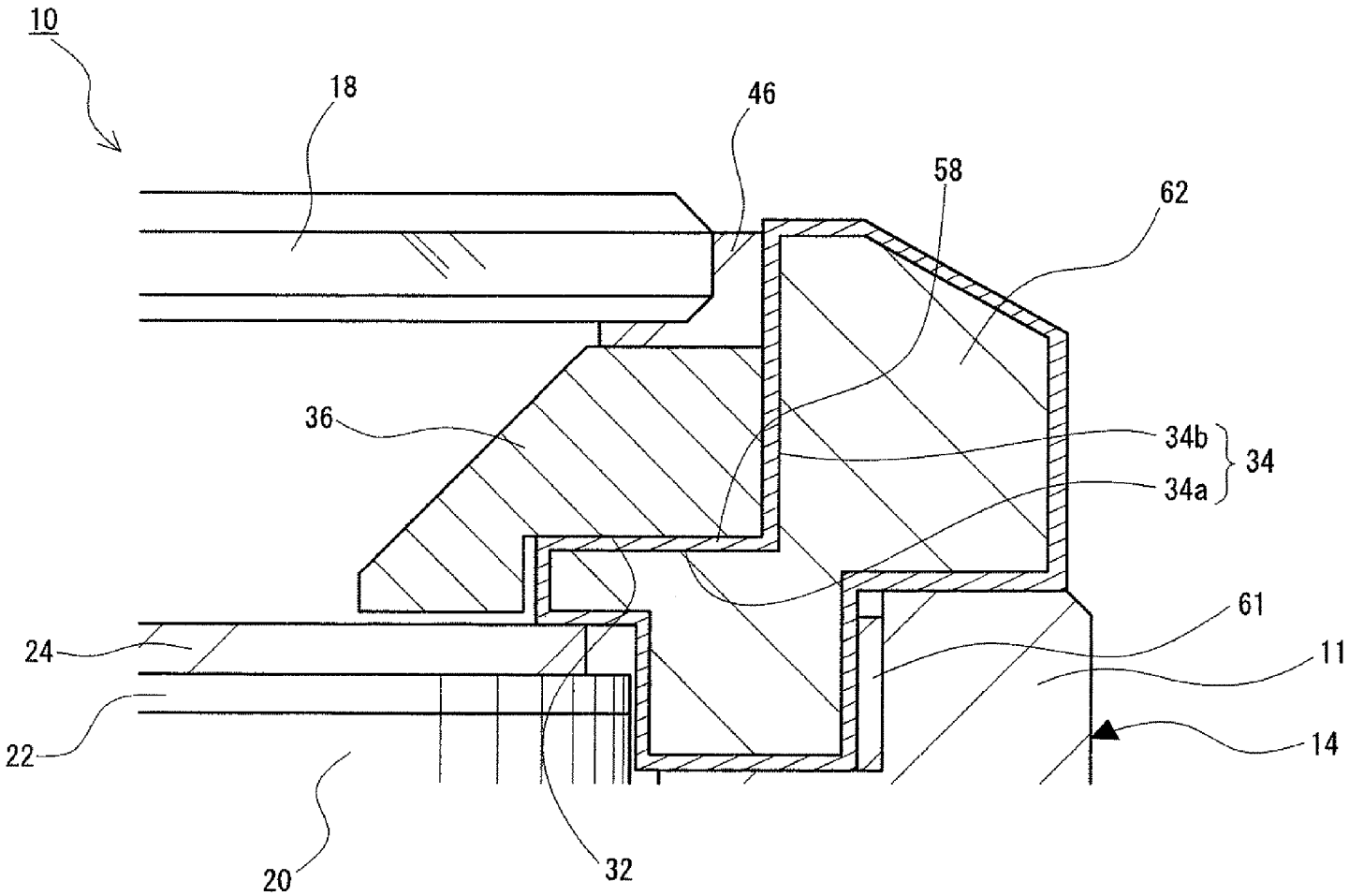
FIG. 10 is an enlarged cross-sectional view showing an area around the insulating region of the timepiece with a wireless function in accordance with another embodiment of the present invention.

FIG. 10 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIGS. 8 and 9. Here, elements equivalent to those illustrated in FIGS. 8 and 9 are numerically numbered similarly and the detailed descriptions of the equivalent elements are omitted.

For the timepiece 10 with a wireless function in accordance with this embodiment, the insulating region 58 is formed on the entire surface of the bezel 62. For instance, the insulating region 58 can be formed as an insulating film coated on the entire surface of the bezel 62. As a method for forming the insulating region 58, a method of dipping can be mentioned for instance.

By forming the insulating region 58 having such a configuration, the conduction between the conductive bezel 62 and the conductive dial ring 36 is blocked. Consequently, the receiving sensitivity of the antenna 26 can be extremely improved similarly to the above described Embodiment 4.

Embodiment 6

Figure 11:
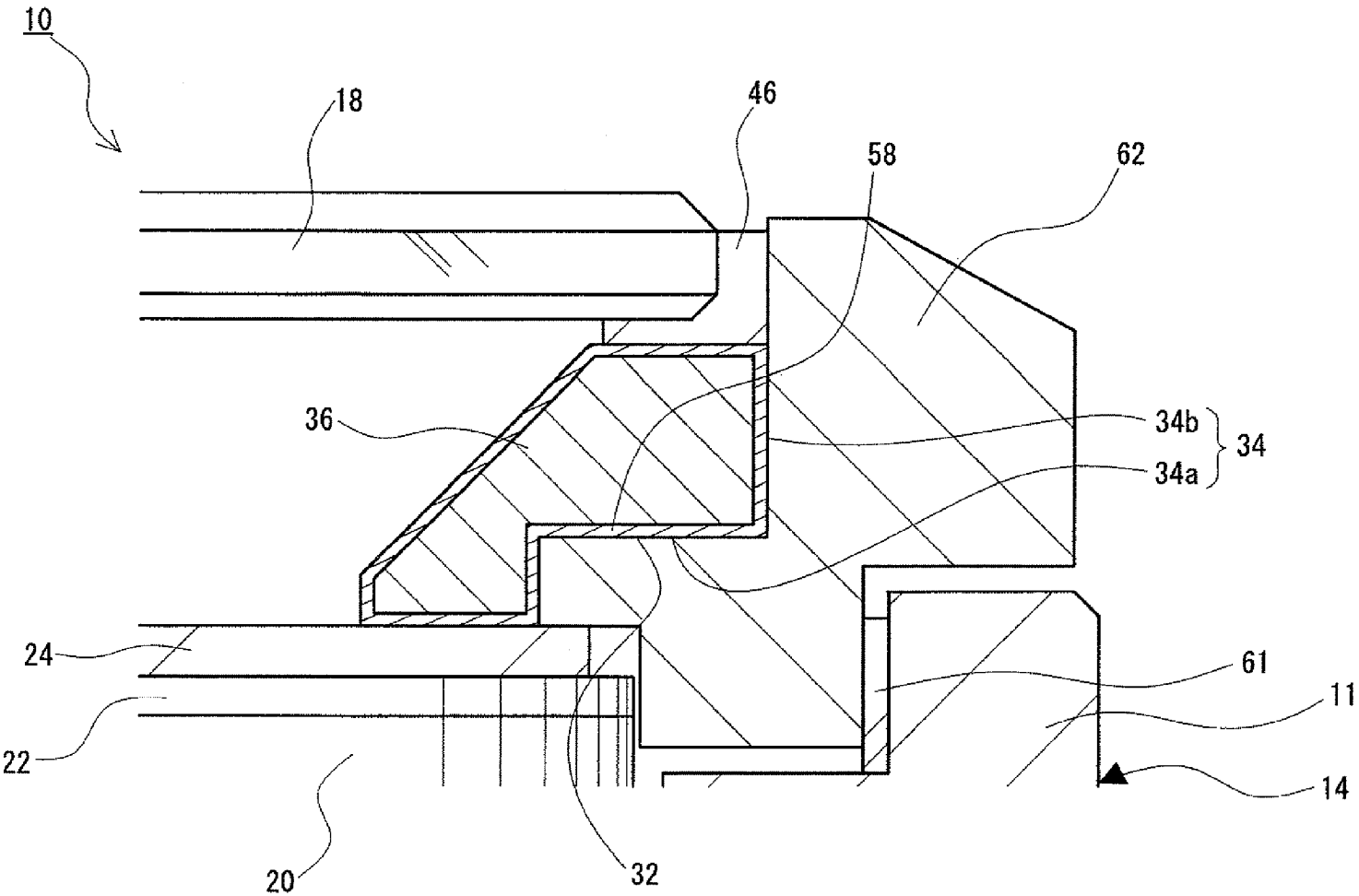
FIG. 11 is an enlarged cross-sectional view showing an area around the insulating region of the timepiece with a wireless function in accordance with another embodiment of the present invention.

FIG. 11 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIGS. 8 and 9. Here, elements equivalent to those illustrated in FIGS. 8 and 9 are numerically numbered similarly and the detailed descriptions of the equivalent elements are omitted.

For the timepiece 10 with a wireless function in accordance with the embodiment, the insulating region 58 is formed on the entire surface of the dial ring 36.

For instance, the insulating region 58 can be formed as an insulating film coated on the entire surface of the dial ring 36 similarly to the above described Embodiment 2.

In this embodiment, the insulating film that configures the insulating region 58 is formed on the entire surface of the dial ring 36. Consequently, even in the case in which the dial ring 36 faces for coming into contact with the side face 34*b* of the shoulder section 34 of the bezel 62 or the flange inner peripheral face of the lining receiving portion 32, the dial ring 36 and the bezel 62 can be sufficiently insulated from each other.

By forming the insulating region 58 having such a configuration, the conduction between the conductive bezel 62 and the conductive dial ring 36 is blocked. Consequently, the receiving sensitivity of the antenna 26 can be extremely improved similarly to the above described Embodiment 4.

Embodiment 7

Figure 12:
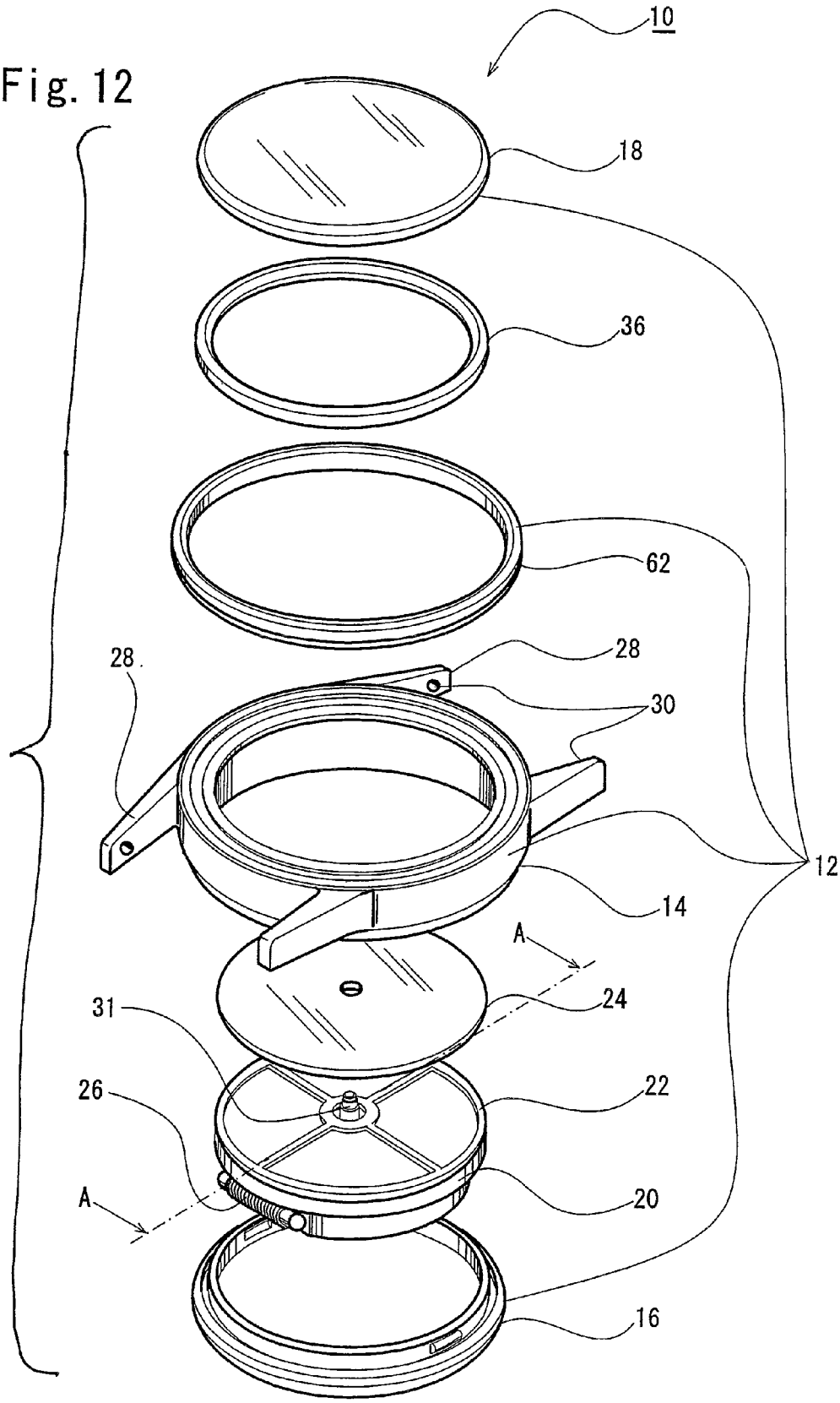
FIG. 12 is an exploded perspective view showing a timepiece with a wireless function in accordance with another embodiment of the present invention.
Figure 13:
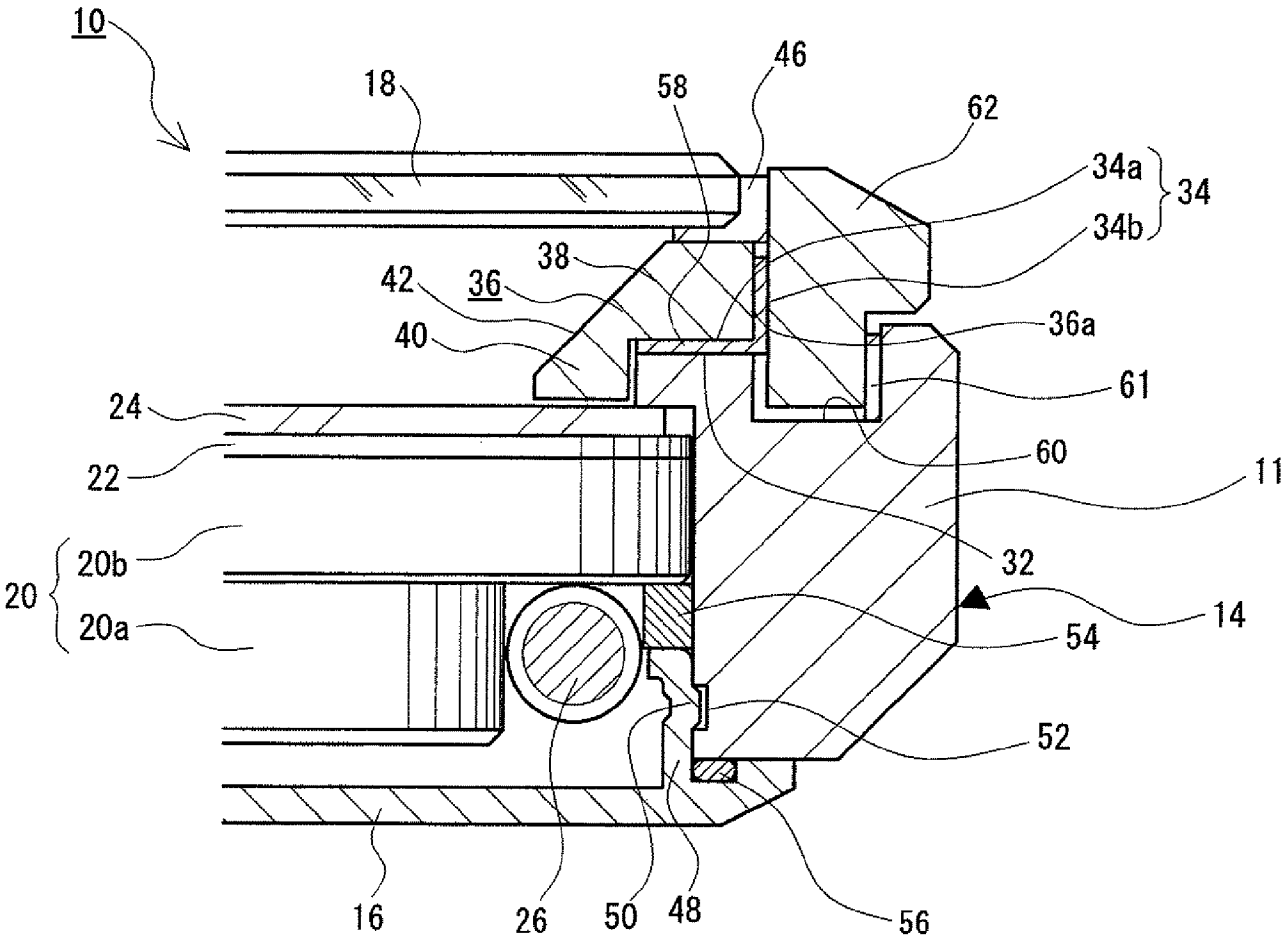
FIG. 13 is a partially cross-sectional view taken along the line A-A in the assembled state of the timepiece with a wireless function shown in FIG. 12.

FIG. 12 is an exploded perspective view showing a timepiece with a wireless function in accordance with another embodiment of the present invention. FIG. 13 is a partially cross-sectional view taken along the line A-A in the assembled state of the timepiece with a wireless function shown in FIG. 12.

The timepiece 10 with a wireless function in accordance with the embodiment has a configuration basically equivalent to that of the timepiece 10 with a wireless function shown in FIGS. 8 and 9. Here, elements equivalent to those illustrated in FIGS. 8 and 9 are numerically numbered similarly and the detailed descriptions of the equivalent elements are omitted.

As shown in FIG. 13, the watch case 14 is separated into a plurality of parts. In this embodiment, the watch case 14 is separated into a watch case body 11, a conductive dial ring 36, and a conductive bezel 62.

A bezel holding depression 60 is formed in a groove shape on the upper surface of the watch case body 11. The conductive bezel 62 is disposed in such a manner that the lower side of the bezel 62 is fitted into the bezel holding depression 60. In FIG. 13, a numeral 61 represents a waterproof packing that is disposed between the bezel 62 and the watch case body 11 in a sealing state.

A lining receiving portion 32 in a flange shape is protruded in a circular pattern on the inner peripheral side of the watch case body 11. The conductive dial ring 36 is mounted on the lining receiving portion 32. The dial ring 36 is provided with a dial ring body 38 disposed on the lining receiving portion 32 and an extended portion 40 that is extended from the dial ring body 38 to the dial plate 24 and that is disposed on the dial plate 24. A tapered face 42 in which a diameter of a lower position thereof gradually becomes smaller is formed on the inner face side of the dial ring 36. An index such as a time character is shown on the tapered face 42.

A fixing (waterproof) packing 46 for fixing the windshield 18 in a sealing state is disposed on the upper end of the dial ring 36 and on the inner peripheral side of the upper end of the bezel 62.

In FIG. 13, a numeral 56 represents a waterproof packing that is disposed between the rear cover 16 and the watch case body 11 in a sealing state.

For the timepiece 10 with a wireless function in accordance with an embodiment of the present invention, as shown in FIG. 13, the insulating region 58 is formed in the range from a space between the upper surface of the lining receiving portion 32 formed on the watch case body 11 and the lower surface of the dial ring 36 disposed on the lining receiving portion 32 to a space between a side face 34*b* of the shoulder section 34 formed by the lining receiving portion 32 and the bezel 62 (an inner peripheral face of the bezel 62) and the outer peripheral face 36*a* of the dial ring 36.

By forming the insulating region 58 having such a configuration, the conduction between the conductive watch case body 11 and the conductive dial ring 36 and the conduction between the conductive bezel 62 and the conductive dial ring 36 are blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved.

The insulating region 58 can be continuously formed in a planar direction on the entire section in a circumferential direction of the watch case body 11, the bezel 62, and the dial ring 36. Alternatively, the insulating region 58 can also be formed on a partial section in the circumferential direction thereof. In this case, it is desirable that the insulating region 58 is disposed around the section above the antenna 26, in particular at least around the section above the opening end of the antenna 26, from a viewpoint of effectively preventing an inductive current of the bezel 62 and the dial ring 36 around the opening end of the antenna 26. The configurations around the section above the antenna 26 and around the section above the opening end of the antenna 26 are similar to those explained in Embodiment 1 described above. The specific examples of the configurations are similar to the ranges shown in FIGS. 3 to 5 in a plan view.

Embodiment 8

Figure 14:
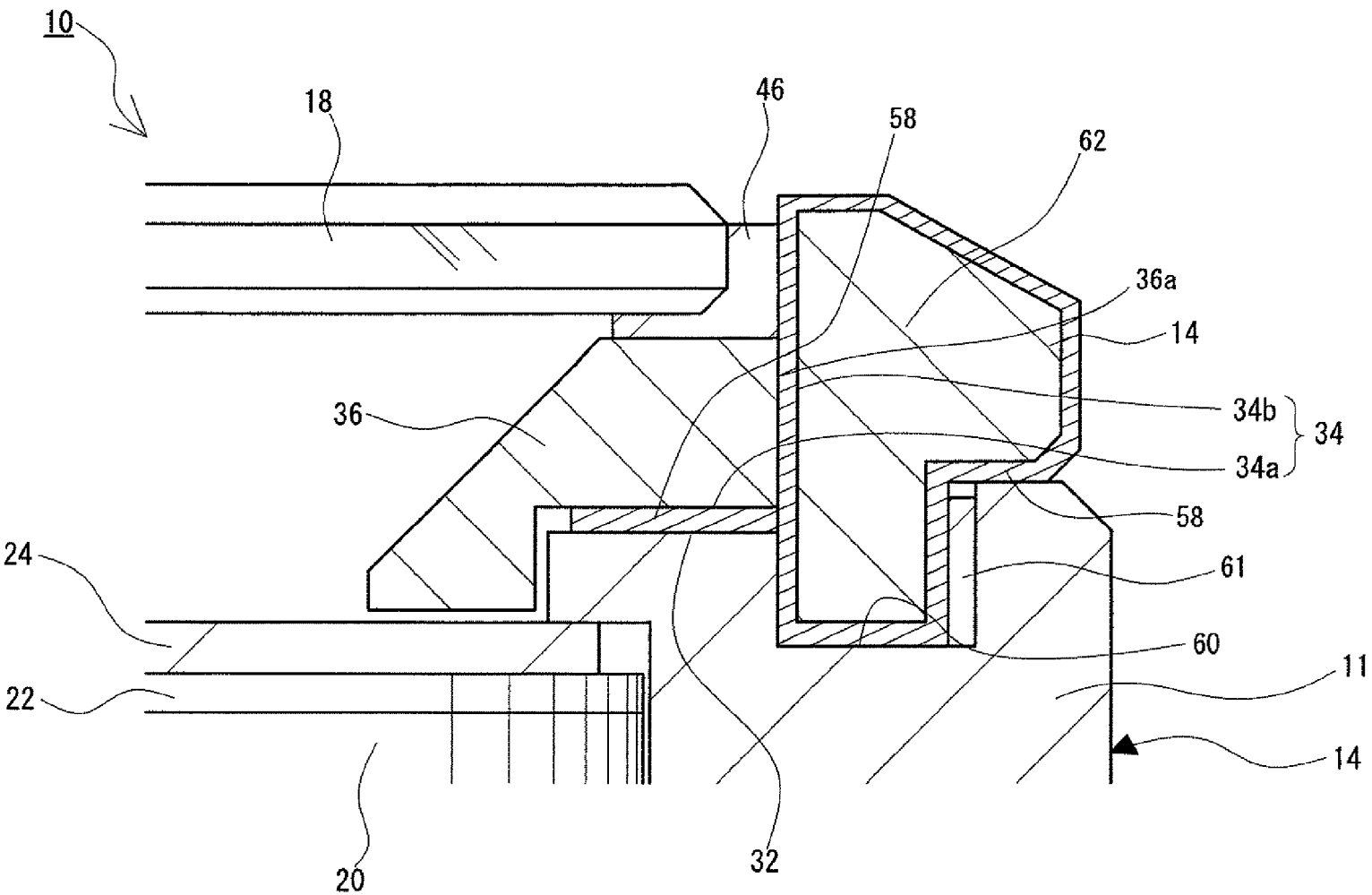
FIG. 14 is an enlarged cross-sectional view showing an area around the insulating region of the timepiece with a wireless function in accordance with another embodiment of the present invention.

FIG. 14 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIGS. 12 and 13. Here, elements equivalent to those illustrated in FIGS. 12 and 13 are numerically numbered similarly and the detailed descriptions of the equivalent elements are omitted.

For the timepiece 10 with a wireless function in accordance with this embodiment, the insulating region 58 is formed between the upper surface of the lining receiving portion 32 and the lower surface of the dial ring 36 and on the entire surface of the bezel 62.

For instance, the insulating region 58 formed on the entire surface of the bezel 62 can be configured as an insulating film coated on the entire surface of the bezel 62. As a method for forming the insulating region 58, a method of dipping can be mentioned for instance.

By forming the insulating region 58 having such a configuration, the conduction between the conductive watch case body 11 and the conductive dial ring 36 and the conduction between the conductive bezel 62 and the conductive dial ring 36 are blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved.

Embodiment 9

Figure 15:
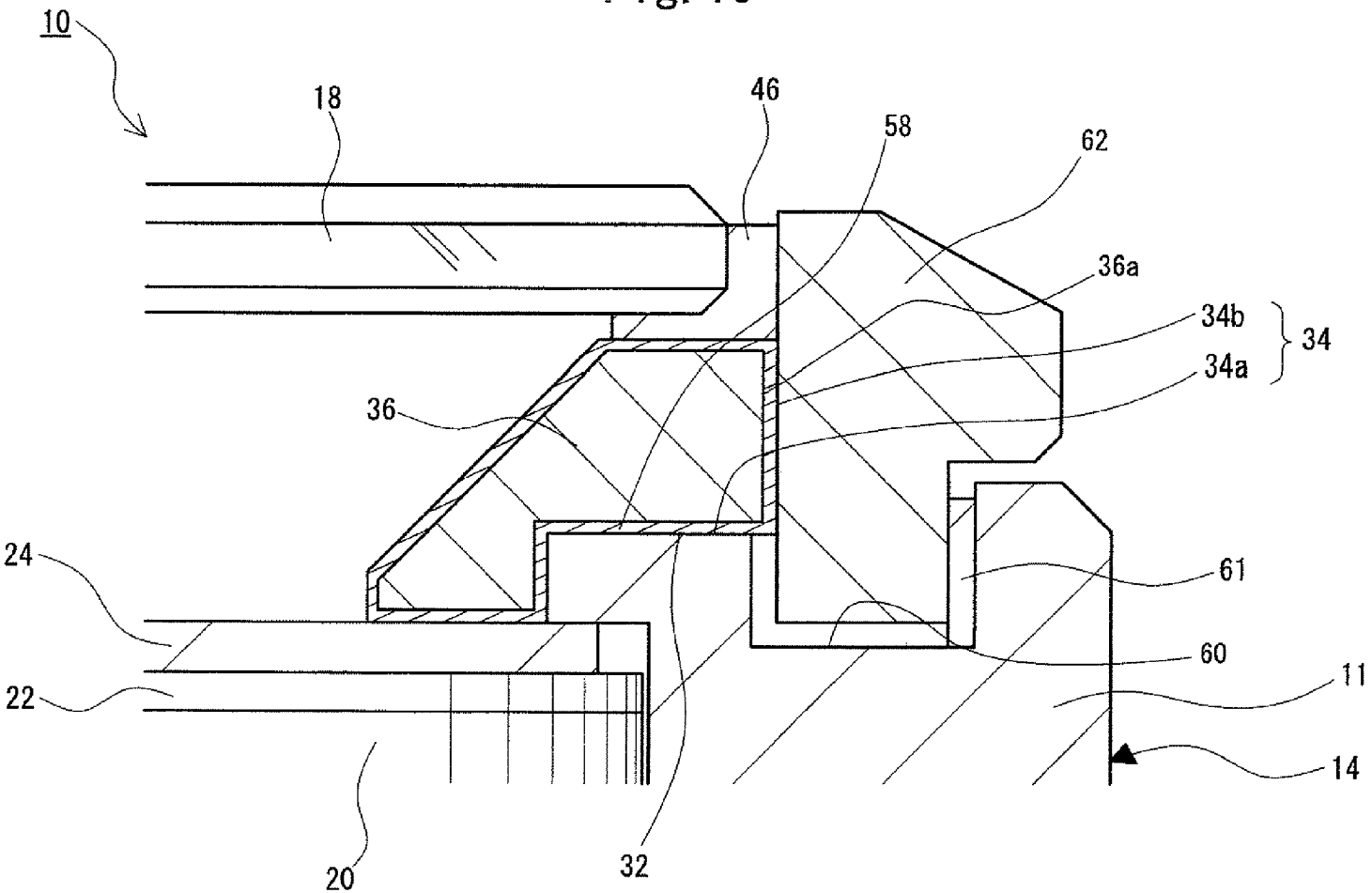
FIG. 15 is an enlarged cross-sectional view showing an area around the insulating region of the timepiece with a wireless function in accordance with another embodiment of the present invention.

FIG. 15 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIGS. 12 and 13. Here, elements equivalent to those illustrated in FIGS. 12 and 13 are numerically numbered similarly and the detailed descriptions of the equivalent elements are omitted.

For the timepiece 10 with a wireless function in accordance with the embodiment, the insulating region 58 is formed on the entire surface of the dial ring 36.

For instance, the insulating region 58 can be formed as an insulating film coated on the entire surface of the dial ring 36 similarly to the above described Embodiment 11 shown in FIG. 11.

In this embodiment, the insulating film that configures the insulating region 58 is formed on the entire surface of the dial ring 36. Consequently, even in the case in which the dial ring 36 faces for coming into contact with the flange inner peripheral face of the lining receiving portion 32, the dial ring 36 and the watch case body 11 can be sufficiently insulated from each other.

By forming the insulating region 58 having such a configuration, the conduction between the conductive watch case body 11 and the conductive dial ring 36 and the conduction between the conductive bezel 62 and the conductive dial ring 36 are blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved.

Embodiment 10

Figure 16:
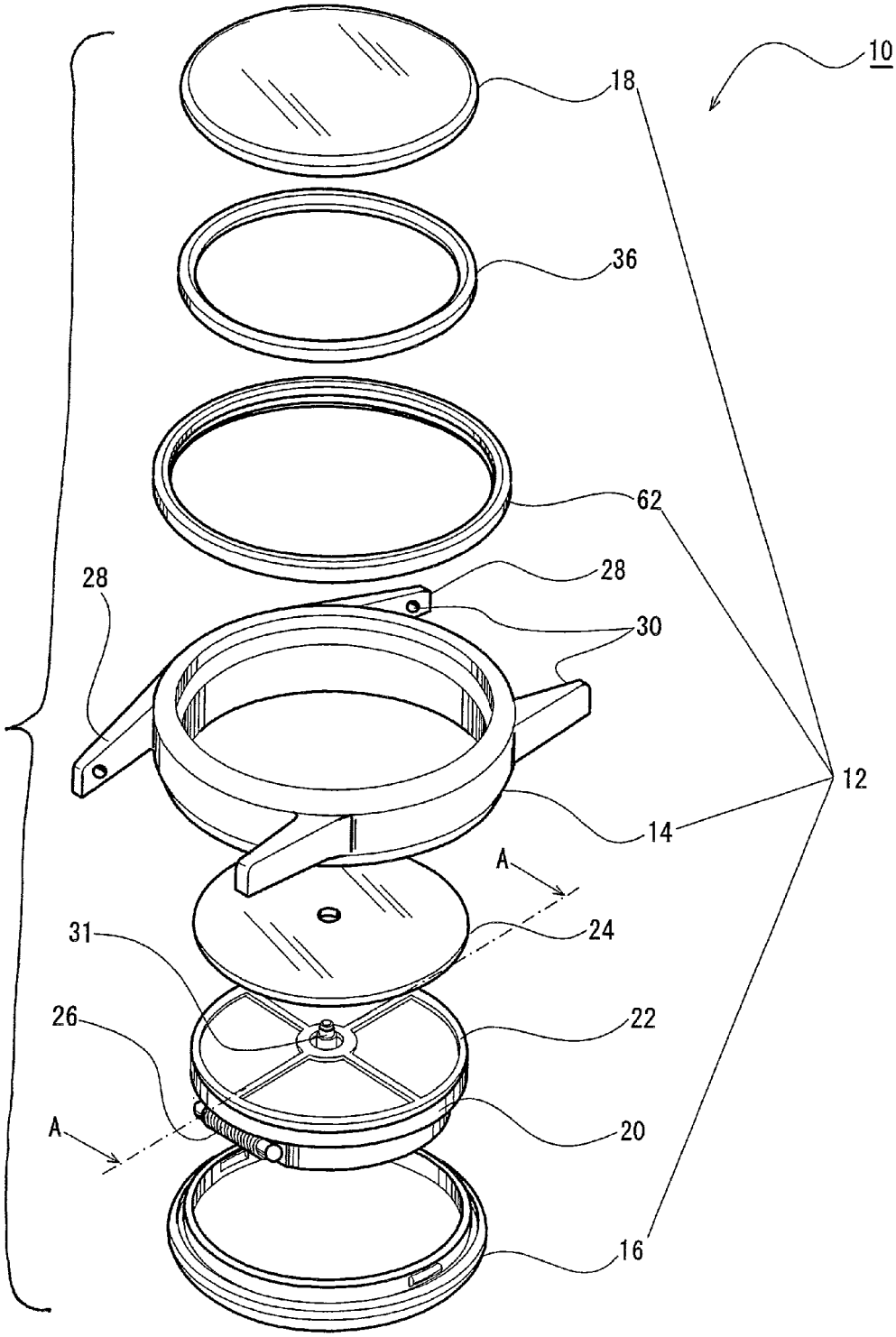
FIG. 16 is an exploded perspective view showing a timepiece with a wireless function in accordance with another embodiment of the present invention.
Figure 17:
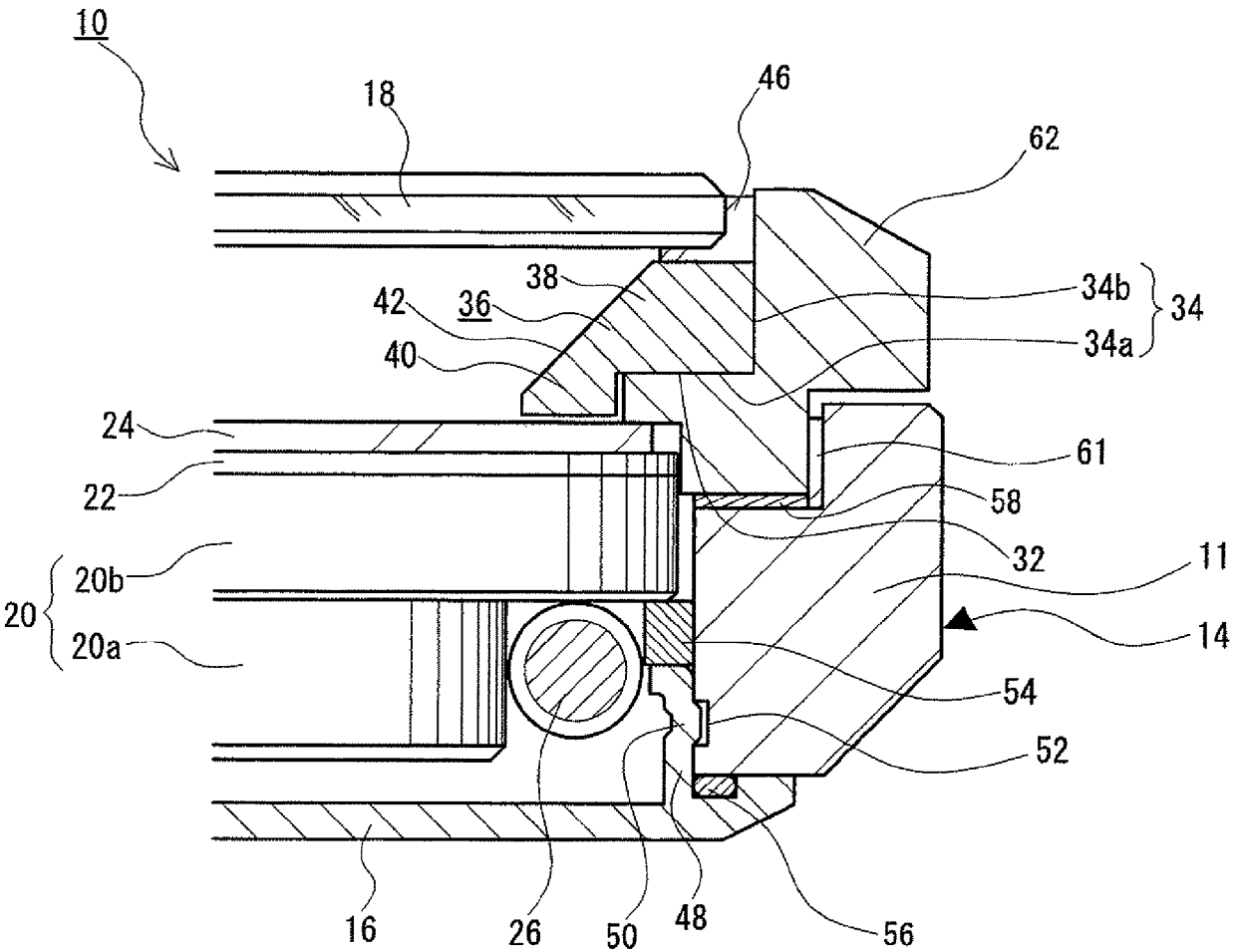
FIG. 17 is a partially cross-sectional view taken along the line A-A in the assembled state of the timepiece with a wireless function shown in FIG. 16.

FIG. 16 is an exploded perspective view showing a timepiece with a wireless function in accordance with another embodiment of the present invention. FIG. 17 is a partially cross-sectional view taken along the line A-A in the assembled state of the timepiece with a wireless function shown in FIG. 16.

The timepiece 10 with a wireless function in accordance with the embodiment has a configuration basically equivalent to that of the timepiece 10 with a wireless function shown in FIGS. 8 and 9. Here, elements equivalent to those illustrated in FIGS. 8 and 9 are numerically numbered similarly and the detailed descriptions of the equivalent elements are omitted.

For the timepiece 10 with a wireless function in accordance with this embodiment, as shown in FIG. 17, the watch case 14 is separated into a plurality of parts. In this embodiment, the watch case 14 is separated into a watch case body 11, a conductive dial ring 36, and a conductive bezel 62.

For the timepiece 10 with a wireless function in accordance with this embodiment, as shown in FIG. 17, an insulating region 58 is disposed between the upper surface on the inner edge side of the watch case body 11 and the lower surface on the inner edge side of the bezel 62.

By forming the insulating region 58 having such a configuration, the conduction between the conductive watch case body 11 and the conductive bezel 62 is blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved.

In this embodiment, an insulating region 58 is disposed in the space between the upper surface on the inner edge side of the watch case body 11 and the lower surface on the inner edge side of the bezel 62, in which the space is the range where the watch case body 11 and the bezel 62 face for coming into contact with each other. However, corresponding to the range in which the conductive parts face for coming into contact with each other, the insulating region 58 is preferably disposed in at least the range.

The insulating region 58 can be continuously formed in a planar direction on the entire section in a circumferential direction of the watch case body 11, the bezel 62, and the dial ring 36. Alternatively, the insulating region 58 can also be formed on a partial section in the circumferential direction thereof.

Figure 18:
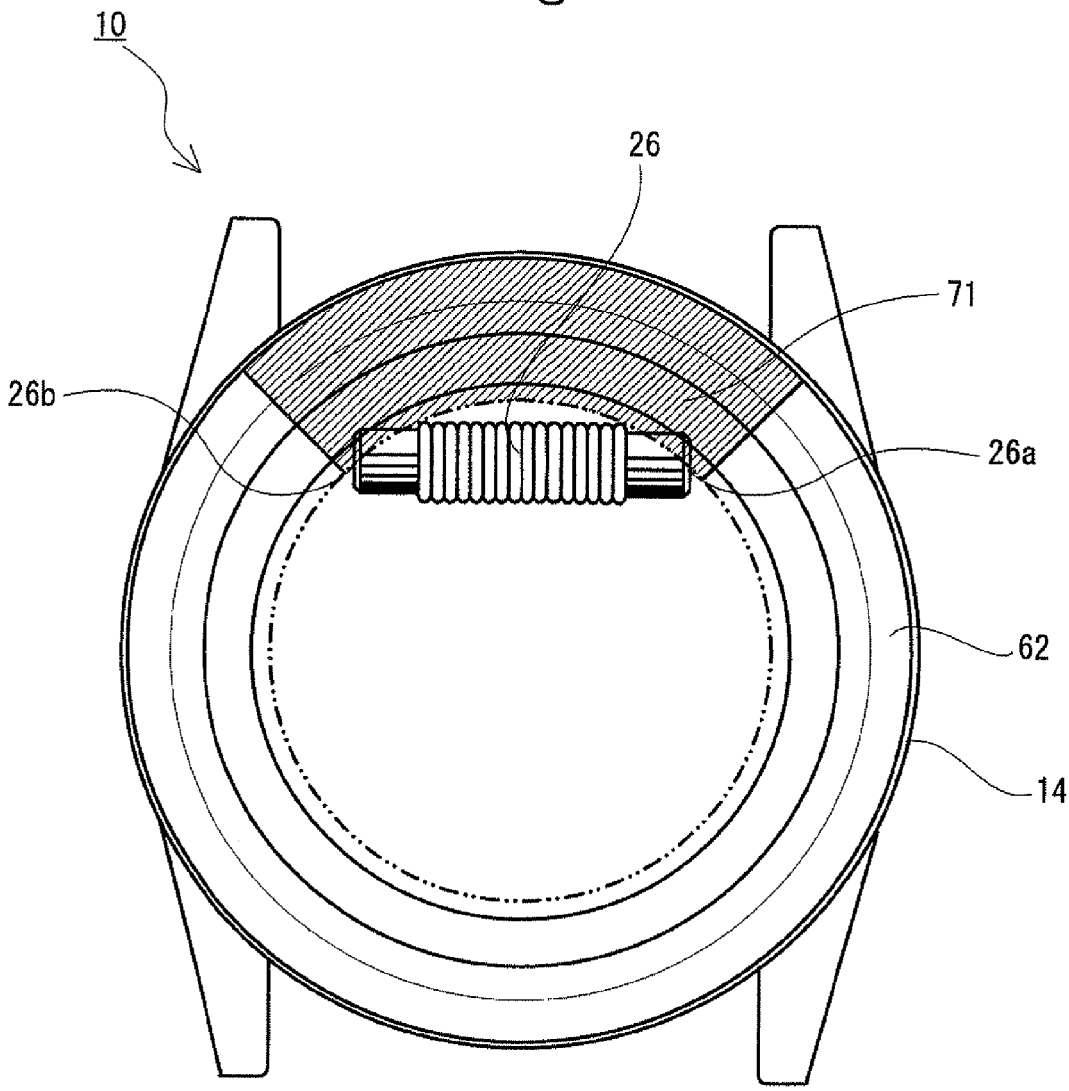
FIG. 18 is a view for illustrating the range above and near the antenna.

In this case, it is desirable that the insulating region 58 is disposed around the section above the antenna 26, in particular at least around the section above the opening end of the antenna 26, from a viewpoint of effectively preventing an inductive current of the bezel 62 around the opening end of the antenna 26. FIG. 18 is a plan view showing a configuration around the section above the antenna 26. In this figure, a region 71 shown by diagonal lines is a region around the section above the antenna 26. For the convenience of explanation, only the inner peripheral side of the dial ring 36 is shown by the alternate long and two short dashes line.

Figure 19:
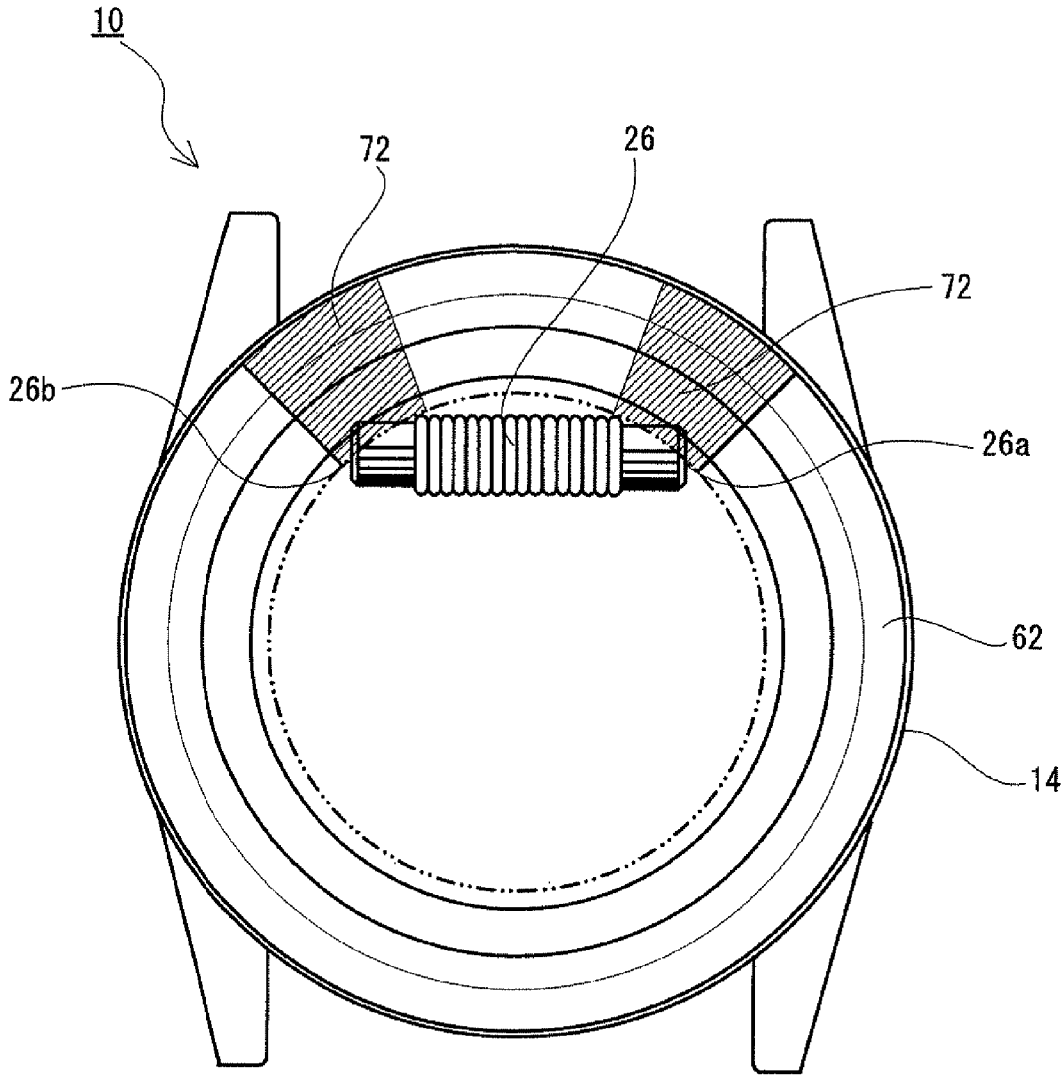
FIG. 19 is a view for illustrating the range around the section above the opening end of the antenna.

FIG. 19 is a plan view showing a configuration around the section above the opening ends 26*a* and 26*b* of the antenna 26. In this figure, two regions 72 shown by diagonal lines are regions around the sections above the opening ends 26*a* and 26*b*. It is particularly preferable that the insulating region 58 is disposed at least in each of the sections.

Figure 20:
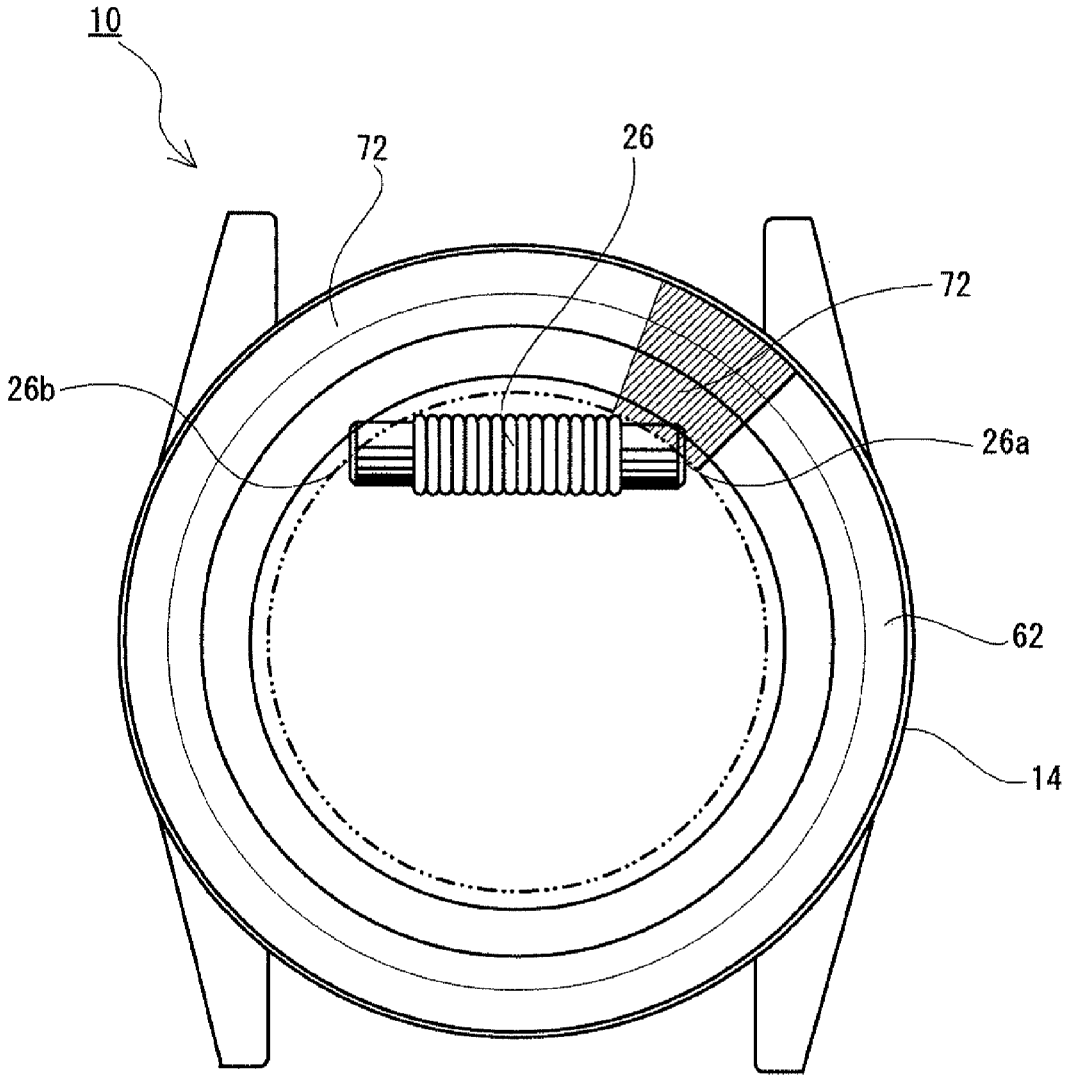
FIG. 20 is a view for illustrating the range around the section above the opening end of the antenna.

FIG. 20 is a plan view showing a configuration around the section above the opening end 26*a* on one side of the antenna 26. In this figure, the region 72 shown by diagonal lines is a region around the section above the opening end 26*a*. It is preferable that the insulating region 58 is disposed at least in the section. (The insulating region 58 can also be disposed in a section above the opening end 26*b* instead.)

Embodiment 11

Figure 21:
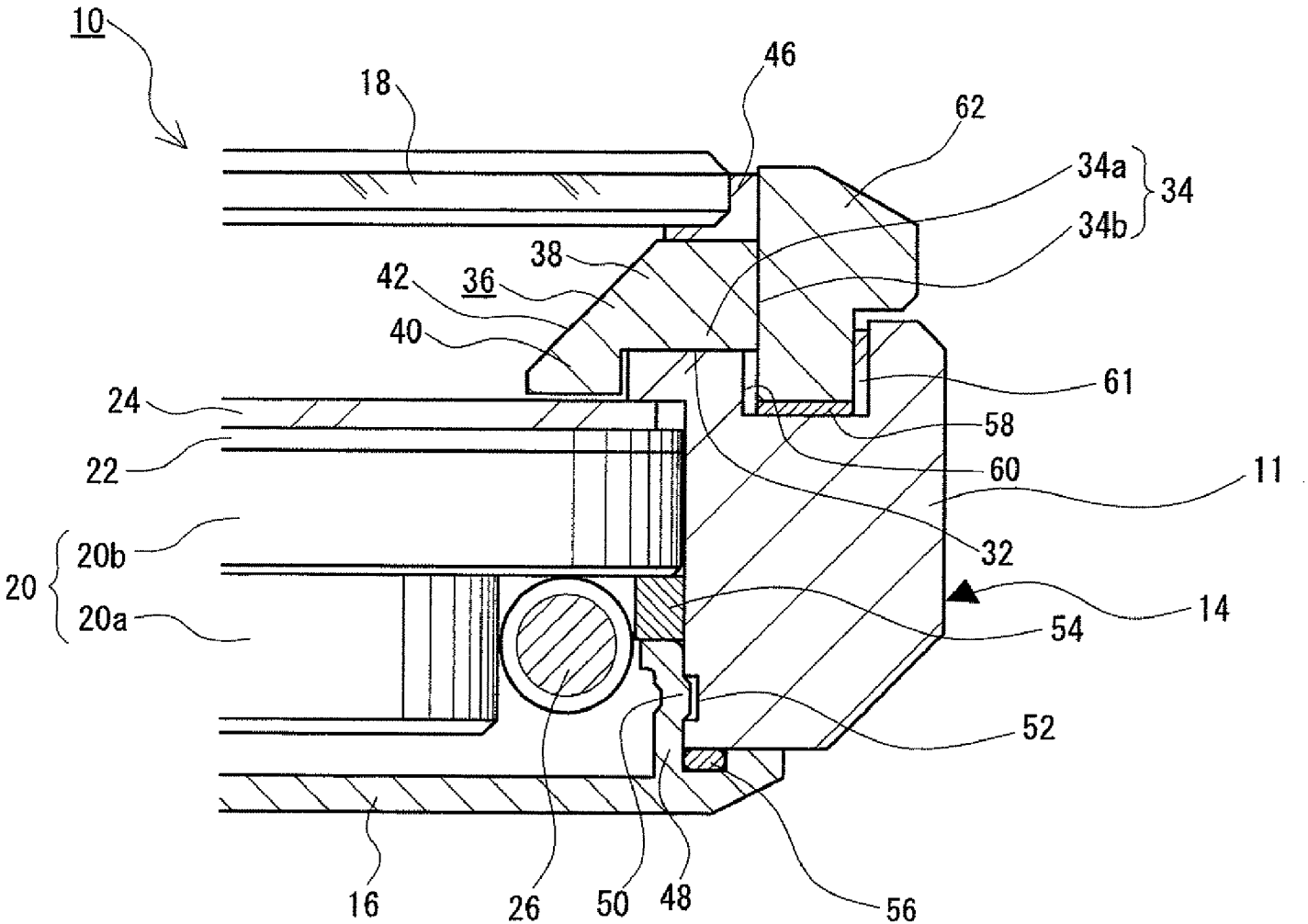
FIG. 21 is a cross-sectional view similar to FIG. 17, which shows a timepiece with a wireless function in accordance with another embodiment of the present invention.

FIG. 21 is a cross-sectional view showing another embodiment of the timepiece with a wireless function in accordance with the present invention similarly to FIG. 17.

The timepiece 10 with a wireless function in accordance with the embodiment has a configuration basically equivalent to that of the timepiece 10 with a wireless function shown in FIGS. 16 and 17. Here, elements equivalent to those illustrated in FIGS. 16 and 17 are numerically numbered similarly and the detailed descriptions of the equivalent elements are omitted.

For the timepiece 10 with a wireless function in accordance with this embodiment, a bezel holding depression 60 is formed in a groove shape on the upper surface of the watch case body 11. The conductive bezel 62 is disposed in such a manner that the lower side of the bezel 62 is fitted into the bezel holding depression 60. In FIG. 21, a numeral 61 represents a waterproof packing that is disposed between the bezel 62 and the watch case body 11 in a sealing state.

A lining receiving portion 32 in a flange shape is protruded in a circular pattern on the inner peripheral side of the watch case body 11. The conductive dial ring 36 is mounted on the lining receiving portion 32.

For the timepiece 10 with a wireless function in accordance with this embodiment, as shown in FIG. 21, an insulating region 58 is disposed between the bottom surface on the bezel holding depression 60 of the watch case 14 and the lower surface of the bezel 62.

By forming the insulating region 58 having such a configuration, the conduction between the conductive watch case body 11 and the conductive bezel 62 is blocked. Consequently, the watch case body 11 and the bezel 62 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

Embodiment 12

Figure 22:
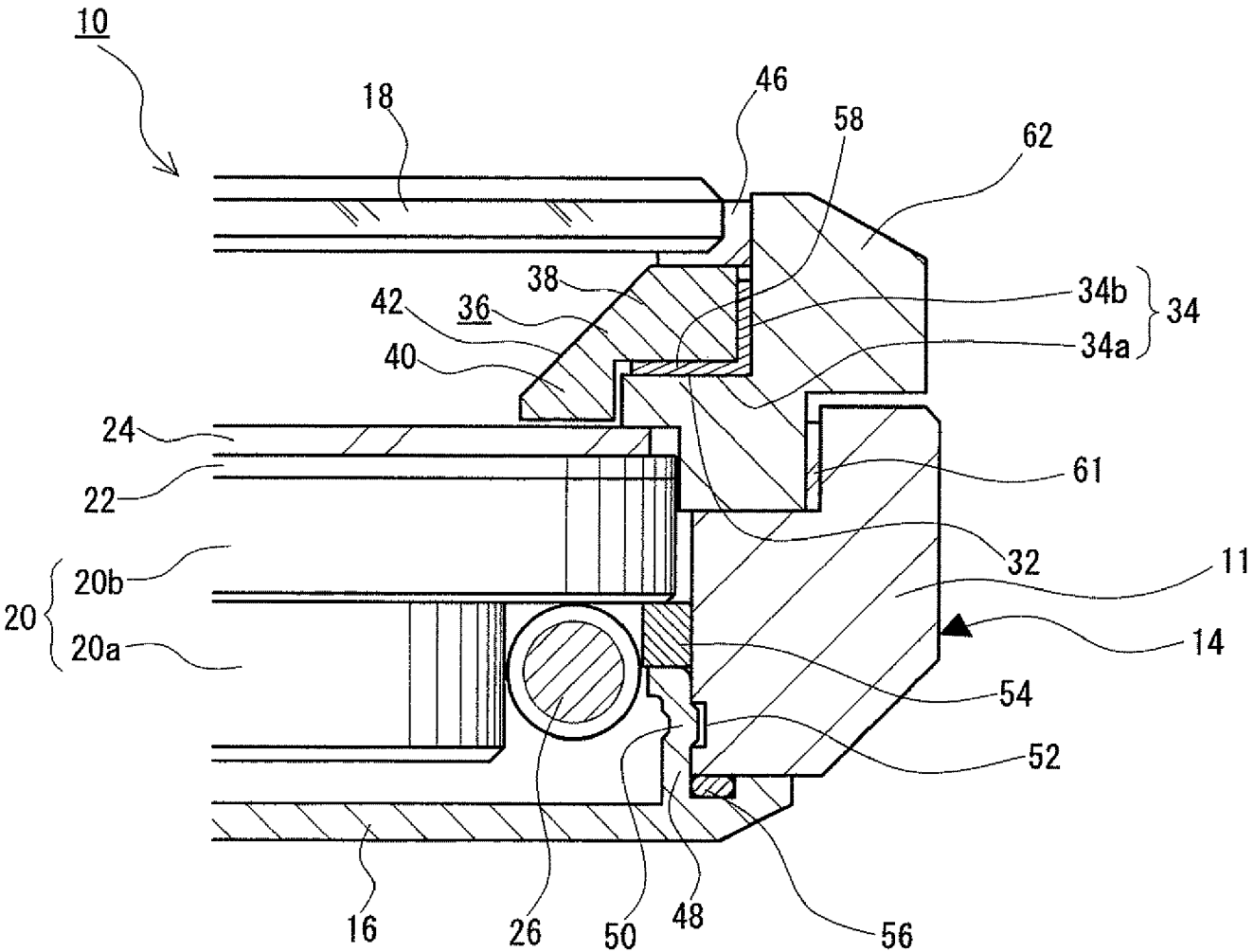
FIG. 22 is a cross-sectional view similar to FIG. 17, which shows a timepiece with a wireless function in accordance with another embodiment of the present invention.

FIG. 22 is a cross-sectional view showing another embodiment of the timepiece with a wireless function in accordance with the present invention similarly to FIG. 17. An exploded perspective view showing a timepiece with a wireless function in accordance with this embodiment is equivalent to FIG. 16.

The timepiece 10 with a wireless function in accordance with the embodiment has a configuration basically equivalent to that of the timepiece 10 with a wireless function shown in FIGS. 16 and 17. Here, elements equivalent to those illustrated in FIGS. 16 and 17 are numerically numbered similarly and the detailed descriptions of the equivalent elements are omitted.

For the timepiece 10 with a wireless function in accordance with this embodiment, as shown in FIG. 22, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36.

By forming the insulating region 58 having such a configuration, the conduction between the conductive bezel 62 and the conductive dial ring 36 is blocked. Consequently, the bezel 62 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

In the embodiment of the present invention, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36. However, in the case in which there is a space between a side face 34*b* of the shoulder section 34 and the outer peripheral face of the dial ring 36 and the side face 34*b* of the shoulder section 34 and the outer peripheral face of the dial ring 36 are not abutted to each other, the insulating region 58 can be formed at least in only a space between the upper surface of the lining receiving portion 32 and the lower surface of the dial ring 36.

The insulating region 58 can be continuously formed in a planar direction on the entire section in a circumferential direction of the watch case body 11, the bezel 62, and the dial ring 36. Alternatively, the insulating region 58 can also be formed on a partial section in the circumferential direction thereof.

In this case, it is desirable that the insulating region 58 is disposed around the section above the antenna 26, in particular at least around the section above the opening end of the antenna 26, from a viewpoint of effectively preventing an inductive current of the bezel 62 and the dial ring 36 around the opening end of the antenna 26.

The configurations around the section above the antenna 26 and around the section above the opening end of the antenna 26 are similar to those explained in above described Embodiment shown in FIGS. 16 and 17. The specific examples of the configurations are similar to the ranges shown in FIGS. 18 to 20 in a plan view.

Embodiment 13

Figure 23:
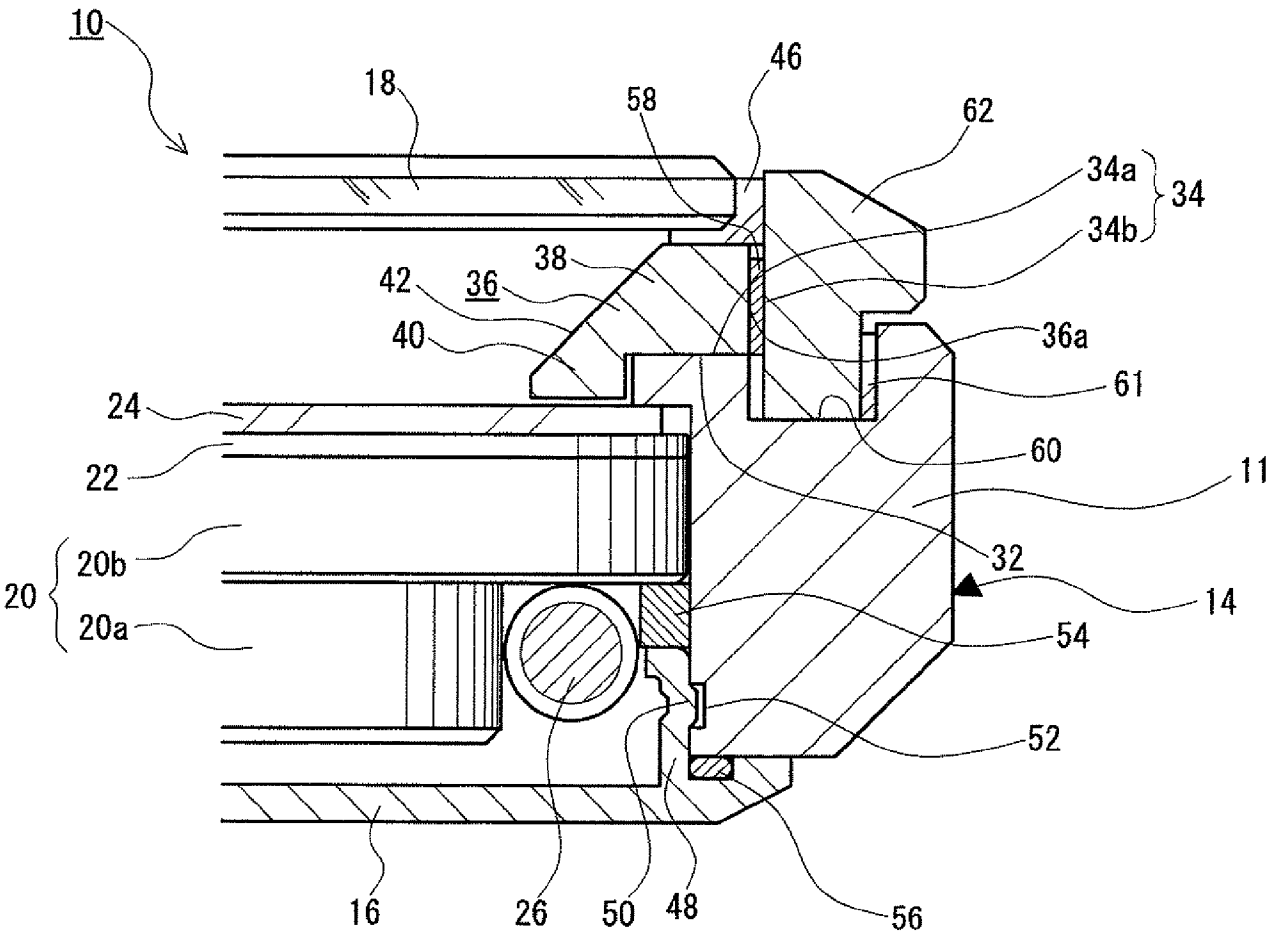
FIG. 23 is a cross-sectional view similar to FIG. 22, which shows a timepiece with a wireless function in accordance with another embodiment of the present invention.

FIG. 23 is a cross-sectional view showing another embodiment of the timepiece with a wireless function in accordance with the present invention similarly to FIG. 22.

The timepiece 10 with a wireless function in accordance with the embodiment has a configuration basically equivalent to that of the timepiece 10 with a wireless function shown in FIG. 21. Here, elements equivalent to those illustrated in FIG. 21 are numerically numbered similarly and the detailed descriptions of the equivalent elements are omitted.

For the timepiece 10 with a wireless function in accordance with this embodiment, a bezel holding depression 60 is formed in a groove shape on the upper surface of the watch case body 11. The lower side of the bezel 62 is fitted into the bezel holding depression 60.

A lining receiving portion 32 in a flange shape is protruded in a circular pattern on the inner peripheral side of the watch case body 11. The conductive dial ring 36 is mounted on the lining receiving portion 32.

For the timepiece 10 with a wireless function in accordance with this embodiment, as shown in FIG. 23, an insulating region 58 is disposed in a space in which the bezel 62 and the dial ring 36 face for coming into contact with each other, that is, a space between the inner peripheral face (the side face 34*b* of the shoulder section 34) of the bezel 62 and the outer peripheral face of the dial ring 36.

By forming the insulating region 58 having such a configuration, the conduction between the conductive bezel 62 and the conductive dial ring 36 is blocked. Consequently, the bezel 62 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

Embodiment 14

Figure 24:
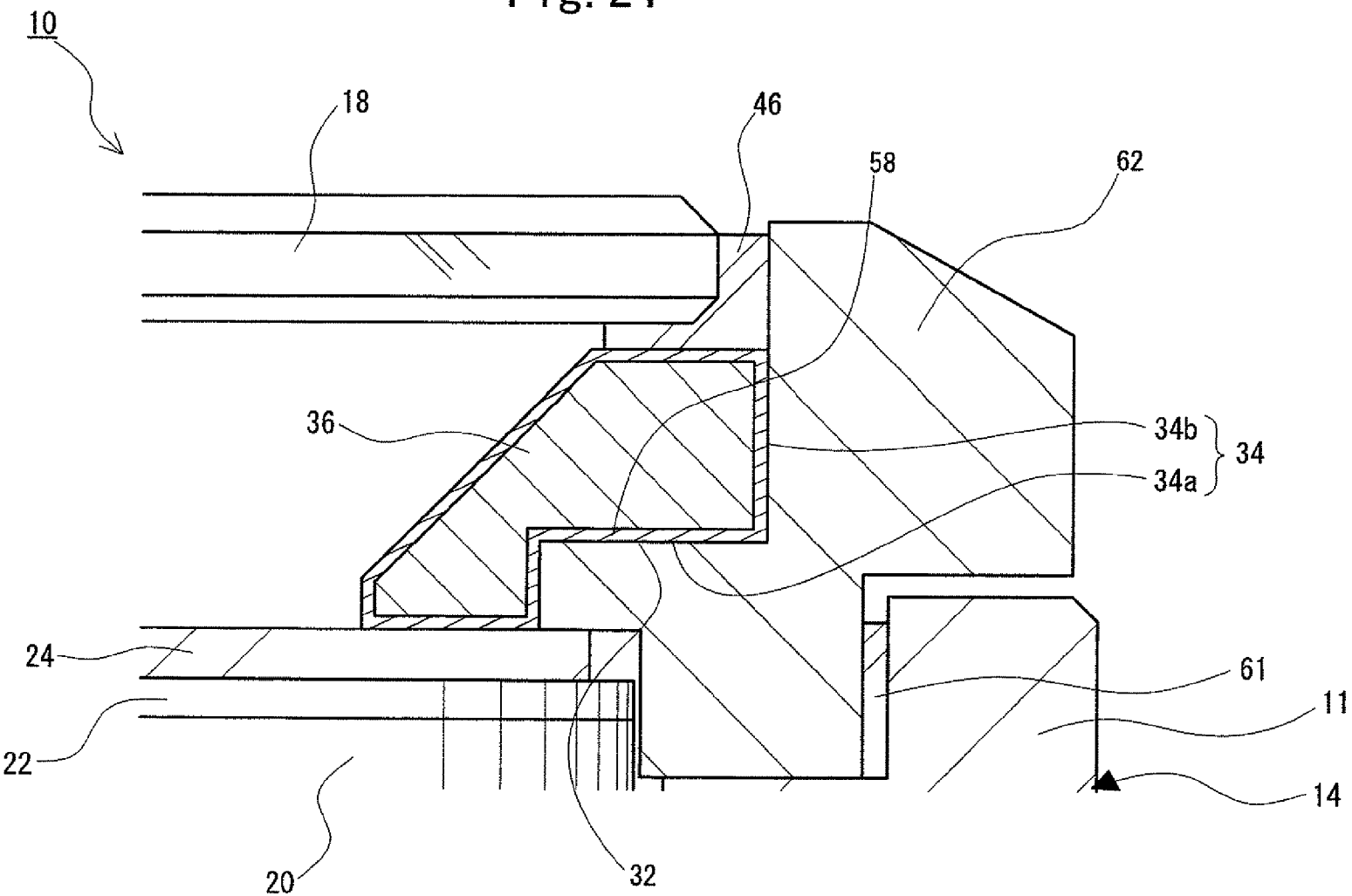
FIG. 24 is an enlarged cross-sectional view showing an area around the insulating region of the timepiece with a wireless function in accordance with another embodiment of the present invention.

FIG. 24 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIGS. 16 and 17. Here, elements equivalent to those illustrated in FIGS. 16 and 17 are numerically numbered similarly and the detailed descriptions of the equivalent elements are omitted.

For the timepiece 10 with a wireless function in accordance with the embodiment, the insulating region 58 is formed on the entire surface of the dial ring 36. For instance, the insulating region 58 can be formed as an insulating film coated on the entire surface of the dial ring 36. As a method for forming the insulating region 58, a method of dipping can be mentioned for instance.

By forming the insulating region 58 having such a configuration, the conduction between the conductive bezel 62 and the conductive dial ring 36 is blocked. Consequently, the bezel 62 and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11 the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

Embodiment 15

Figure 25:
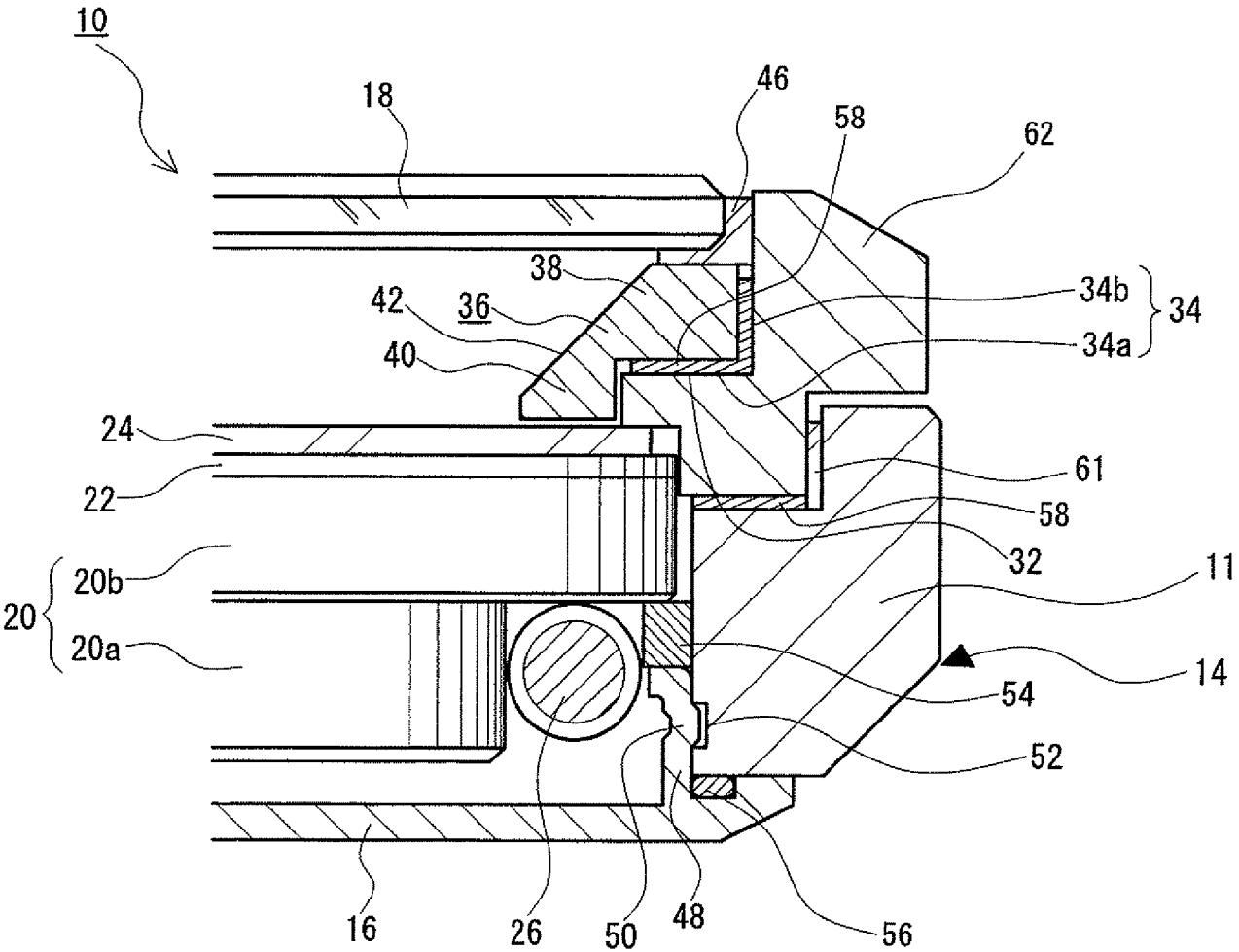
FIG. 25 is a cross-sectional view similar to FIG. 17, which shows a timepiece with a wireless function in accordance with another embodiment of the present invention.

FIG. 25 is a cross-sectional view showing another embodiment of the timepiece with a wireless function in accordance with the present invention similarly to FIG. 17. An exploded perspective view showing a timepiece with a wireless function in accordance with this embodiment is equivalent to FIG. 16.

The timepiece 10 with a wireless function in accordance with the embodiment has a configuration basically equivalent to that of the timepiece 10 with a wireless function shown in FIGS. 16 and 17. Here, elements equivalent to those illustrated in FIGS. 16 and 17 are numerically numbered similarly and the detailed descriptions of the equivalent elements are omitted.

For the timepiece 10 with a wireless function in accordance with this embodiment, as shown in FIG. 25, an insulating region 58 for insulating the watch case body 11 and the bezel 62 from each other is disposed between the upper surface on the inner edge side of the watch case body 11 and the lower surface on the inner edge side of the bezel 62.

In addition, an insulating region 58 for insulating the dial ring 36 and the bezel 62 from each other is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36.

By forming the insulating region 58 having such a configuration, the conduction among the conductive watch case body 11, the conductive dial ring 36, and the conductive bezel 62 is blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

In this embodiment, an insulating region 58 is disposed in the space between the upper surface on the inner edge side of the watch case body 11 and the lower surface on the inner edge side of the bezel 62, in which the space is the range where the watch case body 11 and the bezel 62 face for coming into contact with each other. However, corresponding to the range in which the conductive parts face for coming into contact with each other, the insulating region 58 is preferably disposed in at least the range.

In the embodiment of the present invention, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36. However, in the case in which there is a space between a side face 34*b* of the shoulder section 34 and the outer peripheral face of the dial ring 36 and the side face 34*b* of the shoulder section 34 and the outer peripheral face of the dial ring 36 are not abutted to each other, the insulating region 58 can be formed at least in only a space between the upper surface of the lining receiving portion 32 and the lower surface of the dial ring 36.

The insulating region 58 can be continuously formed in a planar direction on the entire section in a circumferential direction of the watch case body 11, the bezel 62, and the dial ring 36. Alternatively, the insulating region 58 can also be formed on a partial section in the circumferential direction thereof.

In this case, it is desirable that the insulating region 58 is disposed around the section above the antenna 26, in particular at least around the section above the opening end of the antenna 26, from a viewpoint of effectively preventing an inductive current of the bezel 62 and the dial ring 36 around the opening end of the antenna 26. The configurations around the section above the antenna 26 and around the section above the opening end of the antenna 26 are similar to those explained in above described Embodiment shown in FIGS. 16 and 17. The specific examples of the configurations are similar to the ranges shown in FIGS. 18 to 20 in a plan view.

Embodiment 16

Figure 26:
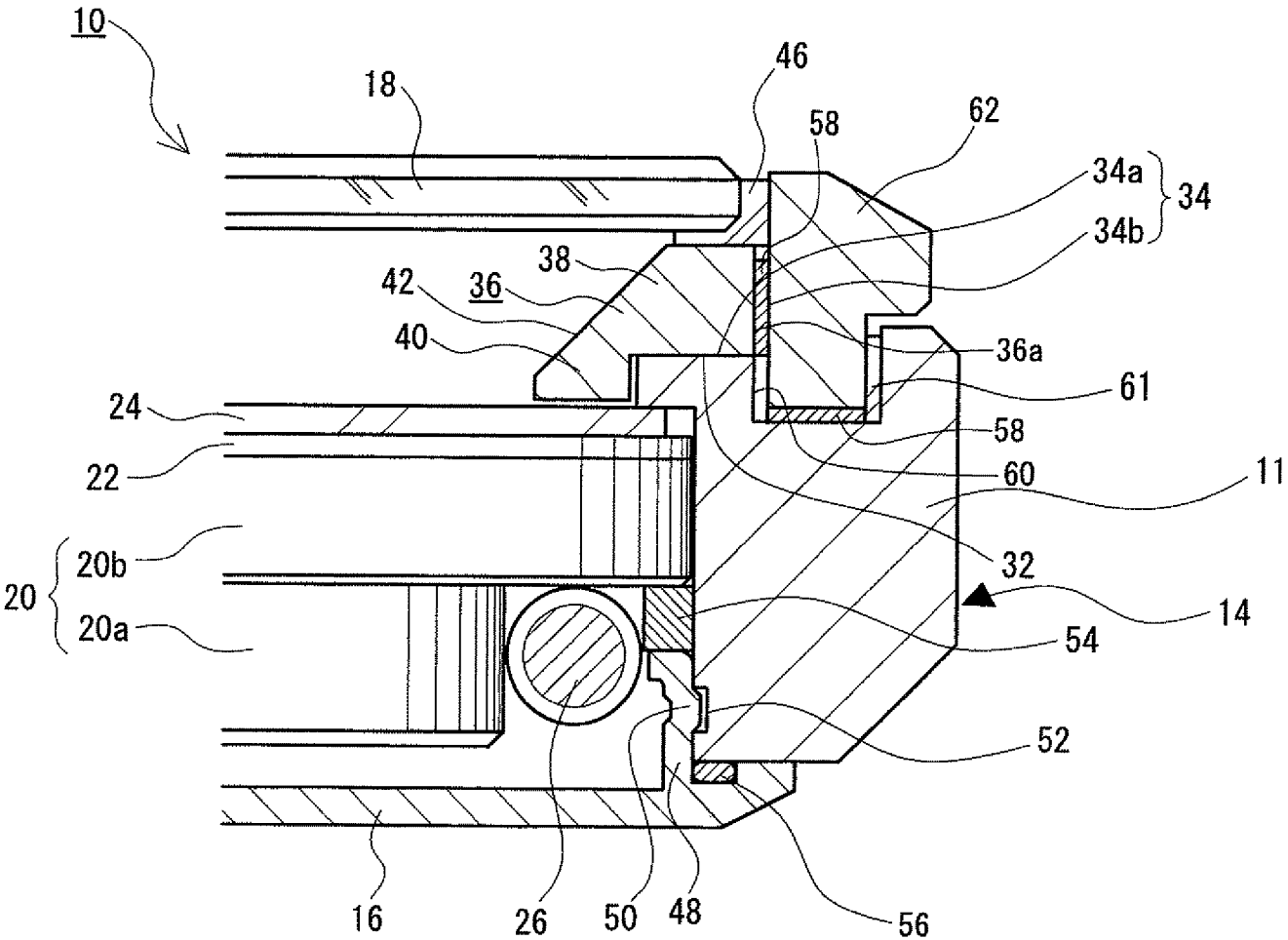
FIG. 26 is a cross-sectional view similar to FIG. 25, which shows a timepiece with a wireless function in accordance with another embodiment of the present invention.

FIG. 26 is a cross-sectional view showing another embodiment of the timepiece with a wireless function in accordance with the present invention similarly to FIG. 25.

The timepiece 10 with a wireless function in accordance with the embodiment has a configuration basically equivalent to that of the timepiece 10 with a wireless function shown in FIG. 21. Here, elements equivalent to those illustrated in FIG. 21 are numerically numbered similarly and the detailed descriptions of the equivalent elements are omitted.

For the timepiece 10 with a wireless function in accordance with this embodiment, a bezel holding depression 60 is formed in a groove shape on the upper surface of the watch case body 11. The lower side of the bezel 62 is fitted into the bezel holding depression 60. In FIG. 26, a numeral 61 represents a waterproof packing that is disposed between the bezel 62 and the watch case body 11 in a sealing state.

A lining receiving portion 32 in a flange shape is protruded in a circular pattern on the inner peripheral side of the watch case body 11. The conductive dial ring 36 is mounted on the lining receiving portion 32.

For the timepiece 10 with a wireless function in accordance with this embodiment, as shown in FIG. 26, an insulating region 58 for insulating the watch case body 11 and the bezel 62 from each other is disposed between the bottom surface on the bezel holding depression 60 of the watch case body 11 and the lower surface of the bezel 62. In addition, an insulating region 58 is disposed in a space in which the bezel 62 and the dial ring 36 face for coming into contact with each other, that is, a space between the inner peripheral face (the side face 34*b* of the shoulder section 34) of the bezel 62 and the outer peripheral face of the dial ring 36.

By forming the insulating region 58 having such a configuration, the conduction among the conductive watch case body 11, the conductive dial ring 36, and the conductive bezel 62 is blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

Embodiment 17

Figure 27:
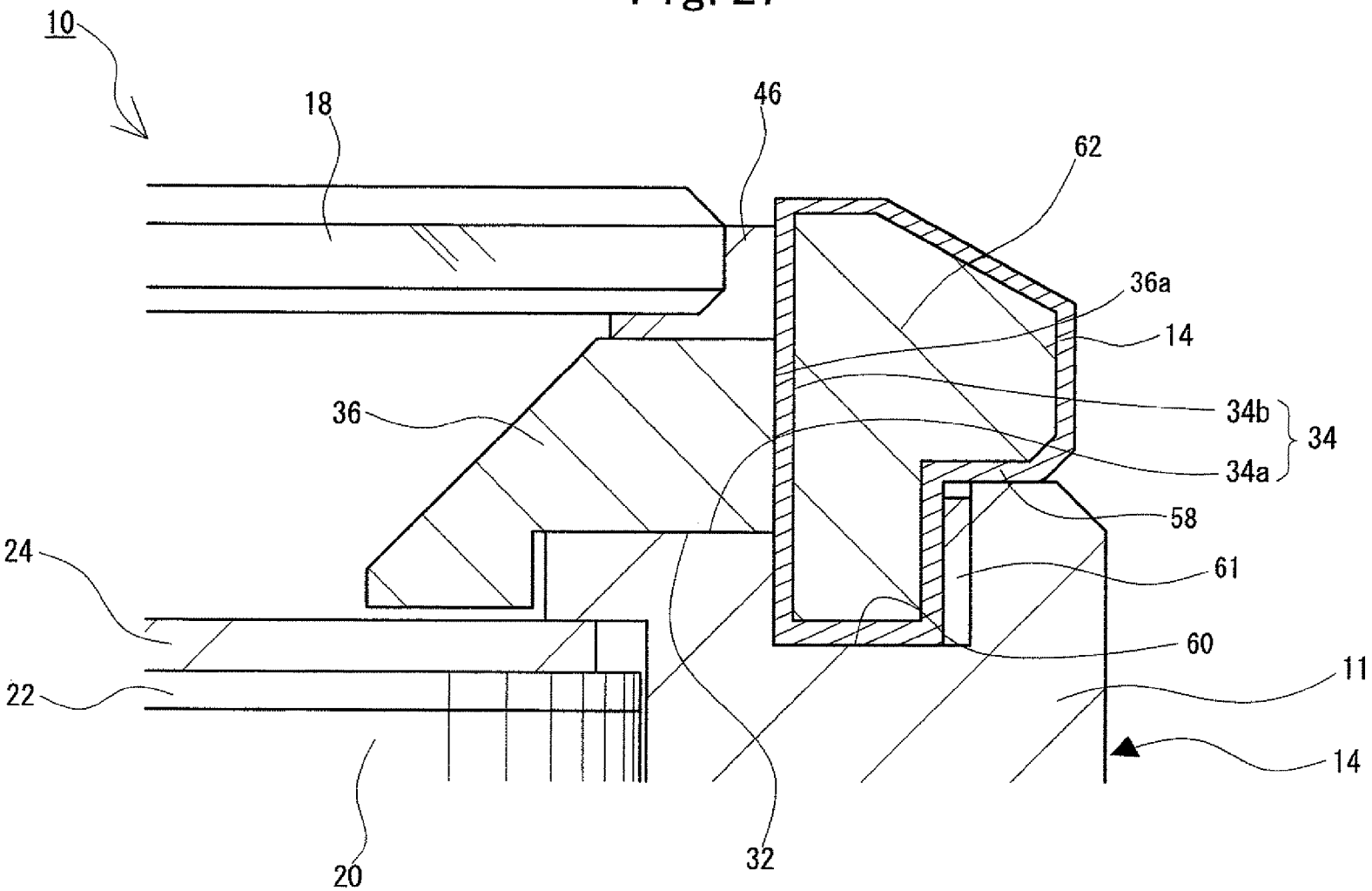
FIG. 27 is an enlarged cross-sectional view showing an area around the insulating region of the timepiece with a wireless function in accordance with another embodiment of the present invention.

FIG. 27 is an enlarged cross-sectional view showing another embodiment of an area around the insulating region of the timepiece with a wireless function in accordance with the present invention.

The timepiece 10 with a wireless function in accordance with the embodiment has a configuration basically equivalent to that of the timepiece 10 with a wireless function shown in FIG. 21. Here, elements equivalent to those illustrated in FIG.

21 are numerically numbered similarly and the detailed descriptions of the equivalent elements are omitted.

For the timepiece 10 with a wireless function in accordance with this embodiment, the insulating region 58 is formed on the entire surface of the bezel 62. For instance, the insulating region 58 can be formed as an insulating film coated on the entire surface of the bezel 62. As a method for forming the insulating region 58, a method of dipping can be mentioned for instance.

By forming the insulating region 58 having such a configuration, the conduction among the conductive watch case body 11, the conductive dial ring 36, and the conductive bezel 62 is blocked. Consequently, the watch case body 11, the bezel 62, and the dial ring 36 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11, the bezel 62, and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case 14 or the like is used, the receiving sensitivity of the antenna can be extremely improved similarly to the embodiment shown in FIGS. 16 and 17.

Embodiment 18

Figure 28:
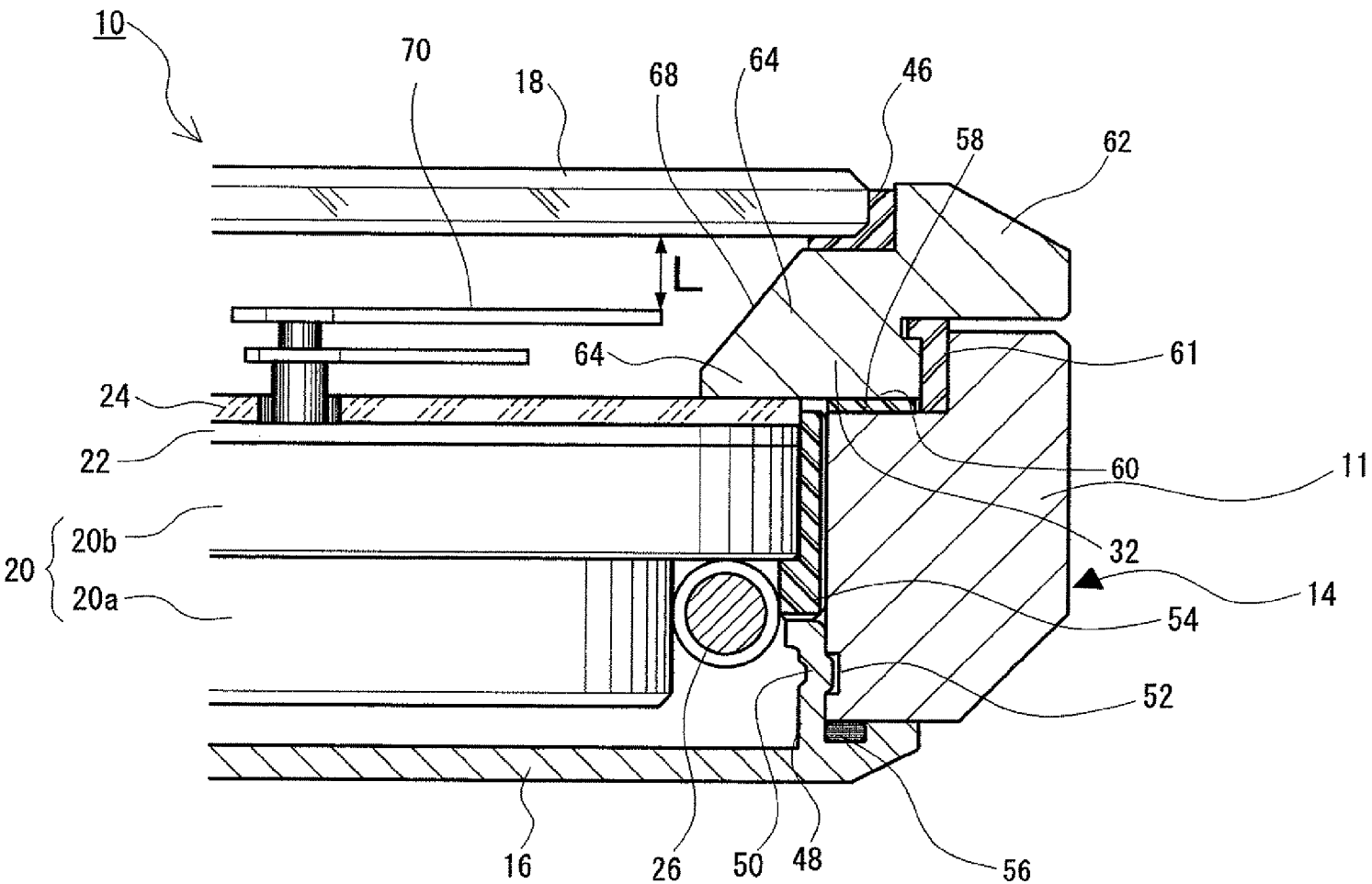
FIG. 28 is a cross-sectional view similar to FIG. 2, which shows a timepiece with a wireless function in accordance with another embodiment of the present invention.

FIG. 28 is a cross-sectional view showing another embodiment of the timepiece with a wireless function in accordance with the present invention similarly to FIG. 2.

The timepiece 10 with a wireless function in accordance with the embodiment has a configuration basically equivalent to that of the timepiece 10 with a wireless function shown in FIGS. 1 and 2. Here, elements equivalent to those illustrated in FIGS. 1 and 2 are numerically numbered similarly and the detailed descriptions of the equivalent elements are omitted.

For the timepiece 10 with a wireless function in accordance with this embodiment, as shown in FIG. 28, the watch case 14 is separated into a plurality of parts. In this embodiment, the watch case 14 is separated into a watch case body 11 and a conductive bezel 62.

A bezel holding depression 60 is formed in a stepped shape on the upper surface on the inner side of the watch case body 11. The conductive bezel 62 is disposed in such a manner that the lower side of the bezel 62 is fitted into the bezel holding depression 60.

The bezel 62 is provided with a bezel body 64 disposed on the bezel holding depression 60 and an extended portion 66 that is extended from the bezel body 64 to the dial plate 24 and that is disposed on the dial plate 24. A tapered face 68 in which a diameter of a lower position thereof gradually becomes smaller is formed on the inner face side of the bezel 62. An index such as a time character is shown on the tapered face 68.

In FIG. 28, a numeral 61 represents a waterproof packing that is disposed between the bezel 62 and the watch case body 11 in a sealing state. In addition, a fixing (waterproof) packing 46 for fixing the windshield 18 in a sealing state is disposed on the upper end on the inner peripheral side of the bezel 62.

A support frame 54 is disposed among a large diameter portion 20*b* formed at the upper section of the movement 20, the upper end of the core cylinder member 48, and the inner side of the watch case body 11. The support frame 54 is made of a nonconductive material such as a synthetic resin, and ensures a space in a planar direction between the conductive watch case body 11 and a conductive antenna 26, thereby maintaining a high receiving performance of the antenna 26.

For the timepiece 10 with a wireless function in accordance with this embodiment, as shown in FIG. 28, an insulating region 58 is disposed between the bezel 62 and the watch case body 11.

By forming the insulating region 58 having such a configuration, the conduction between the conductive watch case body 11 and the conductive bezel 62 is blocked. Consequently, the watch case body 11 and the bezel 62 are insulated from each other, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the watch case body 11 and the bezel 62, as compared with a large eddy current generated in the case of the watch case of one body that is not separated into a plurality of parts. As a result, a reduction in the receiving sensitivity of the antenna due to the eddy current can be suppressed. Furthermore, even in the case in which the conductive watch case or the like is used, the receiving sensitivity of the antenna 26 can be extremely improved.

In this case, an insulating film and an insulating member described in the embodiment shown in FIGS. 1 and 2 can be used as the insulating region 58. Like the embodiment shown in FIG. 10 and other embodiments, the insulating region 58 can be formed on the entire surface of the bezel 62.

The insulating region 58 can be continuously formed in a planar direction on the entire section in a circumferential direction of the watch case body 11 and the bezel 62. Alternatively, the insulating region 58 can also be formed on a partial section in the circumferential direction thereof. In this case, it is desirable that the insulating region 58 is disposed around the section above the antenna 26, in particular at least around the section above the opening end of the antenna 26, from a viewpoint of effectively preventing an inductive current of the bezel 62 around the opening end of the antenna 26. The configurations around the section above the antenna 26 and around the section above the opening end of the antenna 26 are similar to those explained in Embodiment 1 described above. The specific examples of the configurations are similar to the ranges shown in FIGS. 3 to 5 in a plan view.

For the timepiece 10 with a wireless function that adopts such a metal external packaging and that is provided with the watch case body 11 and the conductive bezel 62 as one of a plurality of parts separated from the watch case 14 made of a metal, in the case in which a rear cover 16 that functions as a ground on a human wrist side, the watch case body 11, and the bezel 62 are electrically insulated by the waterproof packing 61 and the insulating region 58, a static electricity from the side of the windshield 18 is stored in the bezel 62 in some cases.

Figure 35:
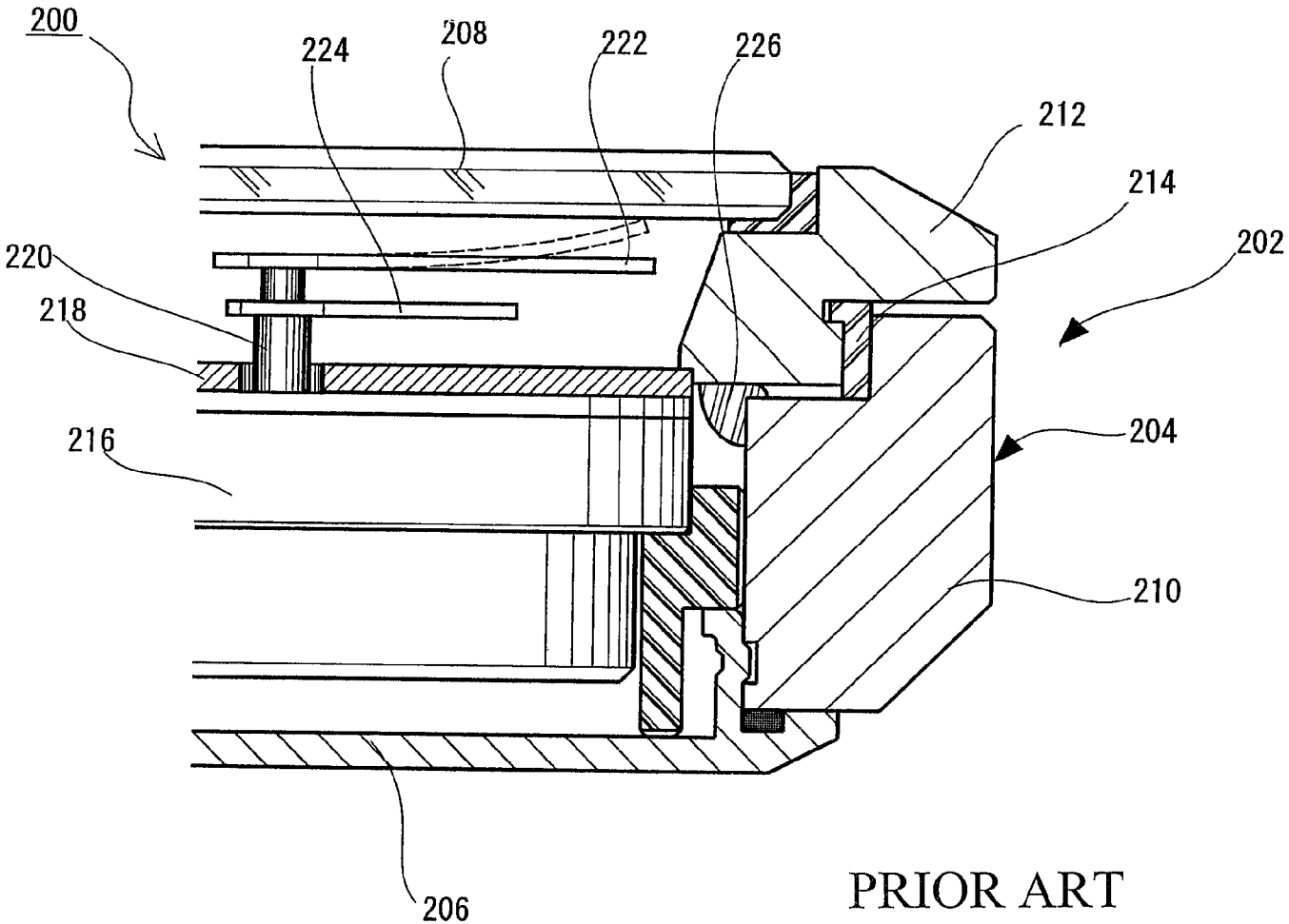
FIG. 35 is a cross-sectional view showing a conventional wristwatch.

By the operation of a static electricity, as shown by the dashed lines of Patent document 2 shown in FIG. 35, the minute hand 222 is abutted to the windshield 208, and the minute hand 222 cannot be moved in some cases. In addition, a static electricity is transmitted to the movement 216 via the minute hand 222, thereby preventing the movement 216 from being operated.

To solve the above problem, in the present invention, as shown in FIG. 28, a smallest distance L between the opening end of an indicating needle 70 disposed closest to the windshield 18, in particular the upper surface of the opening end farthest from a hand spindle 31, and the lower surface of the windshield 18 is preferably 400 μm or more, more preferably 450 μm or more, further preferably 500 μm or more depending on a material, rigidity, and a shape of the indicating needle 70 in the case of a wristwatch.

In this case, the upper limit of the distance L is determined by the design of the wristwatch.

Figure 29:
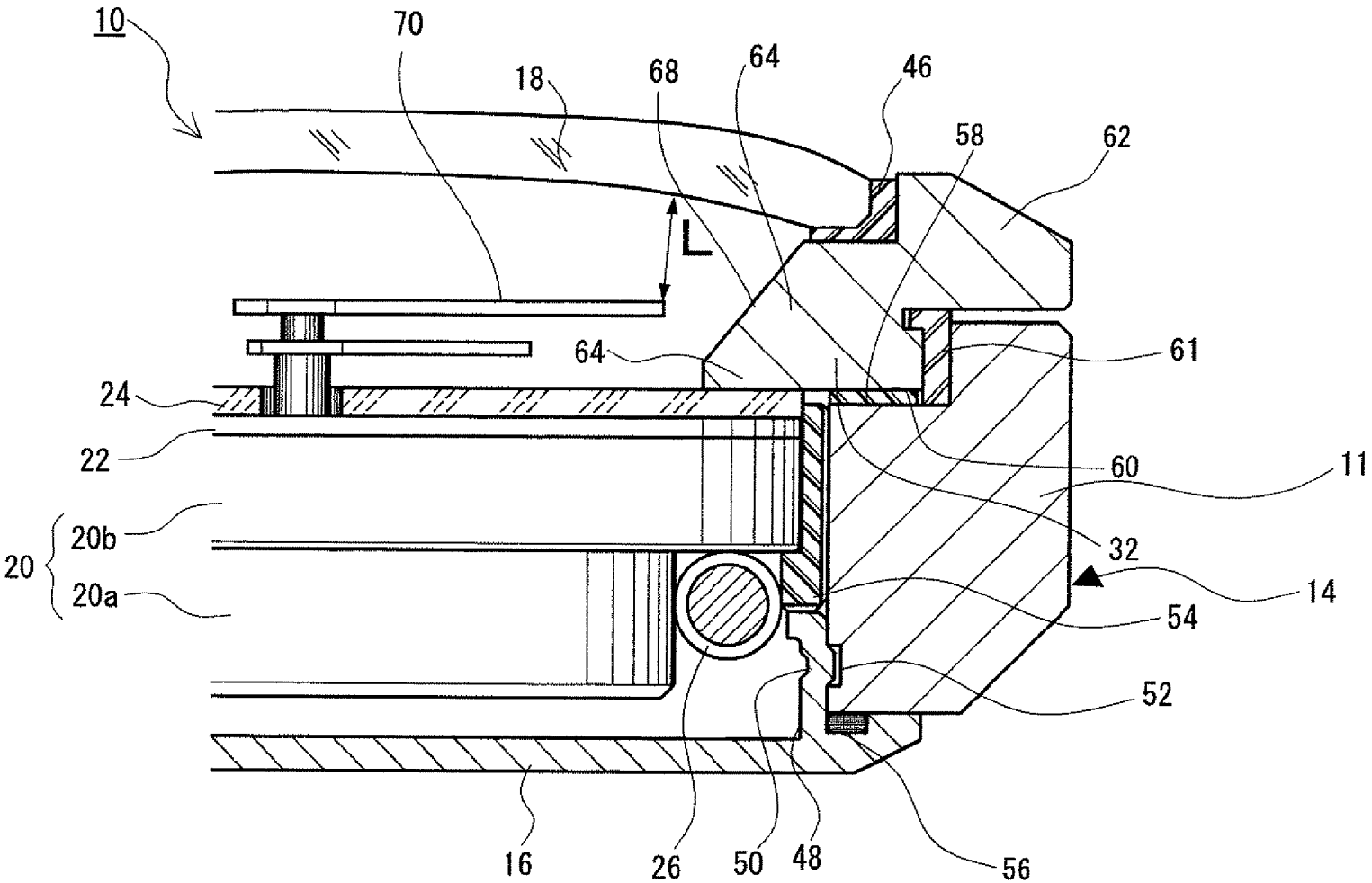
FIG. 29 is a cross-sectional view similar to FIG. 2, which shows a timepiece with a wireless function in accordance with another embodiment of the present invention.

For instance, as shown in FIG. 29, in the case in which the windshield 18 is curved, the distance L is not a distance in a vertical direction from the indicating needle 70, but the smallest distance between the indicating needle 70 and the windshield 18.

The dial plate 24 is mainly composed of a translucent material, a nonconductive material, and a nonmagnetic material for the solar driving wristwatch. Consequently, the dial plate 24 is insulated from the surrounding conductive parts such as the watch case body 11 and the bezel 62.

By this configuration, even in the case in which a static electricity from the side of the windshield 18 is stored in the bezel 62, there can be prevented for instance a state in which the indicating needle 70 cannot be moved and a state in which a static electricity is transmitted to the movement 20 via the indicating needle 70 whereby the operation of the movement 20 is disturbed.

Embodiment 19

Figure 30:
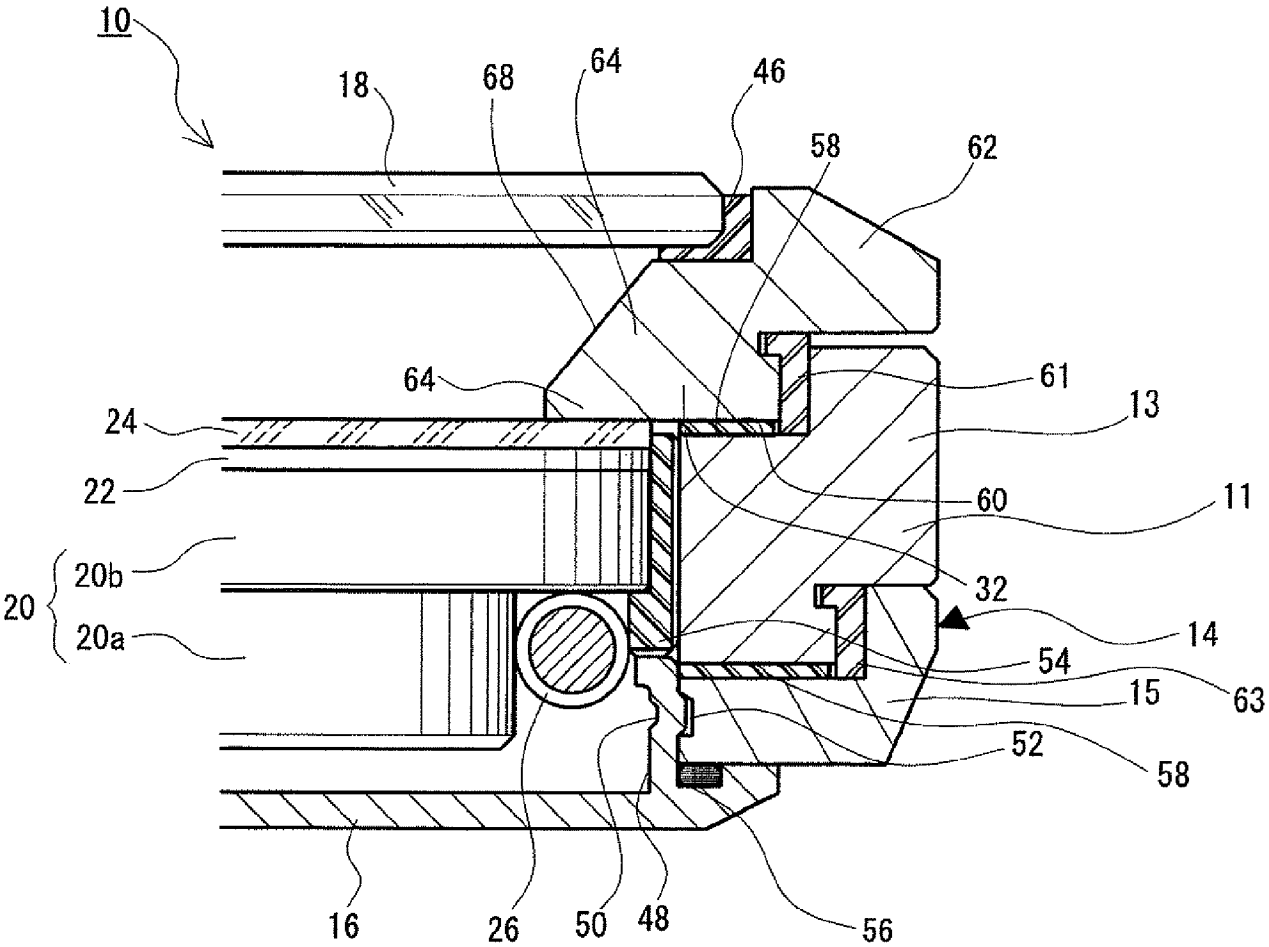
FIG. 30 is a cross-sectional view similar to FIG. 2, which shows a timepiece with a wireless function in accordance with another embodiment of the present invention.

FIG. 30 is a cross-sectional view showing another embodiment of the timepiece with a wireless function in accordance with the present invention similarly to FIG. 2.

The timepiece 10 with a wireless function in accordance with the embodiment has a configuration basically equivalent to that of the timepiece 10 with a wireless function shown in FIGS. 1 and 2. Here, elements equivalent to those illustrated in FIGS. 1 and 2 are numerically numbered similarly and the detailed descriptions of the equivalent elements are omitted.

For the timepiece 10 with a wireless function in accordance with this embodiment, as shown in FIG. 30, the watch case 14 is separated into a plurality of parts. In this embodiment, the watch case 14 is separated into a watch case body 11 and a conductive bezel 62. Moreover, the watch case body 11 is separated into an upper watch case body 13 and a lower watch case body 15.

A bezel holding depression 60 is formed in a stepped shape on the upper surface on the inner side of the upper watch case body 13. The conductive bezel 62 is disposed in such a manner that the lower side of the bezel 62 is fitted into the bezel holding depression 60.

In FIG. 30, a numeral 61 represents a waterproof packing that is disposed between the bezel 62 and the upper watch case body 13 in a sealing state. In addition, a numeral 63 represents a waterproof packing that is disposed between the upper watch case body 13 and the lower watch case body 15 for sealing the space between the upper watch case body 13 and the lower watch case body 15 in a sealing state.

For the timepiece 10 with a wireless function in accordance with this embodiment, as shown in FIG. 30, an insulating region 58 is disposed between the bezel 62 and the upper watch case body 13, and between the upper watch case body 13 and the lower watch case body 15.

By forming the insulating region 58 having such a configuration, the conduction between the conductive bezel 62 and the upper watch case body 13 and the conduction between the upper watch case body 13 and the lower watch case body 15 are both blocked.

By the above configuration, the bezel 62 and the upper watch case body 13, and the upper watch case body 13 and the lower watch case body 15 are insulated from each other, respectively, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the upper watch case body 13, the lower watch case body 15, and the bezel 62, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

Embodiment 20

Figure 31:
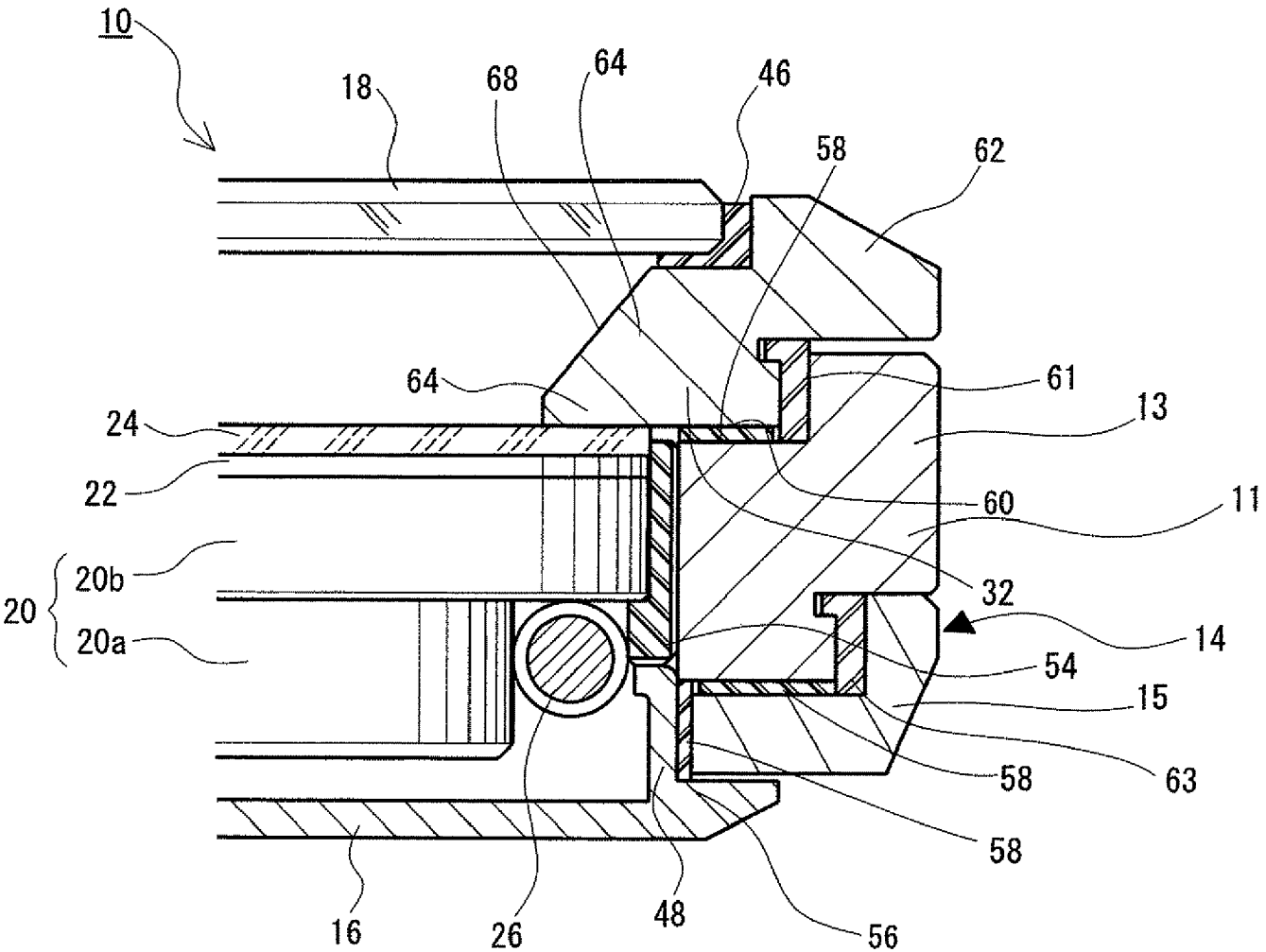
FIG. 31 is a cross-sectional view similar to FIG. 30, which shows a timepiece with a wireless function in accordance with another embodiment of the present invention.

FIG. 31 is a cross-sectional view showing another embodiment of the timepiece with a wireless function in accordance with the present invention similarly to FIG. 30.

The timepiece 10 with a wireless function in accordance with the embodiment has a configuration basically equivalent to that of the timepiece 10 with a wireless function shown in FIG. 30. Here, elements equivalent to those illustrated in FIG. 30 are numerically numbered similarly and the detailed descriptions of the equivalent elements are omitted.

For the timepiece 10 with a wireless function in accordance with this embodiment, as shown in FIG. 31, an insulating region 58 is also disposed in the space between the lower watch case body 15 and the rear cover 16, in addition to the spaces between the bezel 62 and the upper watch case body 13 and between the upper watch case body 13 and the lower watch case body 15.

By forming the insulating region 58 having such a configuration, the conduction between the conductive upper watch case body 13 and the conductive bezel 62, the conduction between the upper watch case body 13 and the lower watch case body 15, and the conduction between the lower watch case body 15 and the rear cover 16 are all blocked.

By the above configuration, the upper watch case body 13 and the conductive bezel 62, the upper watch case body 13 and the lower watch case body 15, and the lower watch case body 15 and the rear cover 16 are insulated from each other, respectively, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the upper watch case body 13, the lower watch case body 15, and the bezel 62, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

Embodiment 21

Figure 32:
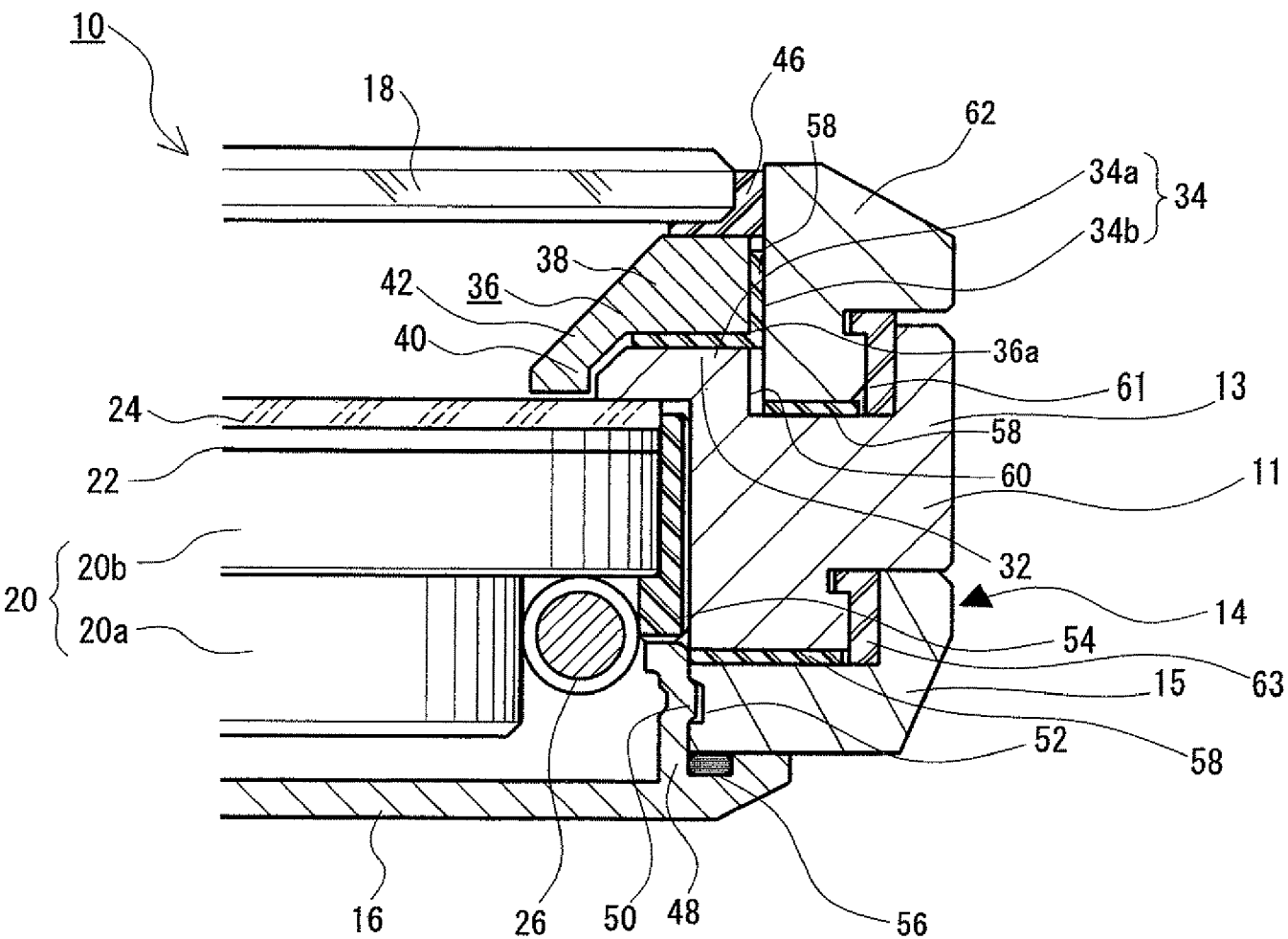
FIG. 32 is a cross-sectional view similar to FIG. 2, which shows a timepiece with a wireless function in accordance with another embodiment of the present invention.

FIG. 32 is a cross-sectional view showing another embodiment of the timepiece with a wireless function in accordance with the present invention similarly to FIG. 2.

The timepiece 10 with a wireless function in accordance with the embodiment has a configuration basically equivalent to that of the timepiece 10 with a wireless function shown in FIGS. 1, 2, and 9. Here, elements equivalent to those illustrated in FIGS. 1, 2, and 9 are numerically numbered similarly and the detailed descriptions of the equivalent elements are omitted.

For the timepiece 10 with a wireless function in accordance with this embodiment, as shown in FIG. 32, the watch case 14 is separated into a plurality of parts. In this embodiment, the watch case 14 is separated into a watch case body 11, a conductive bezel 62, and a dial ring 36. Moreover, the watch case body 11 is separated into an upper watch case body 13 and a lower watch case body 15 similarly to the embodiment shown in FIG. 31.

A lining receiving portion 32 in a flange shape is protruded in a circular pattern on the inner peripheral side of the watch case body 11. The conductive dial ring 36 is mounted on a shoulder section 34 formed by the lining receiving portion 32.

In FIG. 32, a numeral 61 represents a waterproof packing that is disposed between the bezel 62 and the upper watch case body 13 in a sealing state. In addition, a numeral 63 represents a waterproof packing that is disposed between the upper watch case body 13 and the lower watch case body 15 for sealing the space between the upper watch case body 13 and the lower watch case body 15 in a sealing state.

For the timepiece 10 with a wireless function in accordance with this embodiment, as shown in FIG. 32, an insulating region 58 is disposed between the bezel 62 and the upper watch case body 13, and between the upper watch case body 13 and the lower watch case body 15.

Moreover, as shown in FIG. 32, the insulating region 58 is formed in the range from a space between the upper surface of the lining receiving portion 32 forms on the upper watch case body 13 and the lower surface of the dial ring 36 disposed on the lining receiving portion 32 to a space between a side face 34*b* of the shoulder section 34 and the outer peripheral face of the dial ring 36.

By forming the insulating region 58 having such a configuration, the conduction between the conductive upper watch case body 13 and the conductive bezel 62, the conduction between the upper watch case body 13 and the lower watch case body 15, and the conduction between the conductive bezel 62 and the conductive dial ring 36 are all blocked.

By the above configuration, the upper watch case body 13 and the conductive bezel 62, the upper watch case body 13 and the lower watch case body 15, and the conductive bezel 62 and the conductive dial ring 36 are insulated from each other, respectively, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the upper watch case body 13, the lower watch case body 15, the bezel 62 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

Embodiment 22

Figure 33:
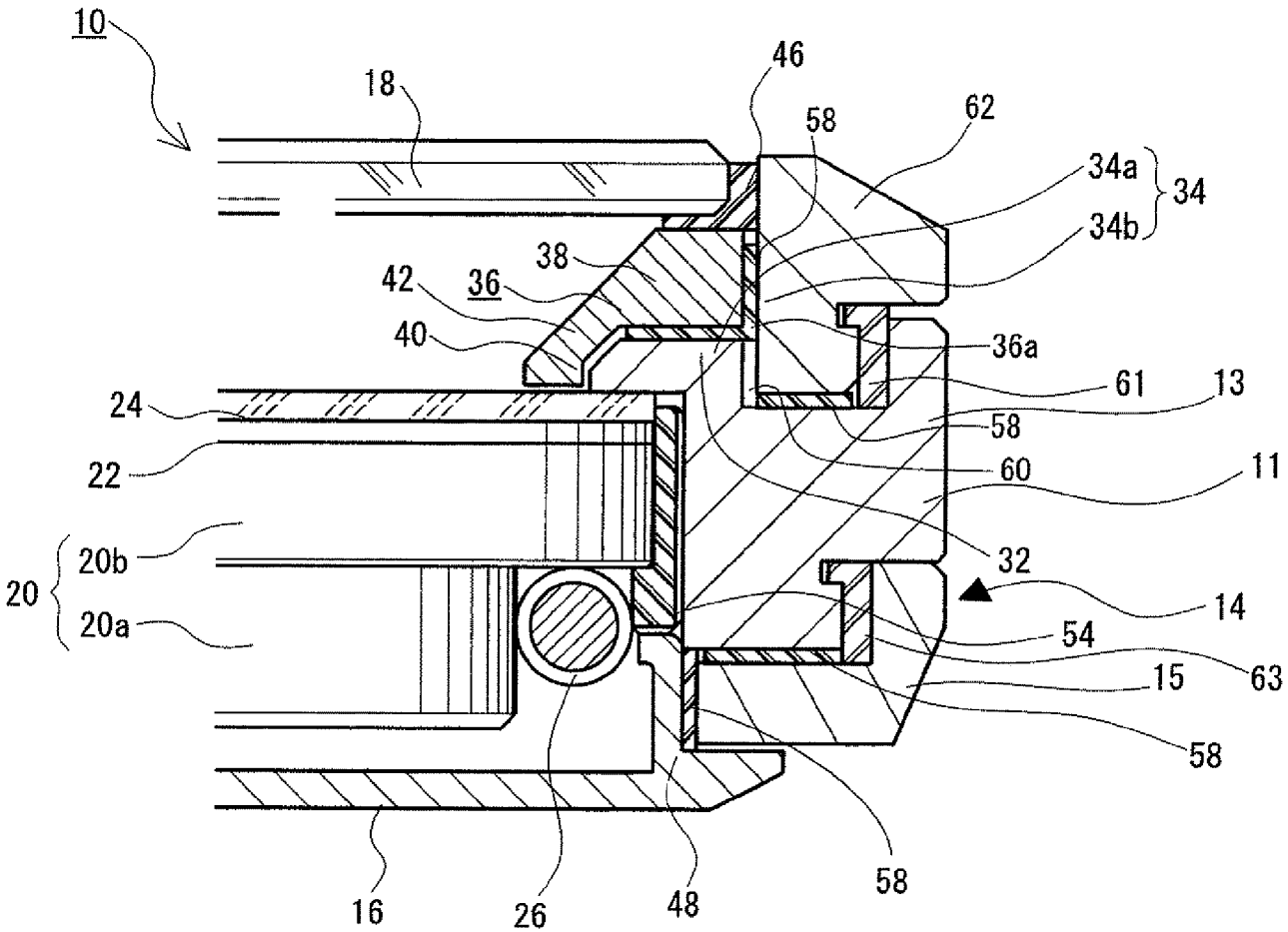
FIG. 33 is a cross-sectional view similar to FIG. 32, which shows a timepiece with a wireless function in accordance with another embodiment of the present invention.
Figure 34:
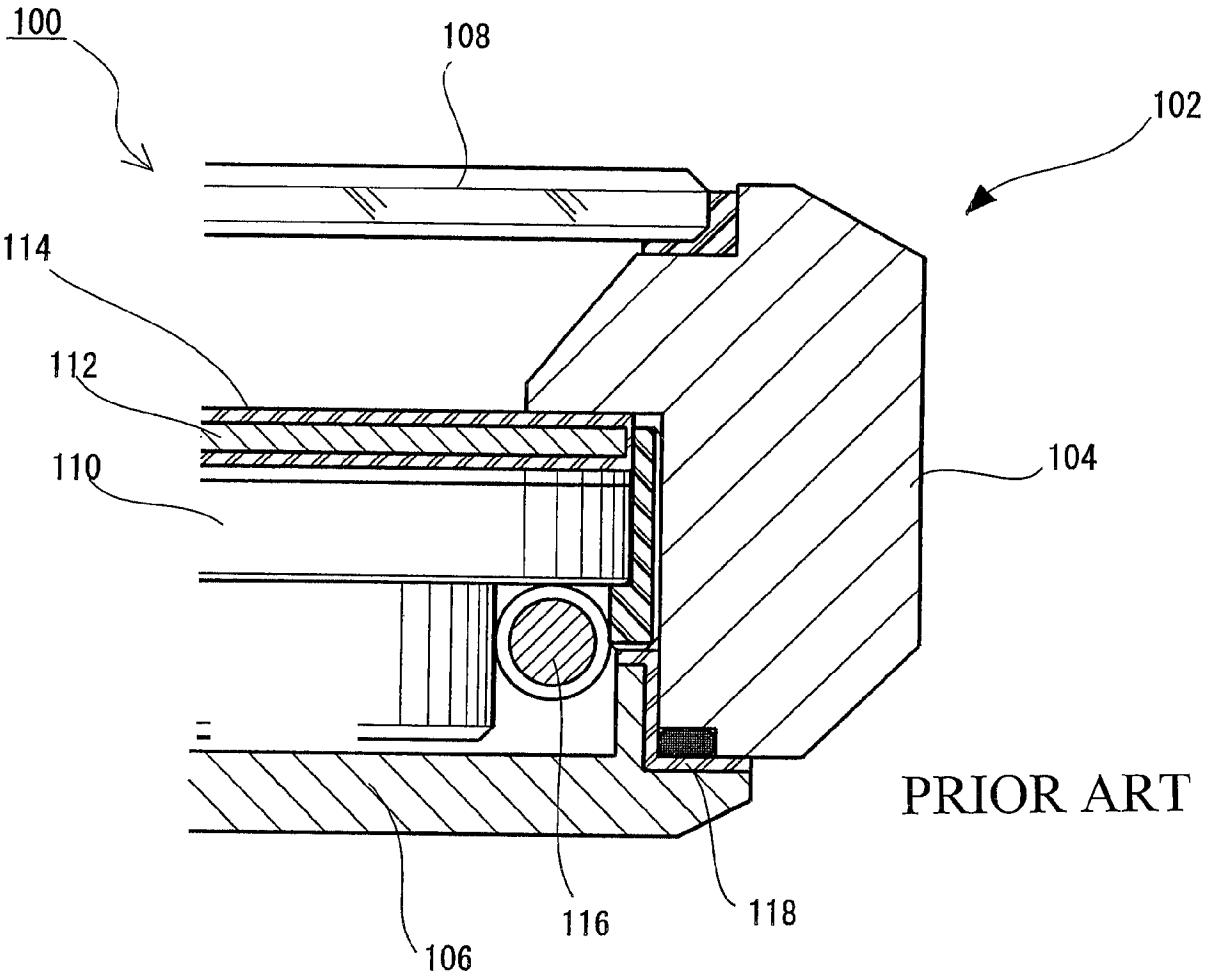
FIG. 34 is a cross-sectional view showing a conventional radio controlled wristwatch.

FIG. 33 is a cross-sectional view showing another embodiment of the timepiece with a wireless function in accordance with the present invention similarly to FIG. 32.

The timepiece 10 with a wireless function in accordance with the embodiment has a configuration basically equivalent to that of the timepiece 10 with a wireless function shown in FIG. 32. Here, elements equivalent to those illustrated in FIG. 32 are numerically numbered similarly and the detailed descriptions of the equivalent elements are omitted.

For the timepiece 10 with a wireless function in accordance with this embodiment, as shown in FIG. 33, an insulating region 58 is disposed in the space between the bezel 62 and the upper watch case body 13, between the upper watch case body 13 and the lower watch case body 15, and between the lower watch case body 15 and the rear cover 16.

Moreover, as shown in FIG. 33, the insulating region 58 is formed in the range from a space between the upper surface of the lining receiving portion 32 formed on the bezel 62 and the lower surface of the dial ring 36 disposed on the lining receiving portion 32 to a space between a side face 34*b* of the shoulder section 34 and the outer peripheral face of the dial ring 36.

By forming the insulating region 58 having such a configuration, the conduction between the conductive upper watch case body 13 and the conductive bezel 62, the conduction between the upper watch case body 13 and the lower watch case body 15, the conduction between the lower watch case body 15 and the rear cover 16, and the conduction between the conductive bezel 62 and the conduction lining receiving portion 32 are all blocked.

By the above configuration, the upper watch case body 13 and the conductive bezel 62, the upper watch case body 13 and the lower watch case body 15, the lower watch case body 15 and the rear cover 16, and the conductive bezel 62 and the conductive dial ring 36 are insulated from each other, respectively, whereby an external radio wave is hard to be shielded by the watch case. Therefore, even in the case in which a conductive watch case or the like is used, the receiving sensitivity of the antenna can be improved.

Moreover, the metal watch case that is a conductive part having the largest volume is separated into a plurality of parts, and the parts are insulated one from the other, whereby a small eddy current is generated for each separated part, that is, a ring member composed of the upper watch case body 13, the lower watch case body 15, the bezel 62 and the dial ring 36, as compared with a large eddy current generated in the case of the watch case of one body that is not separated into a plurality of parts. As a result, a reduction in the receiving sensitivity of the antenna due to the eddy current can be suppressed. Furthermore, even in the case in which a conductive watch case or the like is used, the receiving sensitivity of the antenna 26 can be extremely improved.

A test example using a radio controlled wristwatch in accordance with the above embodiment will described in the following.

<Wristwatch>

Dial ring: brass having a surface on which nickel plating has been applied

Watch case: stainless steel (SUS316L)

Rear cover: stainless steel (SUS316L)

Insulating region: PET film

<Test Contents>

A radio controlled wristwatch having a configuration shown in FIG. 2 was fabricated by assembling the above members. A gain of the antenna disposed in the housing was then measured (test example 1). A received radio wave was a standard radio wave (40 Hz, 60 Hz).

For comparison, a radio wave was received directly without disposing the antenna in the housing (test example 2).

Moreover, a radio controlled wristwatch having a configuration shown in FIG. 2 was fabricated similarly to the test example 1 except that an insulating region was not formed. A gain of the antenna disposed in the housing was then measured (test example 3).

As a result, the test example 1 in which an insulating region was formed has a receiving sensitivity almost equivalent to that of the test example 2 in which a radio wave was received directly without disposing the antenna in the housing. The receiving sensitivity of the test example 1 was extremely improved as compared with the test example 3 in which an insulating region was not formed.

A test example using a radio controlled wristwatch in accordance with the above embodiment will described in the following.

<Wristwatch>

Bezel: stainless steel (SUS316L)

Dial ring: brass having a surface on which nickel plating has been applied

Watch case: stainless steel (SUS316L)

Rear cover: stainless steel (SUS316L)

Insulating region: PET film

<Test Contents>

A radio controlled wristwatch having a configuration shown in FIG. 17 was fabricated by assembling the above members. A gain of the antenna disposed in the housing was then measured (test example 4). A received radio wave was a standard radio wave (40 Hz, 60 Hz).

For comparison, a radio wave was received directly without disposing the antenna in the housing (test example 5).

Moreover, a radio controlled wristwatch having a configuration shown in FIG. 17 was fabricated similarly to the test example 4 except that an insulating region was not formed. A gain of the antenna disposed in the housing was then measured (test example 6).

As a result, the test example 4 in which an insulating region was formed has a receiving sensitivity almost equivalent to that of the test example 5 in which a radio wave was received directly without disposing the antenna in the housing. The receiving sensitivity of the test example 4 was extremely improved as compared with the test example 6 in which an insulating region was not formed.

While the preferred embodiments in accordance with the present invention have been described above, the present invention is not restricted to the embodiments, and various changes and modifications can be thus made without departing from the scope of the present invention. For instance, a variety of methods can be applied to methods for attaching a dial ring to a watch case or a bezel, attaching a dial plate to a watch case, fixing a rear cover to a watch case, and fixing a windshield to a watch case or a bezel, and so on.

In the above embodiments, the insulating region 58 is not disposed in spaces among the dial plate 24, the bezel 62, the dial ring 36, and the watch case body 11. However, in the case in which the dial plate 24 is made of a metal having an electrical conductivity, the insulating region 58 can be disposed between the dial plate 24 and the above members like the above embodiments.

For instance, provided the effect of the present invention can be obtained, an insulating region can be disposed in anyplace. In the embodiments shown in FIGS. 16 and 17, the insulating region 58 is disposed between the upper surface on the inner edge side of the watch case 14 and the lower surface on the inner edge side of the bezel 62. In place of this, the insulating region 58 can also be disposed between the upper surface on the outer edge side of the watch case 14 and the lower surface on the outer edge side of the bezel 62.

Moreover, in the embodiment shown in FIG. 21, an insulating region 58 is disposed between the bottom surface on the bezel holding depression 60 of the watch case 14 and the lower surface of the bezel 62. In place of this, the insulating region 58 can also be disposed between the upper surface on the outer edge side of the watch case 14 and the lower surface of the outer extended portion of the bezel 62. This configuration can also be applied to the embodiment shown in FIG. 25 and the embodiment shown in FIG. 26.

For instance, a variety of methods can be applied to methods for attaching a bezel to a watch case or a dial ring to a watch case, attaching a dial plate to a watch case, fixing a rear cover to a watch case, and fixing a windshield to a bezel, and so on.

A relative position of each part illustrated in the embodiments can be properly modified as needed. Moreover, provided the function of each part is achieved, a material and a shape of each part are not restricted.

The present invention includes an illustrative embodiment in which a rear cover and a watch case are integrated into a single part, an illustrative embodiment in which a dial plate and a watch case are integrated into a single part, and an illustrative embodiment in which a watch case and a windshield are integrated into a single part.

A dial plate can be substituted by a liquid crystal display unit. In the case in which a liquid crystal display unit is used, a display hand can be removed. In the case in which the configuration of a timepiece with a wireless function in accordance with the present invention is applied to a wristwatch, the configuration thereof can display the above described remarkable effect. However, the configuration of a timepiece with a wireless function in accordance with the present invention can also be applied to a clock and a wall clock in addition to a wristwatch.

In the above embodiments, a radio controlled timepiece with a wireless function for receiving a long-wave standard radio wave (carrier wave) including time information and for correcting clock time based on the time information has been described. However, the configuration of a timepiece with a wireless function in accordance with the present invention can also be applied to a timepiece provided with a wireless function such as a personal computer communication function, a cellular phone function, and a noncontact IC card function.

The present invention relates to a timepiece with a wireless function, particularly to a timepiece provided with an antenna capable of receiving a prescribed radio wave and a conductive housing for storing the antenna. More specifically, the present invention can be applied to a timepiece in which a watch case that configures at least a part of the housing and that has at least one portion conductive is provided with a plurality of separated parts such as a conductive body, a conductive bezel, and a conductive dial ring.

The invention claimed is:

1. A timepiece with a wireless function comprising:

a conductive watch case body;

a conductive rear cover;

a windshield;

a non-conductive dial plate;

an antenna that is stored in a housing to receive a radio wave from the external having an opening end on each side thereof; and an insulating region disposed between a dial ring and a lining receiving portion, the lining receiving portion is protruded on an inner peripheral side of the watch case body, wherein the insulating region is disposed around a section above both opening ends of the antenna.

2. The timepiece with a wireless function as defined in claim 1, wherein the insulating region is disposed between an upper surface of the lining receiving portion formed on the watch case body and a lower surface of the dial ring disposed on the lining receiving portion.

3. The timepiece with a wireless function as defined in claim 1, wherein the insulating region is made of an insulating film formed on at least one of the surface of the dial ring and the surface of the watch case body.

4. The timepiece with a wireless function as defined in claim 1, wherein the insulating region is made of an insulating member disposed between the dial ring and the watch case body.

5. The timepiece with a wireless function as defined in claim 4, wherein the insulating member is bonded to the dial ring or the watch case body.

6. The timepiece with a wireless function as defined in claim 1, wherein the insulating region is a region in the lining receiving portion which is above the antenna and between one opening end and the other opening end of the antenna.

* * * * *

UNITED STATES PATENT AND TRADEMARK OFFICE

CERTIFICATE OF CORRECTION

PATENT NO. : 8,328,415 B2
APPLICATION NO. : 12/373534
DATED : December 11, 2012
INVENTOR(S) : Setsuo Kachi et al.

It is certified that error appears in the above-identified patent and that said Letters Patent is hereby corrected as shown below:

Face of the Patent, Item (54) and Column 1, Line 1, Title, delete "CLOCK" and insert -- TIMEPIECE --

Face of the Patent, Column 1, Item (73) Assignee, delete "Citizens" and insert -- Citizen --

Signed and Sealed this
Twelfth Day of February, 2013

Teresa Stanek Rea
*Acting Director of the United States Patent and Trademark Office*